US006231167B1

(12) United States Patent
Tsuboi et al.

(10) Patent No.: US 6,231,167 B1
(45) Date of Patent: May 15, 2001

(54) LIQUID DISCHARGING HEAD, LIQUID DISCHARGING METHOD, HEAD CARTRIDGE, LIQUID DISCHARGING APPARATUS, LIQUID DISCHARGING PRINTING METHOD, PRINTING SYSTEM, HEAD KIT AND HEAD RECOVERY METHOD

(75) Inventors: Hitoshi Tsuboi, Tokyo; Toshio Kashino, Chigasaki; Hiroshi Tajika; Noribumi Koitabashi, both of Yokohama; Osamu Iwasaki, Tokyo; Masaya Uetuki, Yokohama; Hidehiko Kanda, Kawasaki; Masao Kato, Yokohama; Yoshie Asakawa, Nagano-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/889,842

(22) Filed: Jul. 8, 1997

(30) Foreign Application Priority Data

| | | |
|---|---|---|
| Jul. 9, 1996 | (JP) | 8-179632 |
| Jul. 12, 1996 | (JP) | 8-183033 |
| Jul. 12, 1996 | (JP) | 8-183889 |
| Jul. 4, 1997 | (JP) | 9-180123 |

(51) Int. Cl.[7] ..... B41J 2/05

(52) U.S. Cl. ..... 347/65; 347/17; 347/23; 347/48

(58) Field of Search ..... 347/65, 63, 17, 347/14, 23, 26, 48

(56) References Cited

U.S. PATENT DOCUMENTS

| | | | | |
|---|---|---|---|---|
| 4,376,945 | * | 3/1983 | Hara | 347/63 X |
| 4,460,637 | | 7/1984 | Miyamoto et al. . | |
| 4,719,472 | | 1/1988 | Arakawa | 347/17 X |
| 4,785,313 | | 11/1988 | Higuma et al. . | |
| 4,832,984 | | 5/1989 | Hasegawa et al. . | |
| 4,947,194 | * | 8/1990 | Kyoshima | 347/14 X |
| 4,954,395 | | 9/1990 | Hasegawa et al. . | |
| 5,278,585 | | 1/1994 | Karz et al. | 347/65 |
| 5,479,196 | * | 12/1995 | Inada | 347/92 |
| 5,543,826 | * | 8/1996 | Kuronuma | 347/23 |
| 5,601,928 | | 2/1997 | Katayama et al. . | |
| 5,821,962 | * | 10/1998 | Kudo | 347/65 |

FOREIGN PATENT DOCUMENTS

| | | | | |
|---|---|---|---|---|
| 433798 | | 8/1991 | (EP) | B41J/2/14 |
| 0622244 | | 11/1994 | (EP) . | |
| 0636489 | | 2/1995 | (EP) . | |
| 678385 | | 10/1995 | (EP) | B41J/2/05 |
| 56-130364 | * | 10/1981 | (JP) | B41J/3/04 |
| 56-147859 | | 11/1981 | (JP) . | |
| 56-147860 | | 11/1981 | (JP) . | |
| 58-80368 | | 5/1983 | (JP) . | |
| 59-35977 | | 2/1984 | (JP) . | |
| 61-200182 | | 9/1986 | (JP) . | |
| 61-247774 | | 11/1986 | (JP) . | |
| 61-272278 | | 12/1986 | (JP) . | |
| 62-000568 | | 1/1987 | (JP) . | |
| 62-101671 | | 5/1987 | (JP) . | |
| 62-101672 | | 5/1987 | (JP) . | |
| 62-140878 | | 6/1987 | (JP) . | |
| 62-152865 | * | 7/1987 | (JP) | B41J/3/04 |
| 63-57251 | * | 3/1988 | (JP) | B41J/3/04 |
| 1-249869 | | 10/1989 | (JP) . | |
| 1-301760 | | 12/1989 | (JP) . | |
| 5-124189 | | 5/1993 | (JP) | B41J/2/05 |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

There have been desired a liquid discharge method, a liquid discharge head and a liquid discharge apparatus capable of sufficient temperature adjustment for maintaining the viscosity of the discharge liquid within an appropriate range, there by maintaining constantly stable liquid discharge. In this invention, the movable member provided with a heating member simultaneously or individually controls the temperatures of the liquid in the first liquid path and that in the second liquid path.

74 Claims, 45 Drawing Sheets

| ΔT(°C) | <0 | 0 | 0.5 | 1 | 1.5 | 2.0 | · · · · | >15 |
|---|---|---|---|---|---|---|---|---|
| DUTY (%) | 0 | 0 | 1 | 2.5 | 4.5 | 6 | · · · · | 100 |

LIQUID DISCHARGING HEAD, LIQUID DISCHARGING METHOD, HEAD CARTRIDGE, LIQUID DISCHARGING APPARATUS, LIQUID DISCHARGING PRINTING METHOD, PRINTING SYSTEM, HEAD KIT AND HEAD RECOVERY METHOD

BACKGROUND OF THE INVENTION

1. Field of the Invention

The present invention relates to a liquid discharging head for discharging desired liquid by bubble generation induced by application of thermal energy to liquid, a liquid discharging method, a head cartridge, a liquid discharging apparatus, a liquid discharging printing method, a printing system, a head kit and a head recovery method.

2. Related Background Art

There is already known an ink jet printing method, so-called bubble jet printing method, which achieves image formation by providing ink with energy such as heat to induce a state change in the ink, involving a rapid volume change (generation of a bubble), discharging ink from a discharge opening by the action force based on such state change, and depositing thus discharged ink onto a printing medium. In the printing apparatus utilizing such bubble jet printing method, there are generally provided, as disclosed for example in the U.S. Pat. No. 4,723,129, a discharge port for ink discharge, an ink flow path communicating with the discharge port, and an electrothermal converting member provided in the ink flow path and constituting energy generating means for generating energy for discharging the ink.

Such printing method provides various advantages such as printing an image of high quality at a high speed with a low noise level, and obtaining a printed image of a high resolution, even a color image, with a compact apparatus, since, in the printing head utilizing such printing method, ink discharge ports can be arranged at a high density. For this reason, such bubble jet printing method is being recently utilized not only in various office equipment such as printers, copying machines and facsimile apparatus but also in industrial systems such as textile printing apparatus.

With such spreading of the bubble jet printing technology into the products of varied fields, there have emerged various requirements to be explained in the following.

For example, for a requirement for improving the efficiency of energy, there is conceived optimization of the heat generating member, such as the adjustment of the thickness of the protective film. This technology is effective in improving the efficiency of propagation of the generated heat to the liquid.

Also for obtaining the image of higher quality, there have been proposed a driving condition for satisfactory liquid discharge, realizing a higher ink discharge speed and stable bubble generation, and an improved shape of the liquid flow path for realizing a liquid discharge head with a higher refilling speed of the discharged liquid into the liquid flow path.

Among such liquid flow path shapes, a liquid flow path structure shown in FIGS. 64A and 64B is disclosed for example in the Japanese Patent Laid-open Application No. 63-199972. The liquid flow path structure and the head manufacturing method disclosed in the above mentioned patent application are based on an invention utilizing a backward wave (pressure directed opposite to the discharge opening, namely toward a liquid chamber 12), resulting from the bubble generation.

The invention shown in FIGS. 64A and 64B discloses a valve 10, which is positioned separate from the generation area of the bubble generated by a heat generating element 2 and opposite to the discharge port 11 with respect to the heat generating element 2.

In FIG. 64B, the valve 10 is so disclosed, by a manufacturing method utilizing for example a plate member, as to have an initial position sticking to the ceiling of the liquid flow path 3 and to hang down into the liquid flow path 3 with the generation of a bubble. This invention is disclosed to suppress the energy loss by controlling a part of the above-mentioned backward wave by the valve 10.

However, in such structure, the suppression of a part of the backward wave by the valve 10 is not practical for the liquid discharge, as will be made apparent by the consideration of bubble generation in the liquid flow path 3 containing the liquid to be discharged.

The backward wave itself is not related to the liquid discharge as explained before. At a point when the backward wave is generated in the liquid flow path 3, the pressure resulting from the bubble and relating directly to the liquid discharge renders the liquid dischargeable from the liquid flow path 3 as illustrated in FIG. 64A. It will be apparent, therefore, that the suppression of the backward wave, or a part thereof, does not significantly influence the liquid discharge.

On the other hand, in the bubble jet printing method, a deposit is generated on the surface of the heat generating member by the scorching or cogation of the ink since heating is repeated in a state where the heat generating member is in contact with the ink, and, depending on the kind of the ink, such deposit is generated in a large amount to render the bubble generation unstable, whereby satisfactory ink discharge may become difficult. For this reason there has been desired a method for achieving satisfactory discharge without denaturing the liquid to be discharged, even in case of a liquid which is susceptible to heat or is incapable of sufficient bubble generation.

In view of the foregoing points, a method of constituting the liquid for generating bubble by heat (bubble generating liquid) and the liquid to be discharge (discharge liquid) by different liquids and discharging such discharge liquid by transmitting the pressure of bubble generation to such discharge liquid is disclosed for example in the Japanese Patent Laid-open Application Nos. 61-69467 and 55-81172 and U.S. Pat. No. 4,480,259. In these patents, there is employed a configuration of completely separating the ink or discharge liquid from the bubble generating liquid with a flexible membrane such as of silicone rubber thereby avoiding the direct contact of the two, and transmitting the pressure of bubble generation in the bubble generating liquid to the discharge liquid by the deformation of the flexible membrane. It is intended by such configuration to prevent generation of deposit on the surface of the heat generating member and to improve freedom in the selection of the discharge liquid.

However, in a head of the above-explained configuration where the discharge liquid and the bubble generating liquid are completely separated, the pressure of bubble generation, to be transmitted to the discharge liquid by the elongating deformation of the flexible membrane, is considerably absorbed by such flexible membrane. Also as the amount of deformation of the flexible membrane is not so large, there will result a loss in the energy efficiency and in the discharging force, though the effect of separation of the discharge liquid and the bubble generating liquid can be obtained.

The principal objective of the present invention is to elevate the basic discharge characteristics of the basic method of discharging liquid by generating a bubble (particularly bubble formed by film boiling) in the liquid flow path to a conventionally unexpected level, based on a view point that cannot be anticipated in the past.

A part of the present inventors has made intensive research, based on the basic principle of liquid droplet discharge, to provide a conventionally unavailable liquid discharging method and a head to be used therein. In such research, the analysis of the principle of the mechanism of the movable member in the liquid path has lead to the establishment of a completely novel technology for actively controlling the bubble by positioning the fulcrum and the free end of the movable member in such a manner that the free end is positioned at the side of the discharge port or namely at the downstream side and also by positioning the movable member so as to face to the heat generating member or the bubble generating area, wherein the improvement in the discharge efficiency and the discharge speed is achieved by efficiently directly the growing portion of the bubble at the downstream side thereof toward the liquid discharge direction. Based on these facts, a part of the present inventors has reached an extremely high technical level, in comparison with the conventional one, of actively moving the growing portion of the bubble at the downstream side thereof toward the free end side of the movable member.

The present applicant already filed patent applications on facts that, in the heat generating area for bubble generation, it is preferable to consider the structural components such as the movable member and liquid flow path relating to the growth of bubble in the downstream side, in the liquid flowing direction, of the central line passing through the area center of the electrothermal converting member or in the downstream side of the center of area of the surface governing the bubble generation, and that the liquid refilling speed can be significantly improved by the consideration of position of the movable member and the structure of the liquid supply path. Representative ones of such applications are application Ser. No. 08/586,095, filed Jan. 16, 1996, entitled "LIQUID EJECTING HEAD", application Ser. No. 08/586,260, filed Jan. 16, 1996, entitled "LIQUID EJECTING HEAD", application Ser. No. 08/586,261, filed Jan. 16, 1996, entitled "LIQUID EJECTING HEAD" and application Ser. No. 08/632,667, filed Apr. 15, 1996, entitled "LIQUID EJECTING HEAD".

However, the present inventors have found, in the liquid discharging apparatus in which the discharge liquid and the bubble generating liquid are separated by a movable member, a new drawback that the liquid in a flow path separate from the substrate cannot receive sufficient temperature adjustment by the heater for heating the substrate or by the heater for bubble generation and is also unstable in response time.

SUMMARY OF THE INVENTION

A principal object of the present invention is to provide an extremely novel liquid discharging principle through basic control of the generated bubble, or more specifically a configuration of separating the bubble generating area and an area distant from such bubble generating area by means of a movable member thereby efficiently utilizing, by means of such movable member, the expansive force of the generated bubble for the driving force for the liquid discharge, and to enable sufficient heating of the liquid contained in the flow path separated by the movable member and including the discharge port in the above-mentioned specific configuration, thereby providing a liquid discharging head, a liquid discharging method, a head cartridge, a liquid discharging apparatus, a liquid discharging printing method, a printing system, a head kit and a heat recovery method which allow constantly stable liquid discharge, maintaining a constant discharge amount.

The above-mentioned objects can be attained, according to a first aspect of the present invention, by a liquid discharge head comprising:

a discharge port for discharging liquid;

a bubble generating area for generating a bubble in the liquid; and a movable member positioned facing the bubble generating area and movable between a first position and a second position which is farther from the bubble generating area than the first position;

wherein the movable member is adapted to displace from the first position to the second position by the pressure based on the bubble generation in the bubble generating area, whereby the displacement of the movable member causes the bubble to expand in the downstream side than in the upstream side of the liquid flow direction toward the discharge port, and the movable member is provided with heating means.

According to a second aspect of the present invention, there is provided a liquid discharge head comprising:

a first liquid path communicating with a discharge port;

a second liquid path having a bubble generating area for applying heat to liquid thereby generating a bubble therein; and a movable member positioned between the first liquid path and the bubble generating area and having a free end at the side of the discharge port wherein the free end is displaced toward the first liquid path by the pressure of bubble generation in the bubble generating area to guide the pressure toward the discharge port.

wherein the movable member is provided with heating means.

According to a third aspect of the present invention, there is provided a liquid discharge head comprising:

a heat generating member for generating a bubble in liquid;

a discharge port for discharging the liquid, so formed as to substantially oppose in parallel manner to the bottom face of a liquid flow path constituting the flow path of the liquid;

a movable member provided between the bottom face of the liquid flow path and the discharge port and adapted to displace from a first position by the bubble; and a fixed counter face formed so as to opposed to a face, at the bottom face side of the liquid path, of the movable member when the free end thereof is displaced by the bubble for guiding the bubble toward the discharge port in cooperation with the movable member at the displacement thereof;

wherein the movable member is provided with heating means.

According to a fourth aspect of the present invention, there is provided a liquid discharge head comprising:

a first liquid path communicating with a discharge port;

a second liquid path having a bubble generating area for applying heat to liquid thereby generating a bubble therein;

a movable member positioned between the first liquid path and the bubble generating area and having a free end at the side of the discharge port wherein the free end is displaced toward the first liquid path by the pressure of bubble generation in the bubble generating area to guide the pressure toward the discharge port; and a fixed counter face formed so as to opposed to a face, at the bottom face side of the liquid path, of the movable member when the free end thereof is displaced by the bubble for guiding the bubble toward the discharge port in cooperation with the movable member at the displacement thereof;

wherein the movable member is provided with heating means.

According to a fifth aspect of the present invention, there is provided a liquid discharge head comprising:

a first liquid path communicating with a discharge port;

a second liquid path having a bubble generating area for applying heat to liquid thereby generating a bubble therein; and a movable member positioned between the first liquid path and the bubble generating area and having a free end at the side of the discharge port wherein the free end is displaced toward the first liquid path by the pressure of bubble generation in the bubble generating area to guide the pressure toward the discharge port;

wherein the head further comprises heating means for directly heating at least the liquid in the first liquid path.

According to a sixth aspect of the present invention, there is provided a liquid discharging method utilizing a liquid discharging head including a first liquid path communicating with a discharge port, a second liquid path having a bubble generating area and a movable member having a free end at the side of the discharge port and positioned between the first liquid path and the bubble generating area, and adapted to discharge liquid by generating a bubble in the bubble generating area, to displace the free end of the movable member toward the first liquid path by the pressure resulting from the generation of the bubble and to guide the bubble toward the discharge port of the first liquid path by the displacement of the movable member;

wherein provided is heating means for directly heating the liquid in the first liquid path, thereby heating at least the liquid in the first liquid path.

According to a seventh aspect of the present invention, there is provided a liquid discharging method utilizing a liquid discharging head including a first liquid path communicating with a discharge port, a second liquid path having a bubble generating area and a movable member having a free end at the side of the discharge port and positioned between the first liquid path and the bubble generating area, and adapted to discharge liquid by generating a bubble in the bubble generating area, displacing the free end of the movable member toward the first liquid path by the pressure resulting from the generation of the bubble and guiding the bubble toward the discharge port of the first liquid path by the displacement of the movable member;

wherein provided are first temperature adjusting means for adjusting the temperature of first liquid in the first liquid path and second temperature adjusting means for adjusting the temperature of second liquid in the second liquid path, and the first and second temperature adjusting means are set at different temperatures.

According to an eighth aspect of the present invention, there is provided a liquid discharging apparatus comprising:

a liquid discharging head including a grooved member integrally having plural discharge ports for discharging liquid, plural grooves for respectively constituting first liquid paths directly communicating with the discharge ports, and a recess constituting a first common liquid chamber for supplying the plural first liquid paths with the liquid; an element substrate provided with plural heat generating members for generating bubbles in the liquid by heat supply thereto; and a partition wall positioned between the grooved member and the element substrate, constituting a part of the walls of the second liquid paths corresponding to the heat generating members, and provided with plural movable members to be respectively displaced toward the first liquid paths by the pressure of the bubble generation; and temperature adjustment means for individually or collectively adjusting the temperature of the liquid in the first liquid paths and that in the second liquid paths.

According to a ninth aspect of the present invention, there is provided a liquid discharging printing method utilizing a liquid discharging head including a first liquid path communicating with a discharge port, a second liquid path having a bubble generating area and a movable member having a free end at the side of the discharge port and positioned between the first liquid path and the bubble generating area, and adapted to discharge printing liquid by generating a bubble in the bubble generating area, displacing the free end of the movable member toward the first liquid path by the pressure resulting from the generation of the bubble and guiding the bubble toward the discharge port of the first liquid path by the displacement of the movable member;

wherein the printing method is featured by adjusting the temperature of the liquid in the first liquid path and that in the second liquid path.

According to a tenth aspect of the present invention, there is provided a liquid discharging apparatus comprising:

a liquid discharging head including a first liquid path communicating with a discharge port; a second liquid path having a bubble generating area for applying heat to liquid thereby generating a bubble therein; a movable member positioned between the first liquid path and the bubble generating area and having a free end at the side of the discharge port wherein the free end is displaced toward the first liquid path by the pressure of bubble generation in the bubble generating area to guide the pressure toward the discharge port; and a sub heater for adjusting the temperature of the liquid in at least either of the first and second liquid paths;

drive signal supply means for supplying a drive signal for causing the liquid discharging head to discharge the liquid; and recovery means for the liquid discharging head.

According to an eleventh aspect of the present invention, there is provided a liquid discharging apparatus comprising:

a liquid discharging head including a grooved member integrally having plural discharge ports for discharging liquid, plural grooves for respectively constituting first liquid paths directly communicating with the discharge ports, and a recess constituting a first common liquid chamber for supplying the plural first liquid paths with the liquid; an element substrate provided with plural heat generating members for generating bubbles in the liquid by heat supply thereto; a partition wall positioned between the grooved member and the element substrate, constituting a part of the walls of the second liquid paths corresponding to the heat generating members, and provided with plural movable members to be respectively displaced toward the first liquid paths by the pressure of the bubble generation; and a sub heater provided on the partition wall for adjusting the temperature in at least either of the first and second liquid paths;

drive signal supply means for supplying a drive signal for causing the liquid discharging head to discharge the liquid; and recovery means for the liquid discharging head.

According to a twelfth aspect of the present invention, there is provided a liquid discharging apparatus comprising:

a liquid discharging head including a first liquid path communicating with a discharge port; a second liquid path having a bubble generating area for applying heat to liquid thereby generating a bubble therein; a movable member positioned between the first liquid path and the bubble generating area and having a free end at the side of the discharge port wherein the free end is displaced toward the first liquid path by the pressure of bubble generation in the bubble generating area to guide the pressure toward the discharge port; and a sub heater for adjusting the temperature of the liquid in at least either of the first and second liquid paths;

print medium transport means for transporting a print medium for receiving the liquid discharged from the liquid discharging head; and recovery means for the liquid discharging head.

According to a thirteenth aspect of the present invention, there is provided a liquid discharging apparatus comprising:

a liquid discharging head including a grooved member integrally having plural discharge ports for discharging liquid, plural grooves for respectively constituting first liquid paths directly communicating with the discharge ports, and a recess constituting a first common liquid chamber for supplying the plural first liquid paths with the liquid; an element substrate provided with plural heat generating members for generating bubbles in the liquid by heat supply thereto; a partition wall positioned between the grooved member and the element substrate, constituting a part of the walls of the second liquid paths corresponding to the heat generating members, and provided with plural movable members to be respectively displaced toward the first liquid paths by the pressure of the bubble generation; and a sub heater provided on the partition wall for adjusting the temperature in at least either of the first and second liquid paths;

print medium transporting means for transporting a print medium for receiving the liquid discharged from the liquid discharging head; and recovery means for the liquid discharging head.

The present invention is applicable to an apparatus such as a printer for printing on various printing media such as paper, yarn, fiber, textile, leather, metal plastics, glass, timber, ceramics etc., a copying machine, a facsimile provided with a communication system, or a word process provided with a printer unit, and also to an industrial printing apparatus integrally combined with various processing apparatus.

In the present invention, the work "print" means not only provision, onto the printing medium, of a meaningful image such as a character or graphics but also provision of a meaningless image such as a pattern.

Also in the present invention, the work "upstream" or "downstream" refers to the direction of flow of the liquid from the supply source through the bubble generating area (or the movable member) toward the discharging orifice, or the direction in the configuration related to such flow.

Also the word "downstream side" of the bubble itself represents the part of the bubble at the side of the discharge port, considered to principally contribute to the discharge of liquid droplet. More specifically it means a part of the bubble, generated in the downstream side in the above-mentioned flow direction or configurational direction with respect to the center of the bubble or generated in the area at the downstream side with respect to the center of the area of the heat generating member.

Also the word "partition wall" means, in a wide sense, a wall (that may include the movable member) so provided as to divide the bubble generating area and the area directly communicating with the discharging orifice, and, in a narrower sense, a member which separates that liquid path including the bubble generating area from the liquid path directly communicating with the discharge port and avoids mixing liquids present in these areas, and may include the movable member only, the partition wall excluding the movable member or both.

BRIEF DESCRIPTION OF THE DRAWINGS

FIGS. 12A and 12B are cross-sectional views, along the liquid path, of a liquid discharging head of two-path configuration for liquid discharge by bubble generation, capable of temperature adjustment of the discharge liquid and the bubble generating liquid by the partition wall, wherein FIG. 12A shows a configuration in which a heat generating member is incorporated in the partition wall and/or the movable member, while FIG. 12B shows a configuration in which a heat insulation layer is provided at the side of the second liquid path of the partition wall and/or the movable member;

DESCRIPTION OF THE PREFERRED EMBODIMENTS

Now the present invention will be clarified in detail by embodiments thereof, with reference to the attached drawings.

[First Embodiment]

The present embodiment adopts a doubled liquid path configuration to divide the used liquid into bubble generating liquid which generates a bubble by heat application and discharge liquid which is principally discharged.

Figure 1:
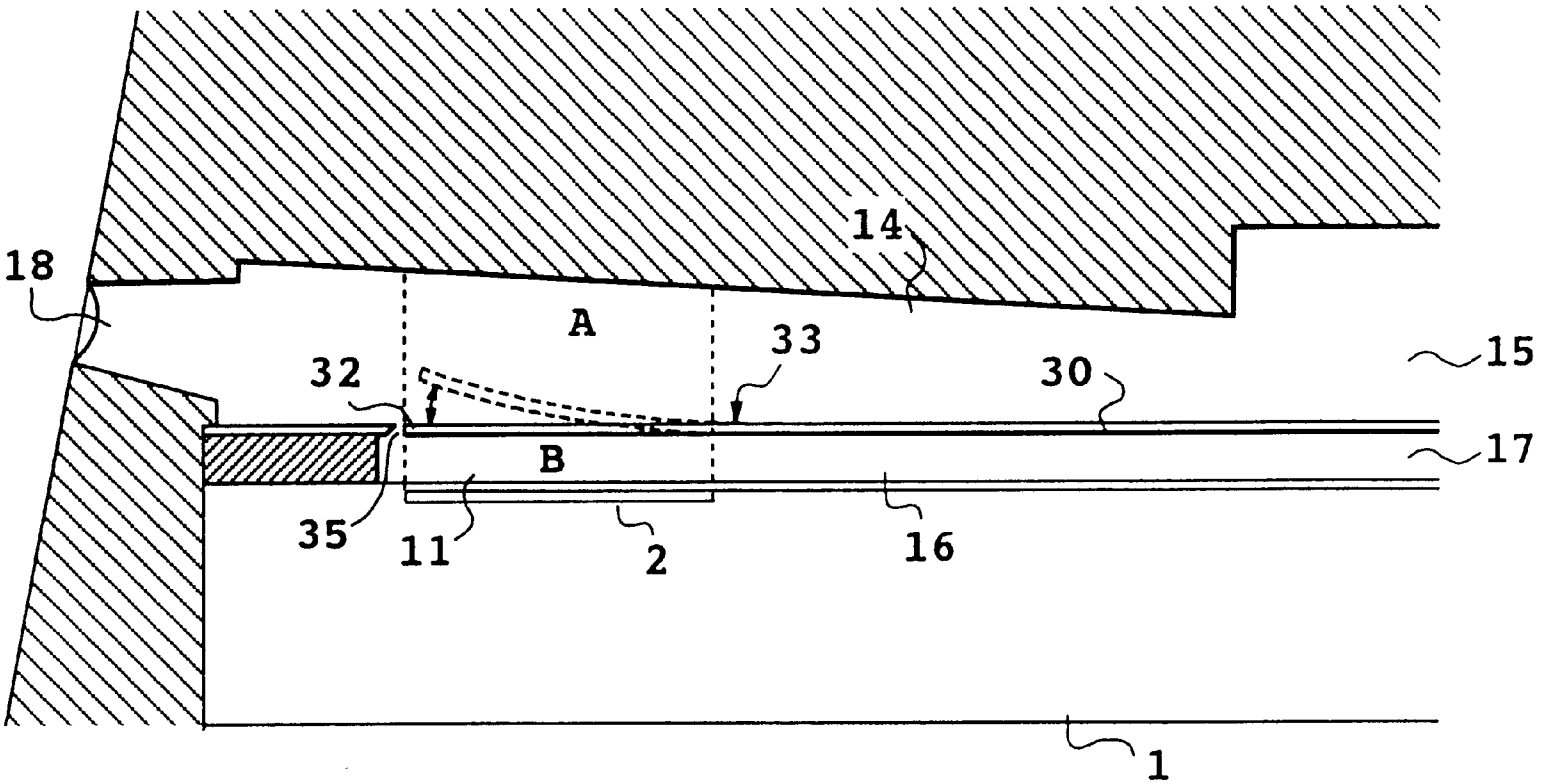
FIG. 1 is a schematic cross-sectional view showing an embodiment of the liquid discharging head of the present invention.
Figure 2:
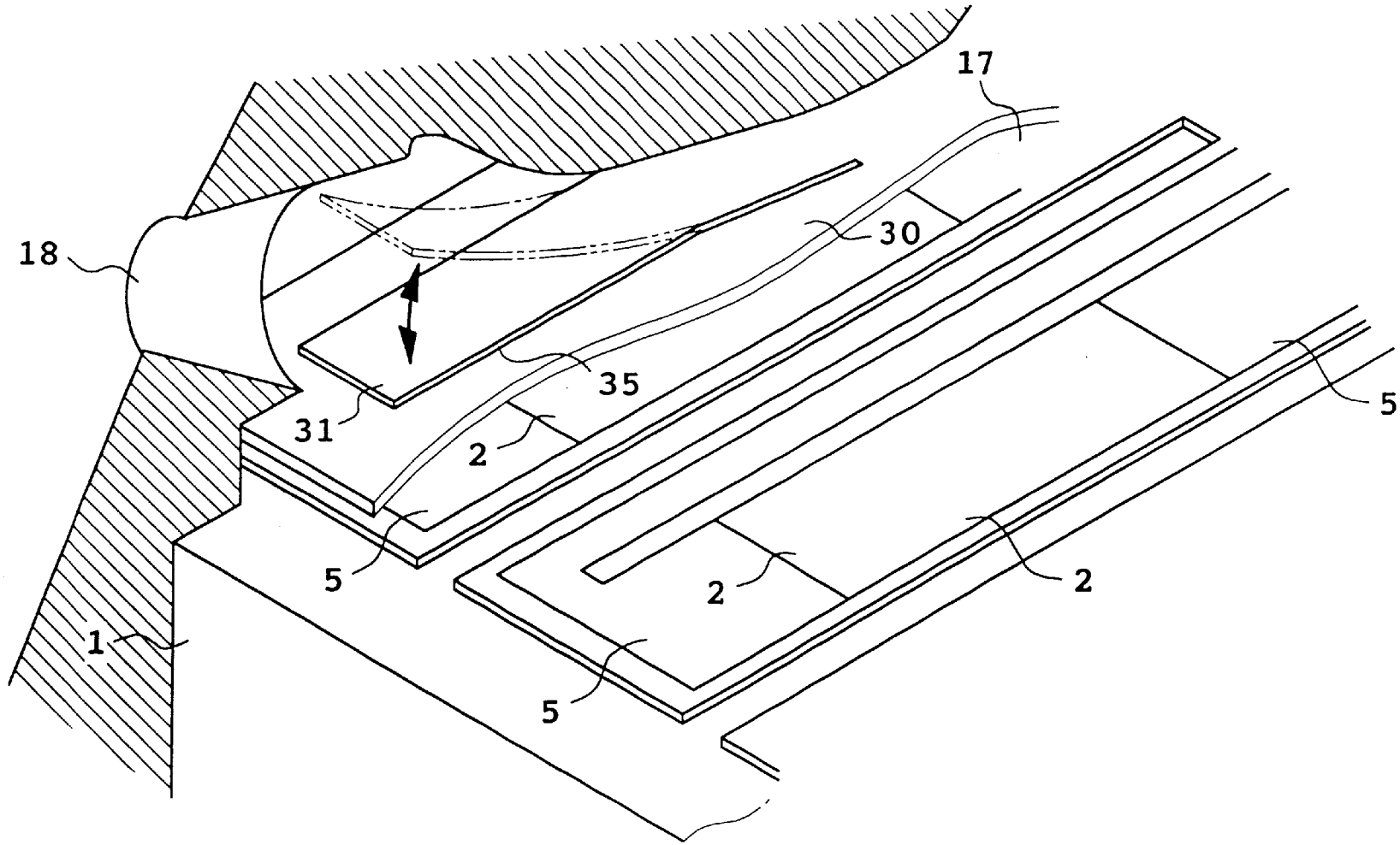
FIG. 2 is a partially cut-off perspective view of a liquid discharge head of the present invention.

FIG. 1 is a schematic cross-sectional view of the liquid discharging head of the present embodiment along the liquid path, and FIG. 2 is a partially cut-off perspective view of such liquid discharging head.

The liquid discharging head of the present embodiment is provided, on an element substrate 1 on which a heat generating member 2 for supplying the liquid with thermal energy for bubble generation is formed, with a liquid path 16 for second liquid for the bubble generating liquid, and thereon with a liquid path 14 for first liquid as the discharge liquid, communicating directly with a discharge port 18.

The upstream side of the first liquid path 14 communicates with a first common liquid chamber 15 for supplying the discharge liquid to the plural first liquid paths 14, while the upstream side of the second liquid path 16 communicates with a second common liquid chamber 17 for supplying the bubble generating liquid to the plural second liquid paths 16.

Between the first and second liquid paths 14, 16 there is provided a partition wall 30 composed of an elastic material such as a metal, for separating the paths 14 and 16. In case the bubble generating liquid and the discharge liquid are to be least mixed, it is desirable to separate, as far as possible, the liquid of the first liquid path 14 and that of the second liquid path 16 by the partition wall 30, but, in case the bubble generating liquid and the discharge liquid may be mixed to a certain extent, the partition wall 30 need not be given the function of such complete separation.

In a space defined by projecting the heat generating member 2 upwards (space corresponding to an area A and the bubble generating area B (11) in FIG. 1 and hereinafter called a discharge pressure generating area), the partition wall constitutes a movable member 31 in the form of a beam supported at an end, having a free end defined by a slit 35 at the side of the discharge port (at the downstream side in the liquid flow) and a fulcrum 33 at the side of the common liquid chambers 15, 17. The movable member 31, being so positioned as to face the bubble generating area 11 (B), is opened toward the discharge port 18 of the first liquid path 14 (as indicated by an arrow in FIG. 1, by the bubble generation in the bubble generating liquid. Also in FIG. 2, it will be understood that the partition wall 30 is positioned, across a space constituting the second liquid path 16, above the element substrate 1 which bears thereon a heat-generating resistance constituting a heat generating member 2 and a wiring electrode 5 for supplying the heat-generating resistance with an electrical signal.

Now reference is made to FIGS. 3 to 6 for explaining the function of the liquid discharge head of the present embodiment.

The head of the present embodiment was driven with same aqueous ink as the discharge liquid to be supplied to the first liquid path 14 and as the bubble generating liquid to be supplied to the second liquid path 16.

The heat generated by the heat generating member 2 is applied to the bubble generating liquid contained in the bubble generating area of the second liquid path to generate a bubble 40 therein by the film boiling phenomenon, as disclosed in the U.S. Pat. No. 4,723,129.

Figure 3:
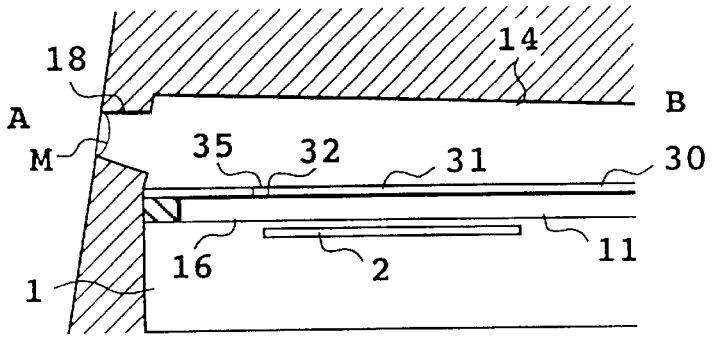
FIG. 3 is a schematic view showing the function in the head of the present invention.
Figure 4:
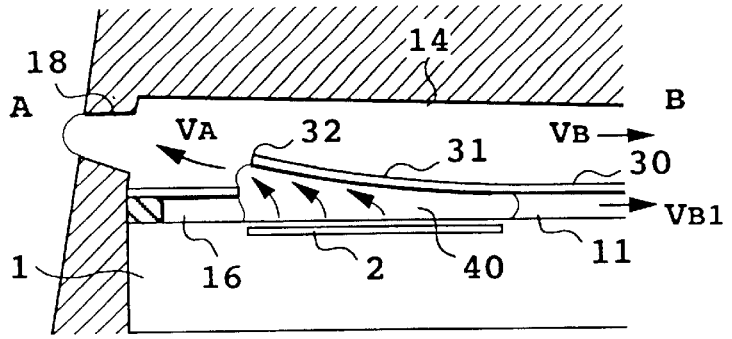
FIGS. 4, 5 and 6 are schematic views showing the pressure propagation from a bubble in a head of the present invention.
Figure 5:
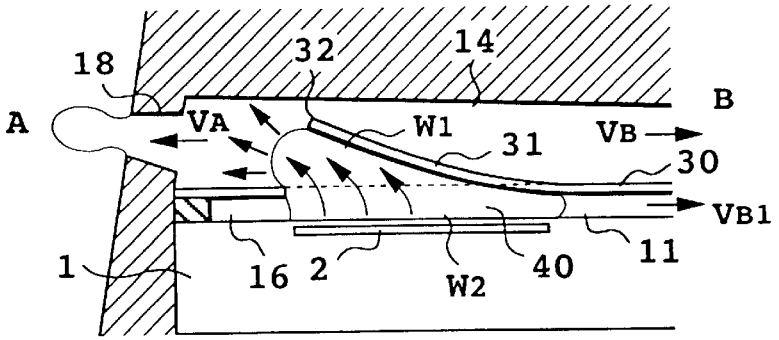

In the present embodiment, since the bubble-generated pressure cannot escape from the bubble generating area in the three directions thereof, except for the upstream side, such pressure propagates in concentrated manner to the movable member 31 provided in the discharge pressure generating area, and, with the growth of the bubble, the movable member 31 displaces from the state shown in FIG. 3 toward the first liquid path 14 as shown in FIG. 4. By such function of the movable member 31, the first liquid path 14 communicates widely with the second liquid path 16 and the bubble-generated pressure is principally transmitted toward the discharge port 18 (direction A) in the first liquid's liquid path 14. With further growth of the bubble 40 as shown in FIGS. 5 and 6, the liquid is discharged from the discharge port 18 by the propagation of such pressure, combined with the mechanical displacement of the movable member 31.

Figure 6:
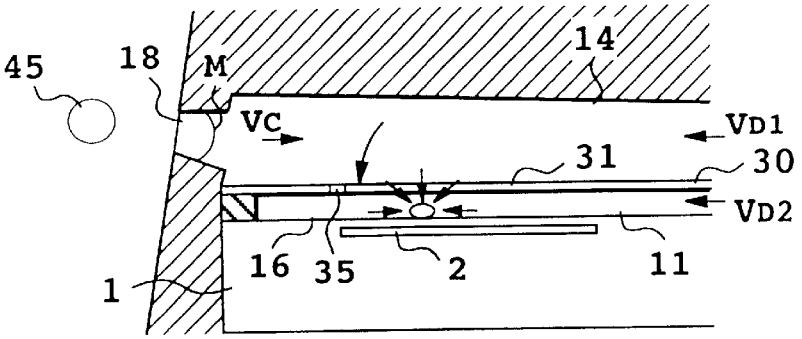

Then, with the contraction of the bubble, the movable member 31 returns through a state shown in FIG. 6 to a state shown in FIG. 3 and, in the first liquid path 14, the discharge liquid of an amount, corresponding to that of the discharged liquid, is replenished from the upstream side. The refilling of the discharge liquid is not hindered by the movable member 31, as the liquid is supplied in the closing direction of the movable member 31.

Now there will be explained one of the basic discharging principles of the present invention. In the present invention, one of the most important principles is that the movable member 31, so positioned as to oppose to the bubble, is displaced from a first position in the stationary state to a second displaced position by the pressure of the bubble or by the bubble itself and such displacing movable member 31 guides the bubble-generated pressure and the bubble itself toward the downstream side where the discharge port 18 is provided.

Figure 7:
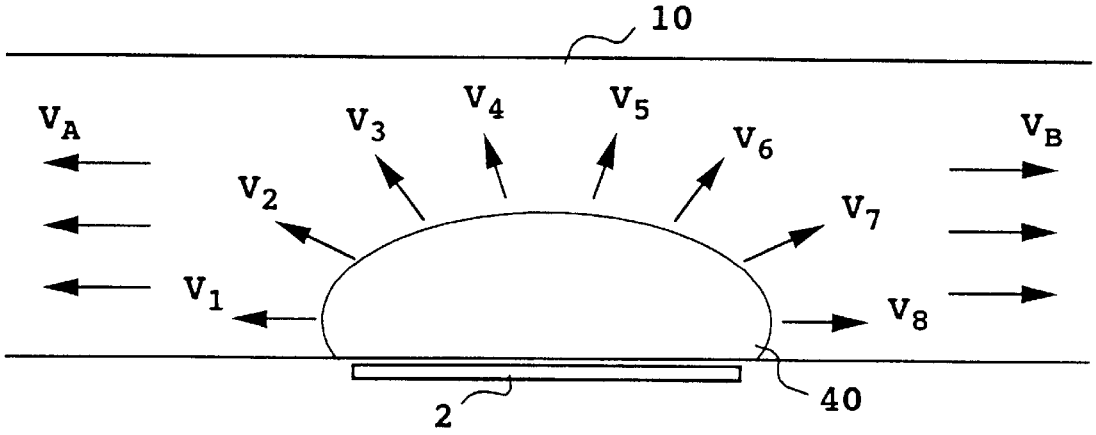
FIG. 7 is a schematic view showing pressure propagation from the bubble in a conventional head.
Figure 8:
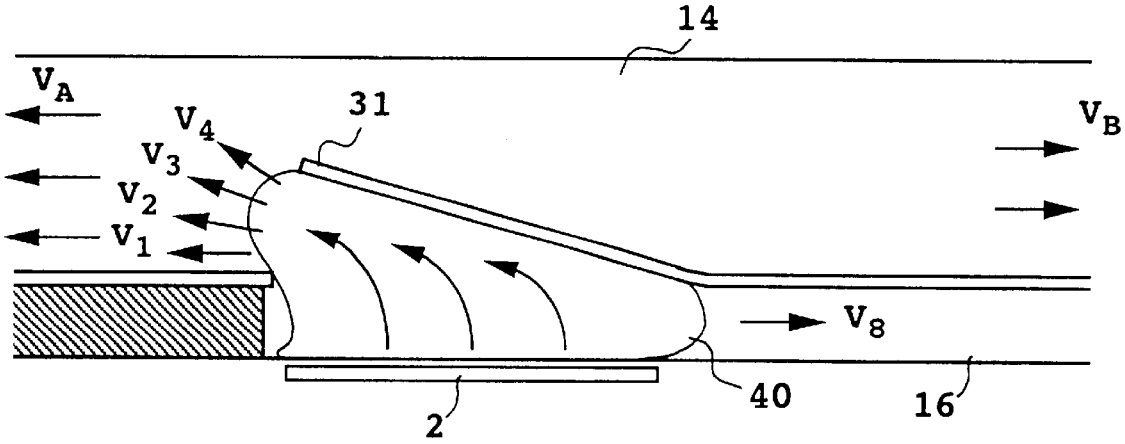
FIG. 8 is a schematic view showing pressure propagation from the bubble in a head of the present invention.

This principle will be explained in further details, with reference to FIG. 7 schematically showing the configuration of the conventional liquid path without the movable member 31 and FIG. 8 showing the configuration of the present invention, wherein $V_A$ stands for pressure propagating direction toward the discharge port 18, and $V_B$ stands for that toward the upstream side.

The conventional head as shown in FIG. 7 lacks any configuration limiting the propagating direction of the pressure resulting from the generated bubble 40. Consequently the pressure propagates in various directions, respectively perpendicular to the surface of the bubble 40, as indicated by $V_1$–$V_8$. Among these directions, those having a component in the pressure propagating direction $V_A$ showing the largest influence on the liquid discharge are $V_1$–$V_4$, which are generated in an about a half, closer to the discharge port 18, of the bubble, and which constitute an important portion directly contributing to the liquid discharge efficiency, the liquid discharge power and the liquid discharge speed. The direction $V_1$ is most efficient as it is closest to the discharge direction $V_A$, while $V_4$ contains a relatively small component in the direction $V_A$.

On the other hand, in the configuration of the present invention shown in FIG. 8, the movable member 31 aligns the pressure propagating directions $V_1$–$V_4$, which are in various directions in the configuration shown in FIG. 7, toward the downstream side (toward the discharge port 18), namely in the propagating direction $V_A$, whereby the pressure of the bubble 40 contributes to the liquid discharge directly and efficiently. Also the growth itself of the bubble is guided toward the downstream side, like the pressure propagating directions $V_1$–$V_4$, whereby the bubble grows larger in the downstream side than in the upstream side. Such control of the growing direction itself of the bubble and of the pressure propagating direction thereof by the movable member 31 enables fundamental improvements in the discharge efficiency, the discharge power and the discharge speed.

Now reference is made again to FIGS. 3 to 6, for explaining the discharging operation of the liquid discharge head of the present embodiment.

FIG. 3 shows a state prior to the application for example of electric energy to the heat generating member 2, thus prior to the heat generation thereby.

FIG. 4 shows a state where the heat generating member 2 generates heat by the application for example of electrical energy, and a part of the liquid in the bubble generating area 11 is heated by the generated heat to have generated a bubble 40 by film boiling.

In this state, the movable member 31 displaces from a first position to a second position, by the pressure resulting from the generation of the bubble 40, so as to guide the propagating direction of the pressure of the bubble 40 toward the discharge port. In this state, it is important, as mentioned before, that the free end 32 of the movable member 32 is provided at the downstream side (side of the discharge port) and the fulcrum 33 is provided at the upstream side (side of the common liquid chamber) whereby at least a part of the movable member 31 is opposed to the downstream portion of the heat generating member 2 or of the bubble.

FIG. 5 shows a state in which the bubble grows further and the movable member 31 is displaced further by the pressure resulting from the generation of the bubble 40. The generated bubble 40 grows larger in the downstream side than in the upstream side and continues growth beyond the broken-lined first position of the movable member 31. The gradual displacement of the movable member 31 in the course of the growth of the bubble 40 is considered to align the pressure propagating direction of the bubble 40 and the direction of easy volume movement thereof, namely the growth direction of the bubble toward the free end side, uniformly toward the discharge opening 18, thereby improving the discharge efficiency. The movable member 31 performs positive contribution in guiding the bubble itself and the pressure thereof toward the discharge port 18, and can efficiently control the pressure propagating direction and the bubble growing direction.

FIG. 6 shows a state in which the bubble 40 contracts and vanishes by the decrease of the pressure in the bubble, after the film boiling mentioned above.

The movable member 31, having displaced to the second position, returns to the initial first position shown in FIG. 3, by a negative pressure generated by the contraction of the bubble and the elastic returning force of the movable member itself. When the bubble vanishes, in order to compensate the volume contraction of the bubble in the bubble generating area 11 and to compensate the volume of the discharged liquid, the liquid flows in as indicated by flows $V_{D1}$, $V_{D2}$ from the side of the common liquid chambers and a flow $V_C$ from the side of the discharge port 18.

In the foregoing there have been explained the function of the movable member 31 and the liquid discharging operation based on the bubble generation. In the following there will be explained the liquid refilling in the liquid discharge head of the present invention.

There will be given a detailed explanation on the liquid filling mechanism in the present invention, with reference to FIGS. 3 to 6.

When the bubble 40 enters a vanishing stage from the state of maximum volume, after the state shown in FIG. 5, the liquid of a volume corresponding to the vanishing bubble flows into the bubble generation area 11, from the side of the discharge port 18 in the first liquid path 14 and from the side of the common liquid chamber of the second liquid path 16.

In the conventional liquid path configuration without the movable member 31, the amount of the liquid flowing into the position of the vanishing bubble from the side of the discharge port 18 and that from the common liquid chamber are determined by the resistance of the portion closer to the discharge port and to the common liquid chamber than the bubble generating area (namely based on the resistance in the liquid paths and the inertia of the liquid). Therefore, if the flow resistance is smaller in the side closer to the discharge port 18, a larger amount of liquid flows into the bubble vanishing position from the side of the discharge port 18, thereby increasing the amount of retraction of the meniscus. Therefore, if a smaller flow resistance is selected in the side closer to the discharge port 18 in order to improve the discharge efficiency, there results a larger amount of retraction of the meniscus M at the bubble vanishing, thus prolonging the refilling time and hindering the high-speed printing.

On the other hand, in the present embodiment involving the movable member 31, the retraction of the meniscus M stops when the movable member 31 reaches the original position in the course of bubble vanishing, and, if the bubble volume W is divided, by the first position of the movable member 31, into a volume W1 at the upper side and W2 at the side of the bubble generation area 11, the volume W2 remaining thereafter is principally replenished by the liquid flow $V_{D2}$ of the second liquid path 16. Consequently, the amount of retraction of the meniscus M, which has been about a half of the bubble volume W in the conventional configuration, can be reduced to about a half of the smaller volume W1.

Also the liquid replenishment of the volume W2 can be achieved, by the pressure at the bubble vanishing, in forced manner principally from the upstream side ($V_{D2}$) of the second liquid path 16, along a face of the movable member 31 at the side of the heat generating member 2, whereby faster refilling can be achieved.

The refilling operation in the conventional head utilizing the pressure at the bubble vanishing causes a significant vibration of the meniscus, leading to the deterioration of the image quality. In contrast, the high-speed refilling in the present embodiment can minimize the meniscus vibration at the discharge port 18 as the movable member suppresses the liquid movement between the first liquid path 14 at the side of the discharge port 18 and the bubble generating area 11.

As explained in the foregoing, the present invention achieves forced refilling to the bubble generating area 11 through the liquid supply path 12 of the second liquid path 16 and the high-speed refilling by the above-explained suppression of the meniscus retraction and the meniscus vibration, thereby realizing stable discharge, high-speed repeated discharges, and improvement in the image quality and in the printing speed.

The above-explained configuration also has the following effective function, which is the suppression of propagation of the bubble-generated pressure to the upstream side (backward wave). Within the pressure resulting from the bubble generated on the heat generating member 2, a major portion based on the bubble at the side of the common liquid chamber (upstream side) forms a force (backward wave) which pushes back the liquid toward the upstream side. Such backward wave creates a pressure in the upstream side B, a resulting liquid movement and an inertial force associated with the liquid movement, which retard the liquid refilling into the liquid path and hinder the high-speed drive. On the other hand, in the present invention, the movable member 31 suppresses these actions toward the upstream side, thereby further improving the refilling ability.

Furthermore, in the present embodiment, the second liquid path 16 is provided with a liquid supply path 12 with an internal wall which is connected with the upstream side of the heat generating member 2 in substantially flat manner (without a significant recess in the portion of the heat generating member 2). In such configuration, the liquid is supplied to the bubble generating area 11 and the surface of the heat generating member 2 by a flow $V_{D2}$, along a face of the movable member 31 closer to the bubble generating area 11. Such mode of liquid supply suppresses stagnation of the liquid on the surface of the heat generating member 2, thereby preventing separation of the gas dissolved in the liquid, also facilitating the elimination of so-called remaining bubble that could not vanish totally, and also avoiding excessive heat accumulation in the liquid. Consequently the bubble generation can be repeated at a high speed, in more stable manner. The present embodiment discloses a configuration having the liquid supply path 12 with a substantially flat internal wall, but there may be employed any liquid supply path that has a smooth internal wall connected smoothly with the surface of the heat generating member 2 so as not to cause liquid stagnation thereon or significant turbulence in the liquid supply.

The movable member 31 is so constructed, as shown in FIG. 1, that the free end 32 is positioned at the downstream side, with respect to the fulcrum 33. Such configuration allows to realize, at the bubble generation, the aforementioned functions and effects such as aligning of the pressure propagating direction of the bubble and the growing direction thereof toward the discharge port 18. Also such positional relationship attains, in addition to the functions and effects relating to the liquid discharge, a lower flow resistance for the liquid flowing in the liquid path at the liquid supply, thereby enabling high-speed refilling. This is because the free end 32 and the fulcrum 33 are so positioned, as shown in FIG. 6, that the movable member 31 is not against the flows in the liquid paths (including the first liquid path 14 and the second liquid path 16) at the returning of the meniscus M to the discharge port 18 by the capillary force or at the liquid replenishment for the vanished bubble.

Also the head of the present embodiment, adopting the two liquid path configuration, can employ different liquids for the discharge liquid and the bubble generating liquid, and can discharge the discharge liquid by the pressure induced by the bubble generation in the bubble generating liquid. For this reason, even a highly viscous liquid such as polyethylene glycol, which can only show an insufficient discharge force because of insufficient bubble generation under heat application, can be discharged satisfactory by supplying such liquid in the first liquid path and by supplying the second liquid path with a liquid capable of satisfactory bubble generation (for example an ethanol-water mixture with a mixing ratio of 4:6 with a viscosity of 1–2 cP) or a low-boiling liquid.

It is also possible to stabilize the bubble generation thereby achieving satisfactory liquid discharge, by selecting a liquid which does not generate deposit on the surface of the heat generating member under heat application as the bubble generating liquid.

Also even liquid susceptible to heat can be discharged without thermal damage and with a high discharge efficiency and a high discharge force, by supplying the first liquid path with such liquid as the discharge liquid and supplying the second liquid path with liquid which is thermally stable and is capable of satisfactory bubble generation.

The present embodiment is further provided with an important function for improving the effects obtained by the movable member. This important function has been attained through the finding of a novel preferred condition for temperature adjustment in order to maintain the liquids in appropriate viscosity ranges in the liquid paths separated by the movable member. This function is to further ensure the behavior of the movable member, by realizing satisfactory viscosity condition in the liquids surrounding the movable member. Such function will be explained in the following, with reference principally to FIG. 3.

This important function is featured by the temperature adjustments of the liquids in the first and second liquid paths 14, 16, in simultaneous or independent manner.

In the heat of the configuration shown in FIG. 3, in which the first liquid path 14 and the second liquid path 16 are separated by the movable member, the temperature adjustment of the discharge liquid in the first liquid path 14 has conventionally been achieved from the substrate, by the heat generating member for substrate heating or by the bubble-generating heat generating member. In such method, however, the temperature of the liquid in the liquid path distant from the substrate cannot be adjusted sufficiently with insufficient response in time and cannot be stable. As a result, the liquid discharge becomes unstable and the fluctuation in the discharge amount cannot be avoided.

For this reason, the present invention of the two liquid path configuration, represented by the present embodiment, adopts a concept of simultaneous or independent heating of the liquid in the liquid paths 14, 16 thereby controlling the temperatures of the liquids in the liquid paths 14, 16 and realizing simultaneous or independent temperature control of the liquid paths 14, 16 in uniform manner. This concept will be explained in more details in the following embodiments 2–7.

[Embodiment 2]

At first there will be explained the head configuration which is common in the present embodiment 2 and in the ensuing embodiments 3–7.

Figure 9:
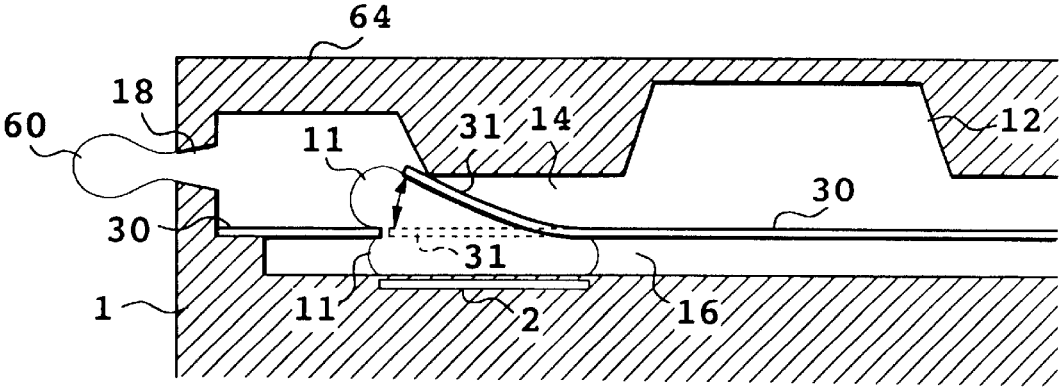
FIG. 9 is a cross-sectional view, along the liquid path, of a liquid discharging head of two-path configuration for liquid discharge by bubble generation.
Figure 10:
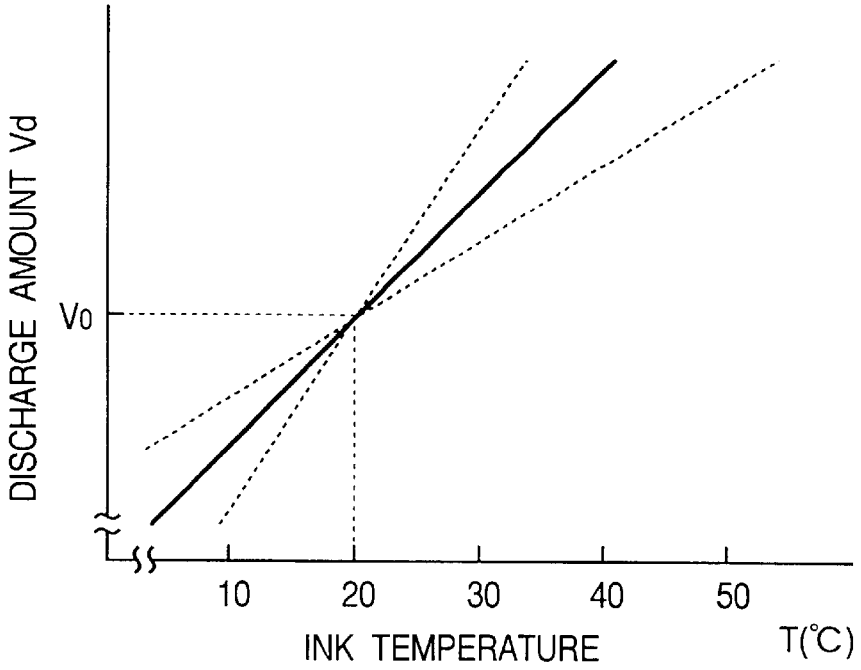
FIG. 10 is a chart showing the relationship between the discharge liquid temperature and the discharge amount.
Figure 11:
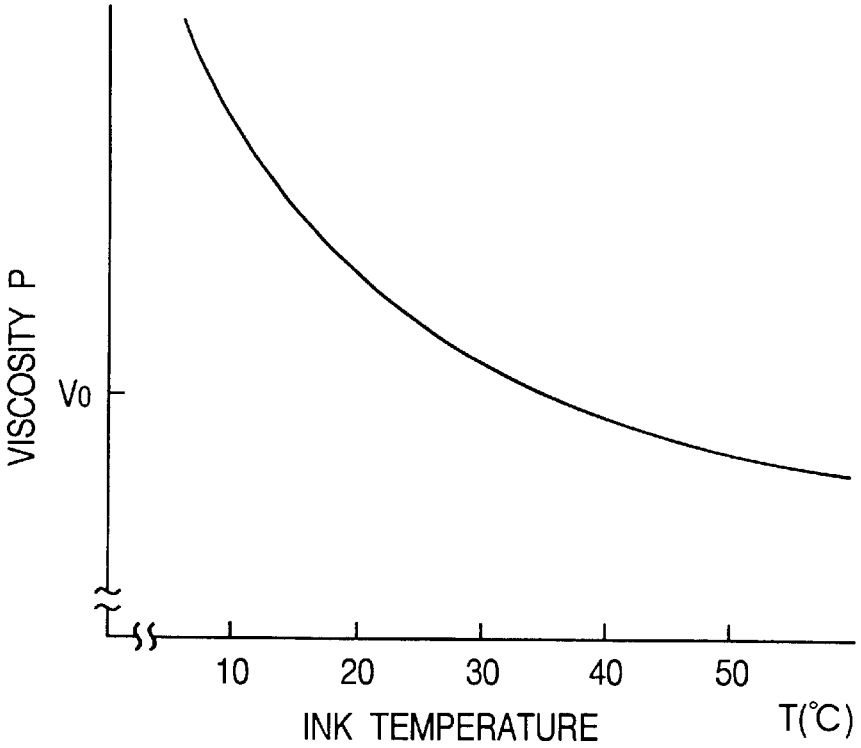
FIG. 11 is a chart showing the relationship between the discharge liquid temperature and the viscosity of the discharge liquid.

As shown in FIG. 9, the liquid discharge head is provided, on a substrate 1 bearing a heat generating member 2 for supplying the liquid with thermal energy for bubble generation, with a second liquid path 16 for the bubble generating liquid, and thereon with a first liquid path 14 for the discharge liquid communicating directly with a discharge port 18, and is further provided with heating or cooling means for temperature adjustment of the discharge liquid simultaneously with or independently from the bubble generating liquid. The temperature adjustment of the bubble generating liquid can be achieved by the bubble-generating heat generating member 2 or the substrate-heating heat generating member which are already known. Between the first and second liquid paths 14, 16 there are provided a partition wall 30 and a movable member 31 composed of an elastic material such as metal, for separating the discharge liquid in the first liquid path 14 from the bubble generating liquid in the second liquid path 16. The movable member 31, constituting a part of the partition wall 30, is in a broken-lined position in the absence of the pressure resulting from the bubble generation. Under the application of a voltage pulse exceeding a certain threshold value to the bubble-generating heat generating member 2, a bubble 11 is generated by film boiling in the bubble generating liquid in the second liquid path 16, and the movable member 31 is pushed up and opens toward the discharge port 18 by the pressure of the bubble 11. Thus the discharge liquid in the first liquid path 14 is pushed out from the discharge port 18 by the pressure of the further expanding bubble 11 while the reverse flow of the discharge liquid toward the liquid chamber 12, thereby discharging a liquid droplet 60. Upon contraction of the bubble by cooling, the liquid droplet 60 is constricted and cut off in the vicinity of the discharge port 18 and flies to the left in the drawing. The movable member 31 returns to the broken-lined position by the elastic force thereof, and the discharge liquid of the consumed amount is replenished from the right, thus filling the first liquid path 14. Upon contraction and vanishing of the bubble by further cooling, the bubble generating liquid of the consumed amount is also replenished from the right to fill the second liquid path 16. The simultaneous or independent temperature adjustment of the liquid paths 14, 16 is effective in regulating the physical properties such as viscosity of the liquids in all the liquid discharging printing apparatus of the two liquid path configuration, regardless whether the liquid discharge relies on the pressure generated by the bubble. The discharge amount of the liquid decreases with an increase in the viscosity. FIGS. 10 and 11 show the relationships between the temperature and the viscosity or the discharge amount, under a constant pulse application to the bubble-generating heat generating member 2. The temperature dependence of the discharge amount is determined by the nozzle configuration of the liquid discharging head and the physical properties of the ink. With an increase in the temperature, the liquid becomes less viscous, thus becoming more easily dischargeable so that the discharge amount increases.

[Embodiment 3]

Figure 12A:
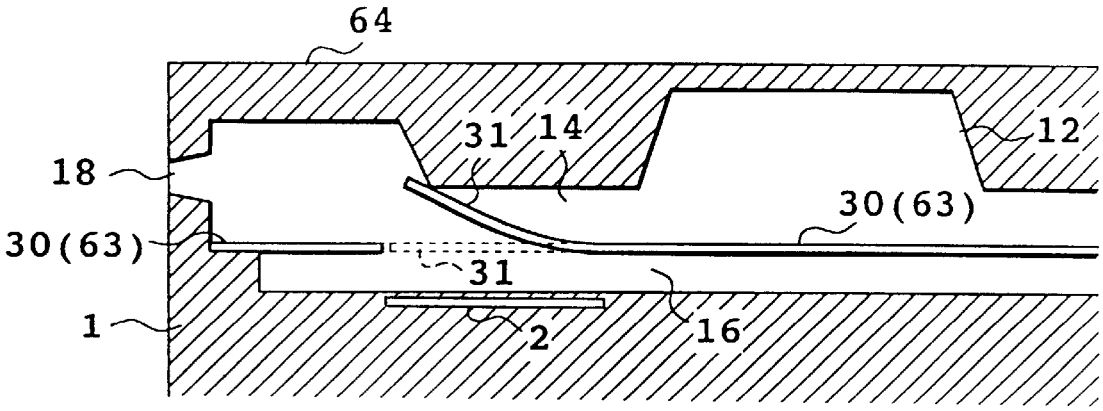
Figure 13:
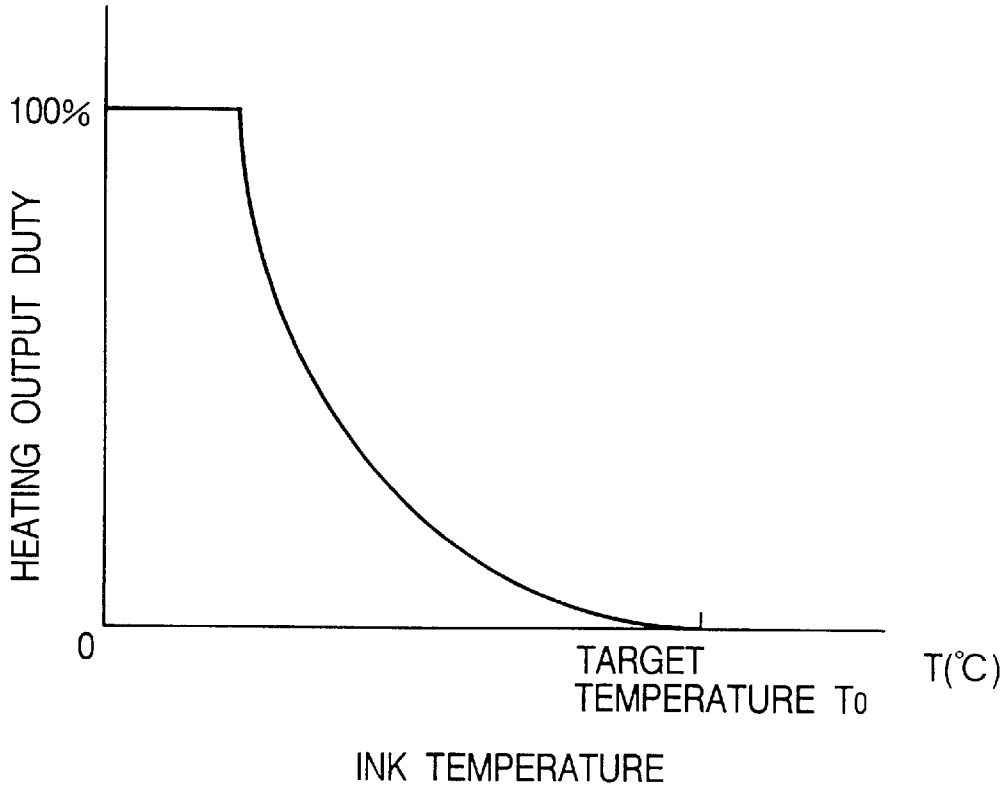
FIG. 13 is a chart showing the relationship between the discharge liquid temperature and the heating output of the heat generating member for temperature adjustment.

A configuration shown in FIG. 12A, in which the function of a temperature-adjusting heat generating member 63 is incorporated in the partition wall 30 and the movable member 31 for separating the discharge liquid in the first liquid path 14 and the bubble generating liquid in the second liquid path 16, allows to directly and simultaneously heat the liquids of the liquid paths in contact with such heat generating member 63, and the temperature adjustment can be achieved by selecting an output duty as shown in FIG. 13, more specifically varying the time-averaged output by the adjustment of the on-off ratio according to the desired temperature.

Figure 12B:
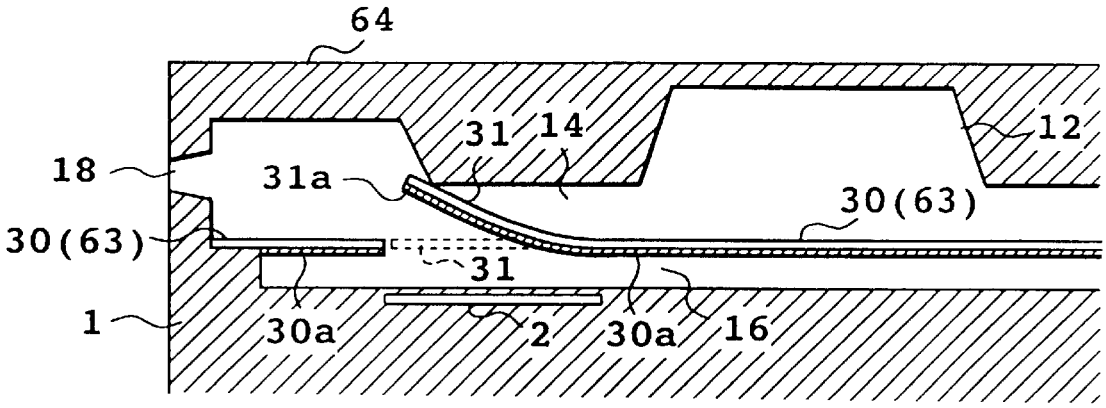

It is also possible to adjust the heating ratio for the first and second liquid paths 14, 16 by providing, as shown in FIG. 12B, a face of at least either of the partition wall 30 and the movable member 31 at the side of the second liquid path with a heat insulation layer 30*a* and/or 31*a* and suitably selecting the thickness and/or the material of such heat insulation layer 30*a*/31*a*. Such adjustment may be made according to the liquids to be used. It is preferable to provide both the partition wall 30 and the movable member 31 with the heat insulation layers 30*a* and 31*a*, but such configuration is not essential.

The common liquid chamber 12 shown in these drawings may be same as the aforementioned first common liquid chamber, or may be formed separately. It is however preferably same because the liquid path can be made shorter.

Figure 14:
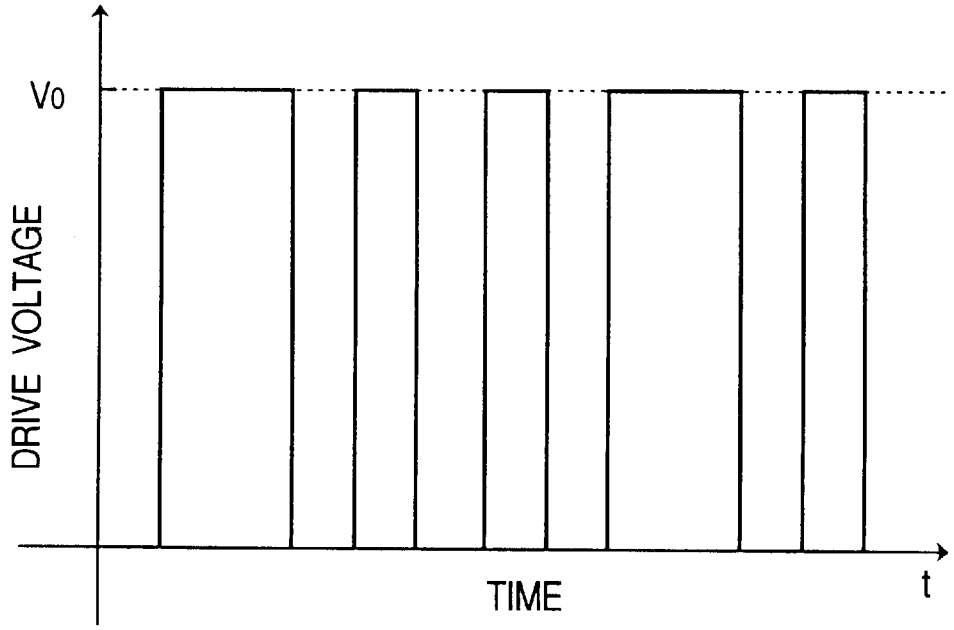
FIG. 14 is a view showing the duty of time-divided heating output.

FIG. 14 shows the driving voltage, wherein the duty ratio means the proportion of time during which the driving voltage $V_0$ is applied. It is also possible to control the duty ratio of driving current $I_o$ instead of the driving voltage.

Figures 15, 16:
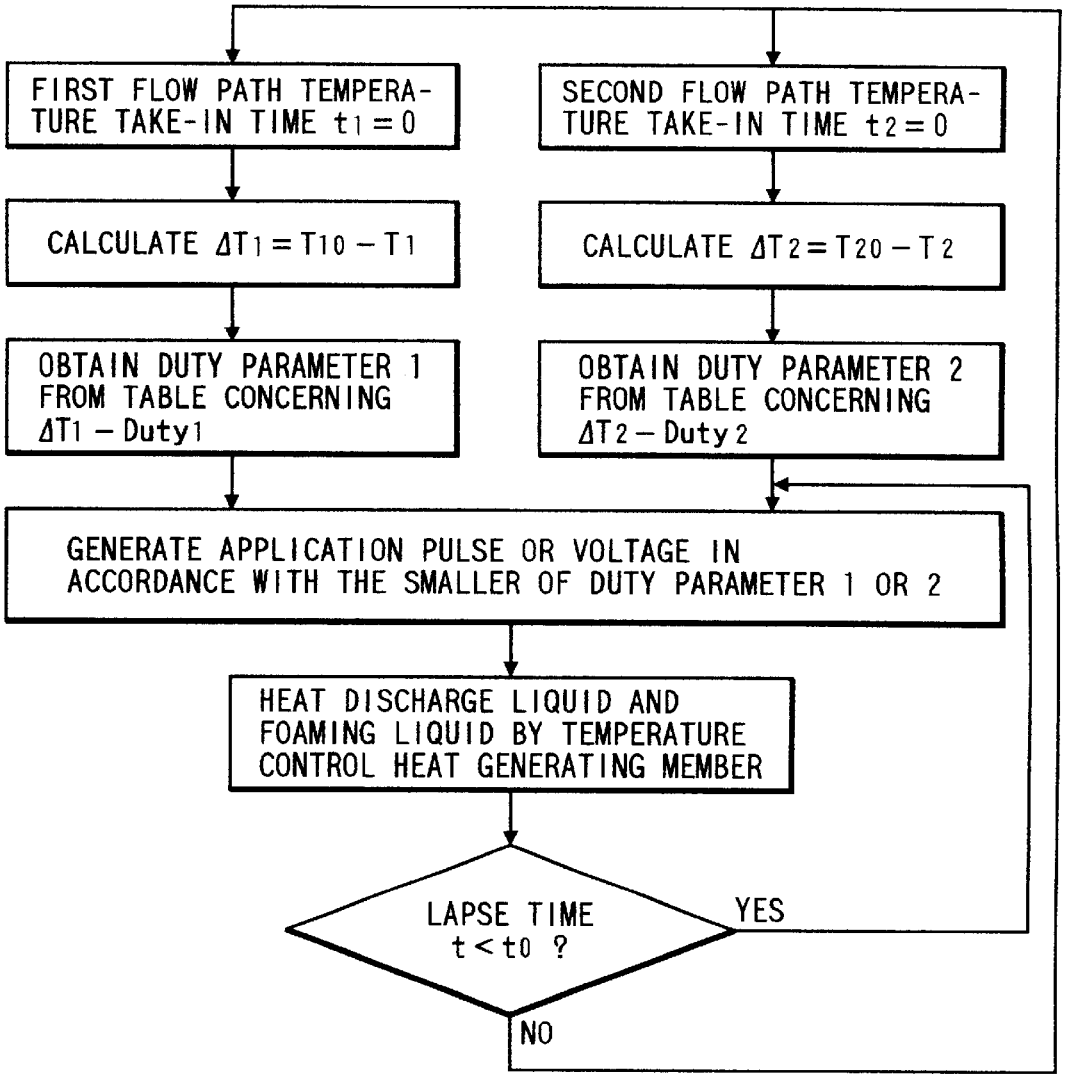
FIG. 15 is a flow chart showing a temperature adjusting process in case of adjusting the temperature of the liquid in the first liquid path and that in the second liquid path.
FIG. 16 is a view showing a table defining the relationship between the temperature difference and the heating output duty.

FIG. 15 shows the flow of temperature adjustment. Unrepresented temperature detectors detect the temperature $T_1$ of the first liquid path 14 and that $T_2$ of the second liquid path 16. The temperature detector for measuring the temperature $T_1$ of the first liquid path 14 may be provided on the partition wall, the movable member, the partition of the nozzles or the cover plate. Also the temperature detector for measuring the temperature $T_2$ of the second liquid path 16 can be a conventional one such as a temperature sensor provided on the substrate.

Then the detected temperatures of the liquid paths are fetched with A/D conversion, and there are calculated temperature differences $\Delta T_1$ and $\Delta T_2$ to target temperatures $T_{10}$ and $T_{20}$. The target temperature $T_{10}$ is determined according to the physical properties of the discharge liquid, and the target temperature $T_{20}$ is determined according to the physical properties of the bubble generating liquid. Based on thus obtained temperature differences $\Delta T_1$ and $\Delta T_2$, duty parameters 1, 2 are obtained from respective tables, which are prepared in advance and store appropriate duty values as a function of temperature difference $\Delta T$ as shown in FIG. 16. The tables are prepared according to the physical properties of the liquids.

Then a pulse or a voltage, corresponding to the smaller one of the above-mentioned duty parameters 1 and 2, is generated and applied to the electrothermal converting member to heat the discharge liquid and the bubble generating liquid. This process is repeated by detecting the temperatures $T_1$, $T_2$ again after the lapse of a predetermined time $t_0$ from the preceding detection.

The appropriate duty value may be different according to whether the drive is conducted with the voltage $V_0$ or with the current $I_0$. The temperature adjustment is not limited to such method but may also be achieved by other methods, such as varying the magnitude of the heating output.

In case of varying the heating ratio for the discharge liquid and the bubble generating liquid, in the above-explained configuration, by providing the partition wall or the movable member with a heat insulation layer or the partition wall itself with heat insulating property and also providing a temperature-adjusting heat generating member at the side of the first liquid path, the heat insulation layer or the heat insulating property is so selected as to obtain a heat insulation that will provide mutually close duty parameters 1, 2. In such case, the duty parameters 1, 2 are determined according to the physical properties or the kinds of the discharge liquid and the bubble generating liquid, and the temperature of emphasis is determined according to the designing of performance.

The temperature adjustment of the discharge liquid and the bubble generating liquid may be conducted solely with the temperature-adjusting heat generating member, or, if the temperature of the bubble generating liquid only is lower than the target temperature $T_{20}$, the bubble generating liquid may be heated by supplying the bubble-generating heat generating member with a pulse that will not cause bubble generation or by heating with the substrate heater.

Figure 17:
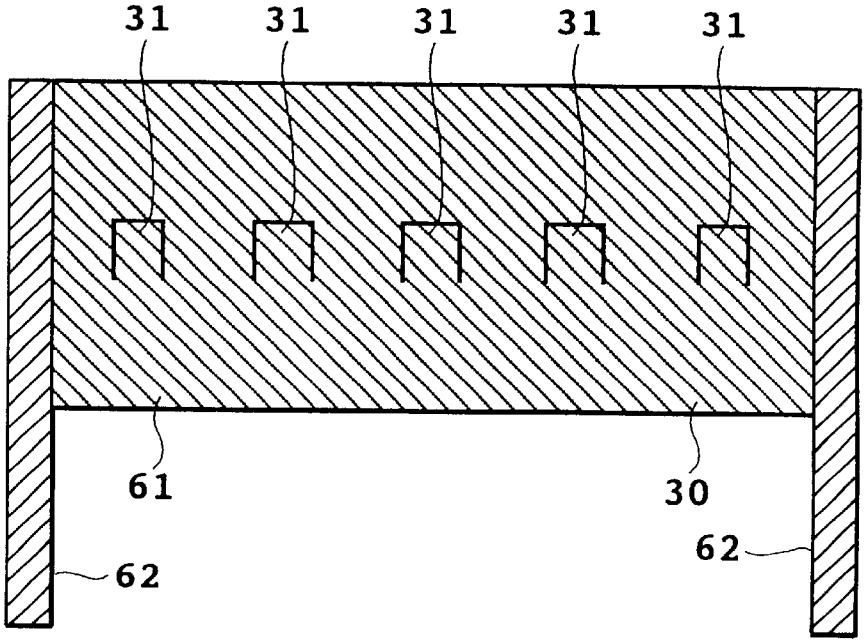
FIG. 17 is a schematic view, seen from the side of the cover plate, of a partition wall of which entire area constitutes the electrothermal converting member.
Figure 18:
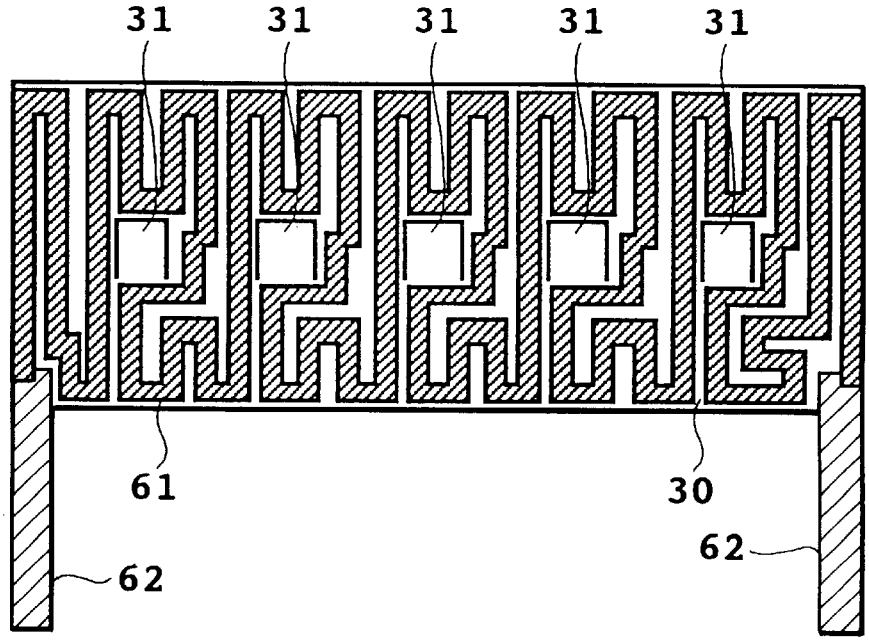
FIG. 18 is a schematic view, seen from the side of the cover plate, of a partition wall on which resistance wires are adhered as the electrothermal converting member.
Figure 19:
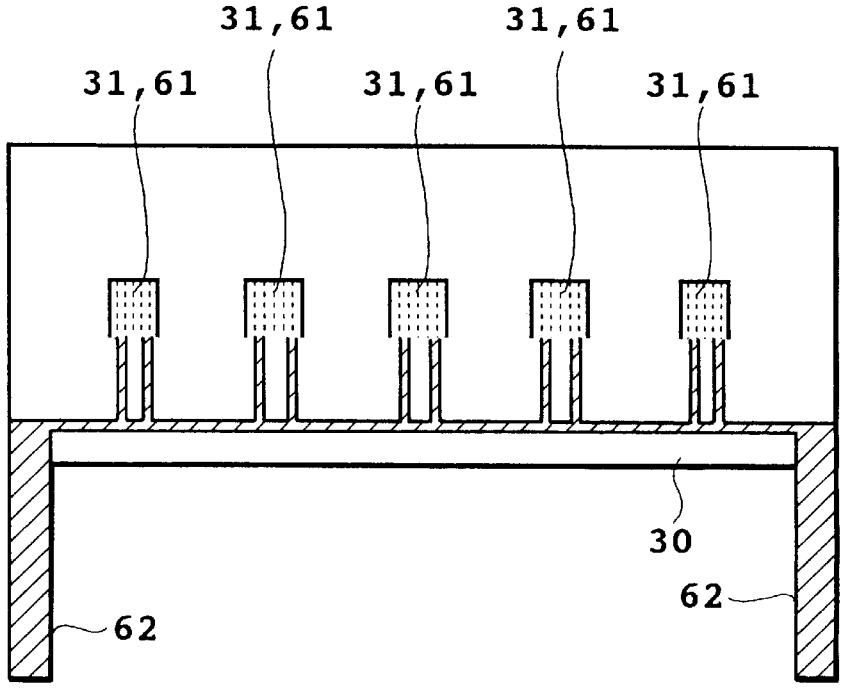
FIG. 19 is a schematic view, seen from the side of the cover plate, of a partition wall portion in which electrothermal converting member are provided on the movable members.
Figure 20:
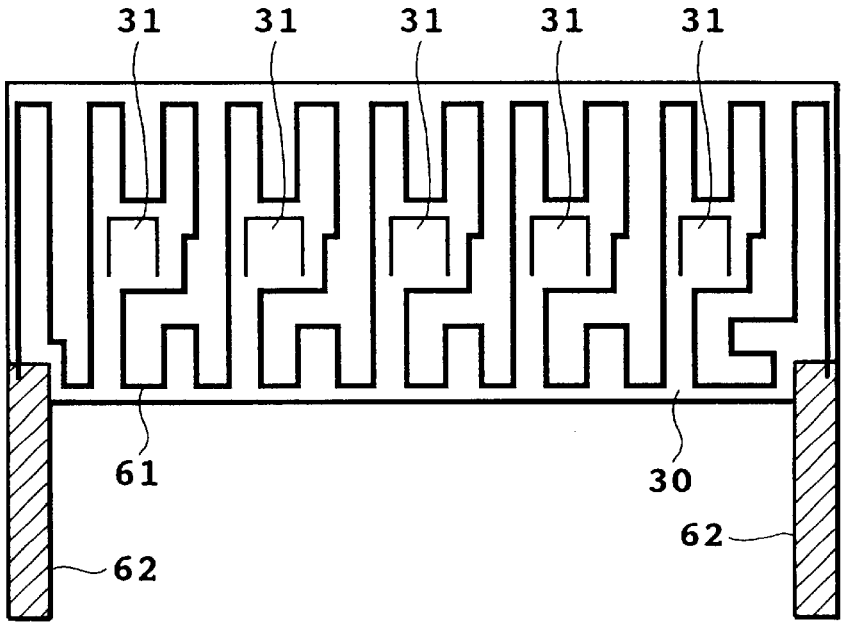
FIG. 20 is a schematic view, seen from the side of the cover plate, of a partition wall on which resistance wires are adhered on the partion wall and the movable members as the electrothermal converting member.

The function of the temperature-adjusting heat generating member 63 may be incorporated in the partition wall 30 and the movable member 31 by adhering a resistance member, similar to the bubble-generating heat generating member 2, to the partition wall 30 and the movable member 31, or constructing the entire partition wall 30 as the electrothermal converting member 63 as shown in FIG. 17, or adhering a resistance wire 61 as an electrothermal converting member to the partition wall 30 as shown in FIG. 18, but such methods are not limitative. In the configuration shown in FIG. 17, the entire area of the partition wall 30 between electric wirings 62 on both lateral ends is formed with an elastic resistance member and heat is generated by current supply to the entire area. Current supply to the completely entire surface is not essential, as long as the entire area of the partition wall 30 or a part thereof can be uniformly heated in the space between the nozzles. In the configuration shown in FIG. 18, a resistance member is formed between electric wirings 62 at lower lateral ends, and heat is generated by current supply to the resistance line. In order to avoid shortcircuiting, the partition wall 30 is insulated from the resistance line 62 or is made of an insulating material. The illustrated wiring pattern is not essential, as long as the entire area of the partition wall 30 or a part thereof can be uniformly heated in the space between the nozzles. For example, it is also possible, as shown in FIGS. 19 and 20, to provide the movable member 31 with a resistance line (electrothermal converting member) 61. FIGS. 17 and 18 show five movable members 31, but in fact they are provided in a number of the nozzles. In case of temperature adjustment in the conventional configuration with the bubble-generating heat generating member 2 or the substrate-heating heat generating member, the response time and the precision of the temperature control have been deficient for the discharge liquid which can only be heated by thermal conduction through the bubble generating liquid and the partition wall 30, but such drawbacks can be resolved in the present embodiment by direct heat adjustment of the discharge liquid by the heat generating member 63 in contract therewith, whereby the viscosity of the discharge liquid can be controlled with satisfactory response.

Also the partition wall 30 and the movable member 31 incorporating the function of the temperature-adjusting heat generating member 63 are in contact with both of the discharge liquid in the first liquid path 14 and the bubble generating liquid in the second liquid path 16, so that such heat generating member 63 provided for temperature adjustment of the discharge liquid can also be used for controlling the temperature of the bubble generating liquid. Consequently the bubble-generating heat generating member 2 or the substrate-heating heat generating member need not be given the function of temperature adjustment of the bubble generating liquid, so that the control and the structure can be simplified. The temperature-adjusting heat generating member 63 is not limited to the electrothermal converting member but can also be formed with a partition wall 30 or a movable member 31 composed of a high frequency-thermal converting member, which is irradiated with high-frequency wave from above the cover plate 64. In such case the wirings required for the electrothermal converting member can be dispensed with, so that fine mechanical working can be avoided in the vicinity of the nozzle where the structure is complex.

[Embodiment 4]

Figure 21:
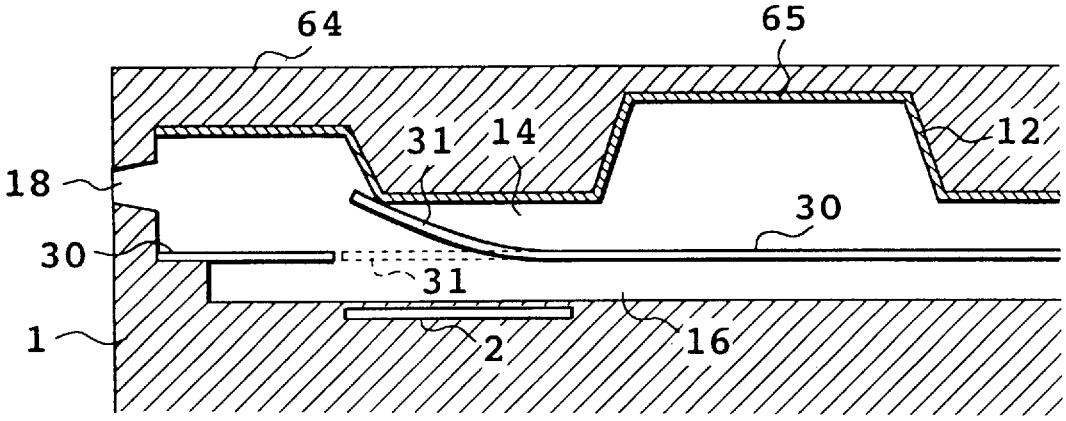
FIG. 21 is a cross-sectional view, along the liquid path, of a liquid discharging head of two-path configuration for liquid discharge by bubble generation, capable of temperature adjustment of the discharge liquid by the cover plate.

In this embodiment, a temperature-adjusting heat generating member 65 is formed in the cover plate 64 or on the surface thereof facing the first liquid path 14 as shown in FIG. 21 to heat the discharge liquid only, in contact with such heat generating member 65, thereby achieving temperature adjustment of the discharge liquid independent from that of the bubble generating liquid. The temperature adjustment of the discharge liquid is conducted as explained in the embodiment 3, and the temperature thereof is detected by an unrepresented temperature detector provided on the wall of the discharge liquid path. It is thus rendered possible to adjust the temperature of the discharge liquid while suppressing the heating of the bubble generating liquid, which tends to be heated by the heat of the bubble-generating heat generating member 2 and by the lower consumption. The temperature adjustment of the bubble generating liquid is achieved in conventional manner by the bubble-generating heat generating member 2 or the substrate-heating heat generating member. It is thus rendered possible to optimize the temperature of the discharge liquid for obtaining a constant discharge amount, also in consideration of the fluctuation in the discharge amount resulting from the variation in viscosity dependent on the bubble generating frequency, while also optimizing the temperature of the bubble generating liquid for bubble generation.

It is also possible to select the temperature of the discharge liquid higher than that of the bubble generating liquid by selecting a material of low thermal conductivity for the partition wall 30 and the movable member 31, so that discharge liquid of high viscosity can be optimized for discharge by viscosity reduction at a higher temperature. It is furthermore possible to actively vary the discharge amount by varying the temperature, and plural discharge amounts can be realized within a same head. The heat generating member 64 for temperature adjustment of the discharge liquid, provided in the cover plate 64 or on the surface thereof facing the first liquid path 14, may be composed of an electrothermal converting member. Also such electrothermal converting member may be replaced with high frequency wave irradiation on a high frequency-thermal converting member. In such case the wirings required for the electrothermal converting member can be dispensed with, so that fine mechanical working can be avoided in the vicinity of the nozzle where the structure is complex. Also such electrothermal converting member may be replaced with infrared light irradiation on an infrared-thermal converting member. Also in such case the wirings required for the electrothermal converting member can be dispensed with, so that fine mechanical working can be avoided in the vicinity of the nozzle where the structure is complex.

[Embodiment 5]

Figure 22:
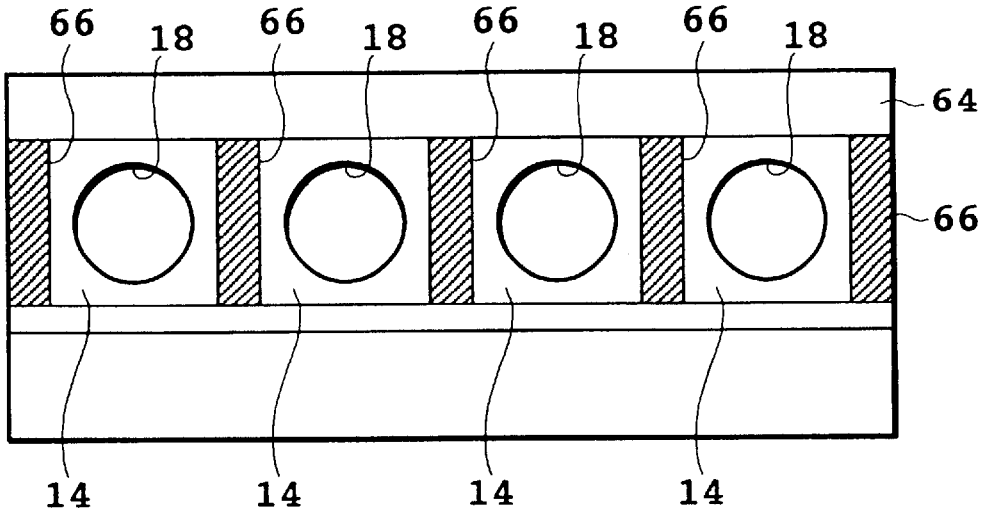
FIG. 22 is a cross-sectional view, seen from the direction of discharge, of a liquid discharging head of two-path configuration for liquid discharge by bubble generation, capable of temperature adjustment of the discharge liquid by the partition between the discharge ports.

In this embodiment, the partition between the nozzles of the first liquid paths 14 is formed with an electothermal converting member 66 as shown in FIG. 22 to heat the discharge liquid in contact therewith, thereby achieving the temperature adjustment of the discharge liquid. The temperature can be set for each nozzle or for each color, with suitable wirings and control for the electrothermal converting member 66, whereby the fluctuation or balance in the discharge amount can be appropriately adjusted. The electrothermal converting member 66 cannot be replaced by a high frequency-thermal converting member or an infrared-thermal converting member because the cover plate 64 has a vertical upper face, but the present embodiment is similar to the embodiment 3 in the case of use and in the effects, with respect to the possibility of independent temperature adjustment of the discharge liquid.

Figure 23:
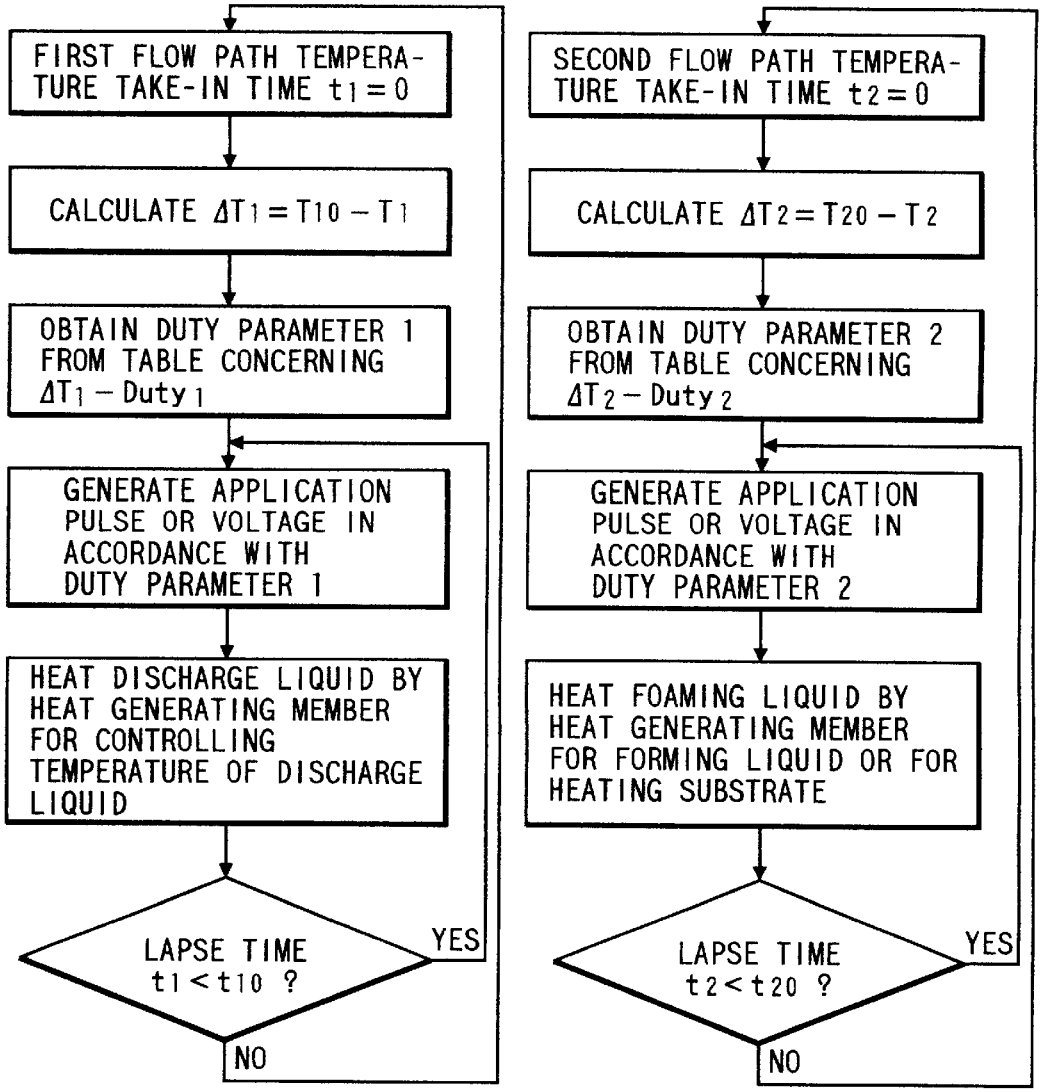
FIG. 23 is a flow chart showing a temperature adjusting process in case of separately adjusting the temperature of the liquid in the first liquid path and that in the second liquid path.

FIG. 23 shows the flow of independent temperature control for the discharge liquid and the bubble generating liquid, with a head of the configuration shown in the foregoing embodiment 4 or in the present embodiment 5. This flow will not be explained further as it is similar to that shown in FIG. 15, except that the liquid temperature of the first liquid path 14 and that of the second liquid path 16 are separately measured and separately controlled.

[Embodiment 6]

Figure 24:
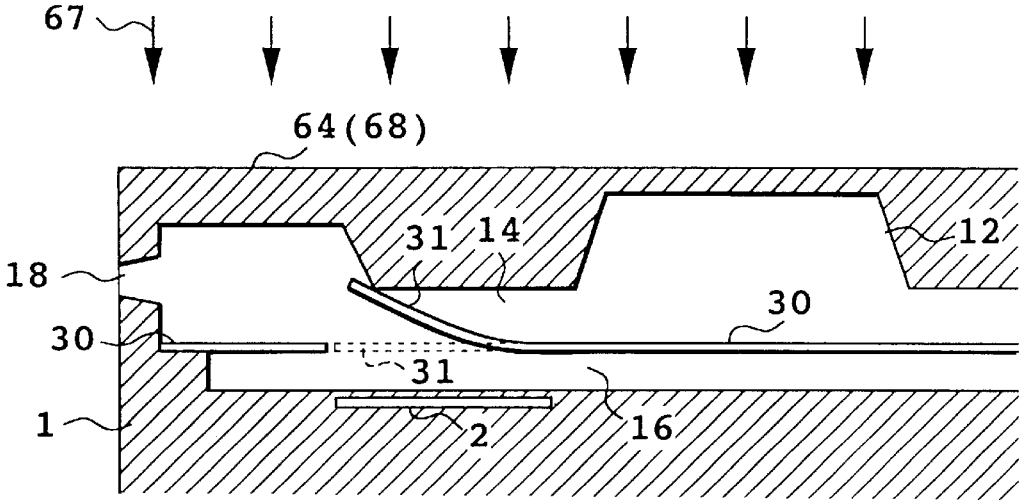
FIG. 24 is a across-sectional view, along the liquid path of, liquid discharging head of two-path configuration for liquid discharge by bubble generation, capable of temperature adjustment of the liquids in the liquid paths by direct absorption of irradiation energy the liquids in the liquid paths.

As shown in FIG. 24, the cover plate 64 facing the first liquid path 14 is formed with an infrared transmitting member 68 and the temperature adjustment of the discharge liquid is achieved by causing the discharge liquid itself with energy of infrared light 67 thereby heating the discharge liquid itself. In this case, sufficient heating cannot be obtained unless the discharge liquid has a high absorbance for the infrared light and low reflectance and transmittance. If these conditions cannot be met, the heating may be supplemented by heat generation on a wall receiving the infrared light 67. The liquids can be temperature controlled simultaneously or independently, as the ratio of heating of the liquid paths can be determined by the infrared transmittance or reflectance of the partition wall 30 and the movable member 31 which separate the discharge liquid in the first liquid path 14 and the bubble generating liquid in the second liquid path 16. It is also possible to control the temperatures of the liquids in the liquid paths 14, 16 by direct heating, by replacing the infrared transmitting member 68 and the infrared light 67 respectively with a high frequency wave transmitting member and a high frequency wave, just like heating water in a microwave oven. Any portion that should not be heated can be sealed against the high frequency wave with a metal.

[Embodiment 7]

Figure 25:
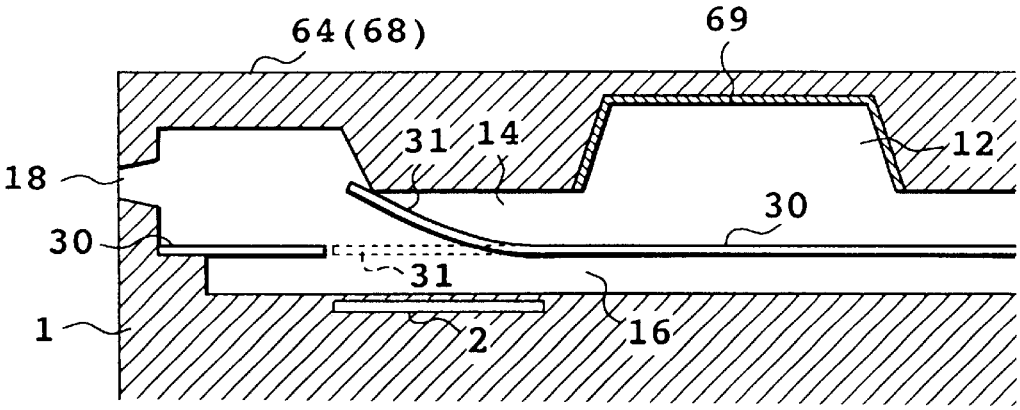
FIG. 25 is cross-sectional view, along the liquid path, of a liquid discharging head of two-path configuration for liquid discharge by bubble generation, capable of adjusting the temperature of the discharge liquid of a higher flow amount in the liquid chamber.

In this embodiment, as shown in FIG. 25, the discharge liquid is heated with an electrothermal converting member 69 provided on the cover plate 64 in the vicinity of the liquid chamber 12. This configuration avoids concentration of component parts in the vicinity of the nozzle end. The discharge liquid, larger in the flow amount and not in contact with the bubble-generating electrothermal converting member 2, shows only little temperature change in the vicinity of the nozzle end once it is subjected to temperature adjustment in the liquid chamber 12. The bubble generating liquid, being less in the flow amount as in other embodiments, cannot be sufficiently temperature adjusted in the liquid chamber and is preferably subjected to the temperature adjustment by the bubble-generating heat generating member 2 or by the substrate in the vicinity thereof. The discharge liquid, being in contact only with the heat generating member 69 for the discharge liquid, can be temperature controlled independently from the bubble generating liquid. It is thus rendered possible to adjust the temperature of the discharge liquid while suppressing the heating of the bubble generating liquid, which is not in contact with the heat generating member 69, in spite of a fact that the bubble generating liquid tends to be heated by the bubble-generating heat generating member 2 because of its lower consumption rate.

In the foregoing embodiments, no specific temperatures have been given in relation to the temperature adjustment of the liquids in the first and second liquid paths 14, 16, since such temperatures vary according to the properties such as compositions of the liquids and cannot be uniquely determined but have to be regulated in the designing stage. As an example, a preferred temperature for the first liquid is 45° or 50° C. for liquid of a high viscosity. However it may be selected at the room temperature (about 25° C.) according to the properties of such first liquid. On the other hand, a preferred temperature for the second liquid is about 40° C. in case pulse width modulation control is employed for stabilizing the bubble generation. Even when the first liquid is same as the second liquid, there may be employed different temperatures in the first and second liquid paths.

[Embodiment 8]

This embodiment explains a configuration for improving the discharge force and the discharge efficiency by controlling the propagating direction of the bubble-generated pressure and the growth of the bubble, for the liquid discharge.

Figure 26A:
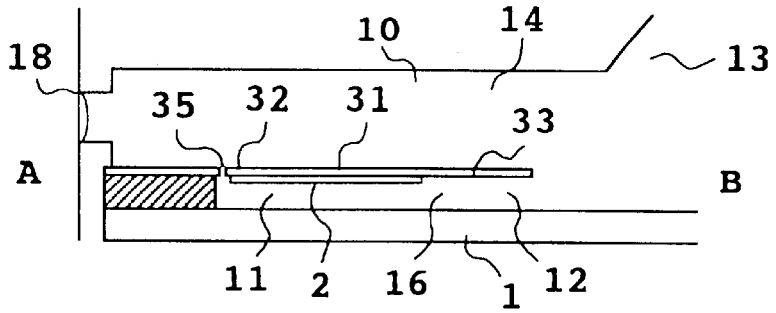
FIGS. 26A, 26B, 26C and 26D are schematic cross-sectional views, along the liquid path, of a liquid discharging head of an eighth embodiment of the present invention.
Figure 26B:
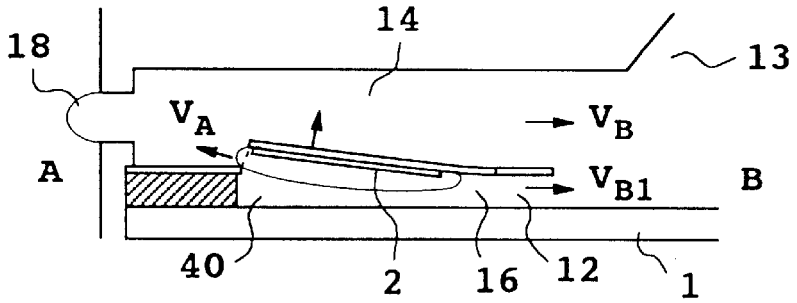
Figure 26C:
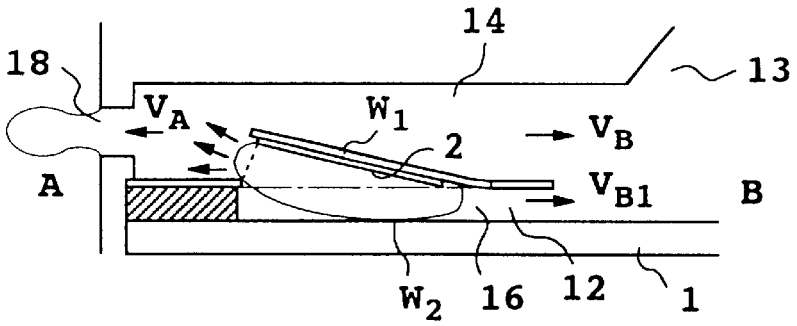
Figure 26D:
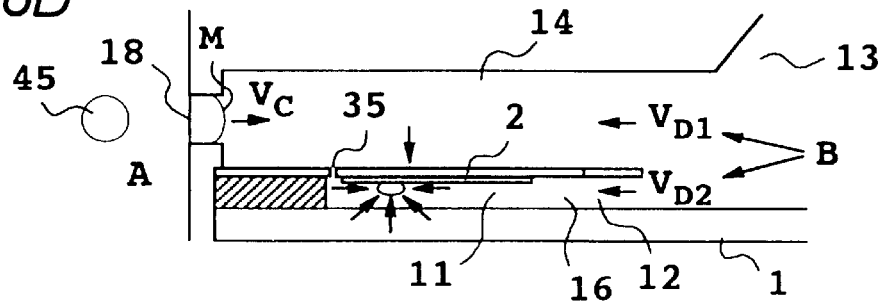
Figure 27:
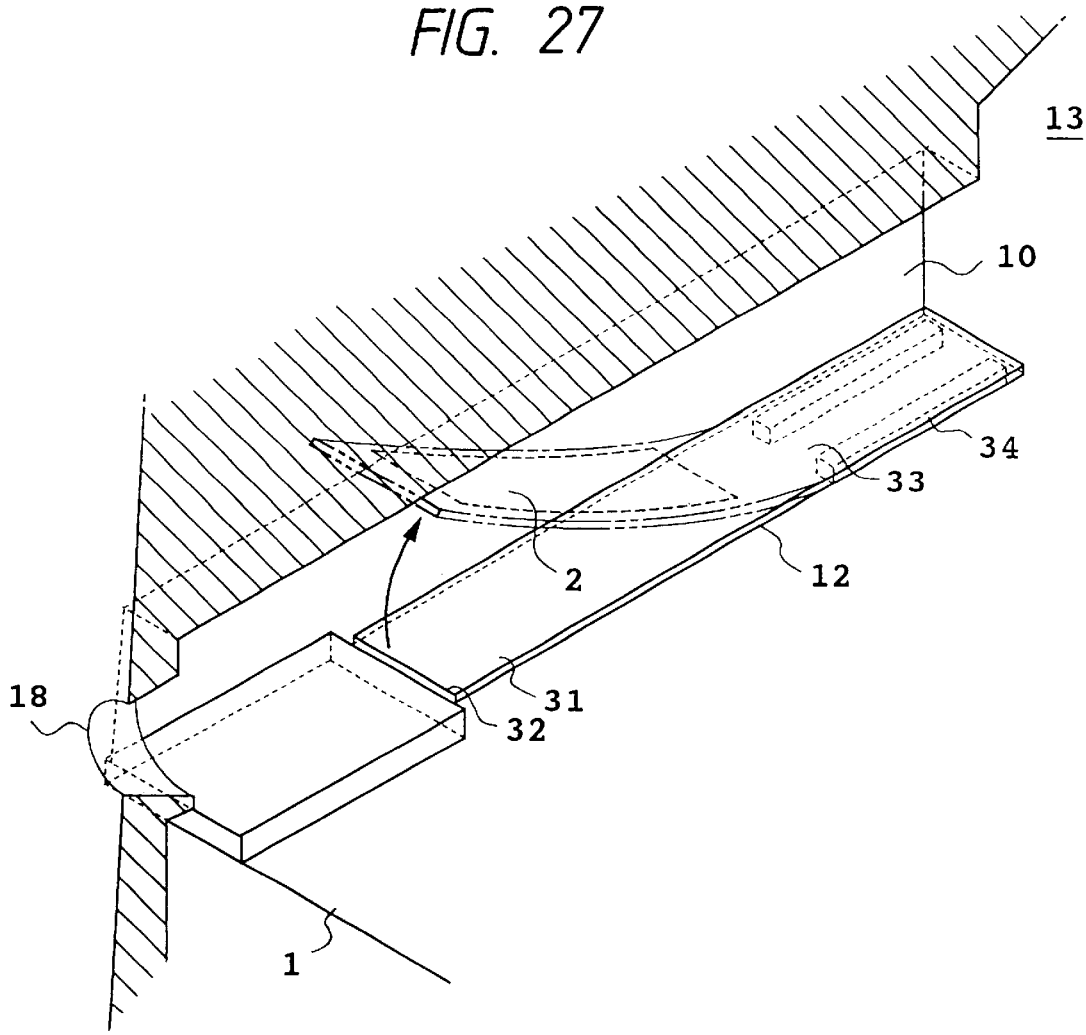
FIG. 27 is a partially cut-off perspective view of the liquid discharging head shown in FIGS. 26A, 26B, 26C and 26D.

FIGS. 26A to 26D are schematic cross-sectional views, along the liquid path, of a liquid discharging head of the present embodiment, and FIG. 27 is a partially cut-off perspective view of such liquid discharging head.

The liquid discharging head of the present embodiment is formed on an element substrate 1, on which provided is a liquid path 10, communicating with a discharge port 18 and with a common liquid chamber 13 for supplying plural liquid paths 10 with liquid and adapted to receive liquid of an amount, corresponding to the amount of the liquid discharged from the discharge port 18, from the common liquid chamber 13.

In this liquid path 10, a plate-shaped planar movable member 31, composed of an elastic material such as metal, is provided in the form of a beam supported at an end. A heat generating member 2 (a heat generating resistance member of a size of 40×105 μm in the present embodiment) for applying thermal energy to the liquid for discharge is formed on a surface of the movable member 31, opposed to the element substrate 1. An end of the movable member 31 is fixed on a support member 34, formed by patterning photosensitive resin or the like on the wall of the liquid path 10 or on the element substrate. Such support member supports the movable member 31 and constitutes a fulcrum portion 33.

The movable member 31 is provided with a distance of about 15 μm from the element substrate 1, in such a manner as to have the fulcrum (fixed end) 33 at the upstream side of the major flow from the common liquid chamber 13 to the discharge port 18 through the movable member 31 induced by the liquid discharging operation, and a free end 32 at the downstream side of the fulcrum 33. A space between the heat generating member 2 and the movable member 31 constitutes the bubble generating area. The kind, shape and arrangement of the heat generating member 2 and the movable member 31 are not limited to those explained above but may be so arbitrarily selected as to control the bubble growth and the pressure propagation as will be explained in the following. Also for facilitating the following description of the liquid flow, the liquid path 10 will be divided by the movable member 31 into a first liquid path 14 constituting a part communicating with the discharge port 18, and a second liquid path 16 including the bubble generating area 11 and the liquid supply path 12.

Heat generated by the heat generating member 2 is applied to the liquid present in the bubble generating area 11 between the movable member 31 and the heat generating member 2, thus generating a bubble in the liquid, based on a film boiling phenomenon as described in the U.S. Pat. No. 4,723,129. The bubble and the pressure resulting from the generation thereof act preferentially on the movable member 31, whereby the movable member 31 displaces to open toward the discharge opening 18 about the fulcrum 33, as shown in FIGS. 26B, 26C and 27. The displacement or the displaced state of the movable member 21 guides the propagation of the pressure resulting from the bubble generation and the growth of the bubble itself toward the discharge port.

Now there will be explained one of the basic discharging principles of the present invention. In the present invention, one of the most important principles is that the movable member 31, so positioned as to oppose to the bubble, is displaced from a first position in the stationary state to a second displaced position by the pressure of the bubble or by the bubble itself whereby the bubble pressure propagation in various directions $V_1$–$V_4$ as shown in FIG. 8 are guided toward the downstream side (toward the discharge port) and are converted into the direction $V_A$. In this manner the pressure of the bubble 40 directly and efficiently contribute to the liquid discharge. Also the growth itself of the bubble 40 is guided toward the downstream side in the same manner as the pressure propagating direction $V_1$–$V_4$ and the bubble grows larger in the downstream side than in the upstream side. There can thus be achieved fundamental improvement in the discharge efficiency, the discharge force and the discharge speed by controlling the growth itself of the bubble 50 and the pressure propagation thereof by means of the movable member 31.

Now reference is made again to FIGS. 26A to 26D, for explaining the discharging operation of the liquid discharge head of the present embodiment.

FIG. 26A shows a state prior to the application for example of electric energy to the heat generating member 2, thus prior to the heat generation thereby. It is important in this state that the movable member 31 is so positioned as to face at least a downstream. portion of the bubble 40 generated by the heat of the heat generating member 2, namely it is so positioned that the downstream portion of the bubble 40 acts on the movable member.

FIG. 26B shows a state where the heat generating member 2 generates heat by the application for example of electrical energy, and a part of the liquid in the bubble generating area 11 is heated by the generated heat to have generated a bubble 40 by film boiling.

In this state, the movable member 31 displaces from a first position to a second position, by the pressure resulting from the generation of the bubble 40, so as to guide the propagating direction of the pressure of the bubble 40 toward the discharge port. In this state, it is important, as mentioned before, that the free end 32 of the movable member 32 is provided at the downstream side (side of the discharge port) and the fulcrum 33 is provided at the upstream side (side of the common liquid chamber) whereby at least a part of the movable member 31 is opposed to the downstream portion of the bubble 40.

FIG. 26C shows a state in which the bubble grows further and the movable member 31 is displaced further by the pressure resulting from the generation of the bubble 40. The generated bubble 40 grows larger in the downstream side than in the upstream side and continues growth beyond the broken-lined first position of the movable member 31. The gradual displacement of the movable member 31 in the course of the growth of the bubble 40 is considered to align the pressure propagating direction of the bubble 40 and the direction of easy volume movement thereof, namely the growth direction of the bubble toward the free end side, uniformly toward the discharge port 18, thereby improving the discharge efficiency. The movable member 31 performs positive contribution in guiding the bubble itself and the pressure thereof toward the discharge port 18, and can efficiently control the pressure propagating direction and the bubble growing direction.

FIG. 26D shows a state in which the bubble 40 contracts and vanishes by the decrease of the pressure in the bubble, after the film boiling mentioned above.

The movable member 31, having displaced to the second position, returns to the initial first position shown in FIG. 26A, by a negative pressure generated by the contraction of the bubble and the elastic returning force of the movable member itself. When the bubble vanishes, in order to compensate the volume contraction of the bubble in the bubble generating area 11 and to compensate the volume of the discharged liquid, the liquid flows in as indicated by flows $V_{D1}$, $V_{D2}$ from the upstream side B or from the side of the common liquid chamber and a flow $V_C$ from the side of the discharge port 18.

In the foregoing there have been explained the function of the movable member and the liquid discharging operation based on the bubble generation. In the following there will be explained the liquid refilling in the liquid discharge head of the present invention.

There will be given a detailed explanation on the liquid filling mechanism in the present invention, with reference to FIGS. 26A to 26D.

When the bubble 40 enters a vanishing stage from the state of maximum volume, after the state shown in FIG. 26C, the liquid of a volume corresponding to the vanishing bubble flows into the bubble generating area 11, from the side of the discharge port 18 in the first liquid path 14 and from the side of the common liquid chamber 13 of the second liquid path 16. In the conventional liquid path configuration without the movable member 31, the amount of the liquid flowing into the position of the vanishing bubble from the side of the discharge port 18 and that from the common liquid chamber are determined by the resistance of the portion closer to the discharge port and to the common liquid chamber than the bubble generating area (namely based on the resistance in the liquid paths and the inertia of the liquid).

Therefore, if the flow resistance is smaller in the side closer to the discharge port 18, a larger amount of liquid flows into the bubble vanishing position from the side of the discharge port 18, thereby increasing the amount of retraction of the meniscus. Therefore, if a smaller flow resistance is selected in the side closer to the discharge port 18 in order to improve the discharge efficiency, there results a larger amount of retraction of the meniscus M at the bubble vanishing, thus prolonging the refilling time and hindering the high-speed printing.

On the other hand, in the present embodiment involving the movable member 31, the retraction of the meniscus M stops when the movable member 31 reaches the original position in the course of bubble vanishing, and, if the bubble volume W is divided, by the first position of the movable member 31, into a volume W1 at the upper side and W2 at the side of the bubble generation area 11, the volume W2 remaining thereafter is principally replenished by the liquid flow $V_{D2}$ in the second liquid path 16. Consequently, the amount of retraction of the meniscus M, which has been about a half of the bubble volume W in the conventional configuration, can be reduced to about a half of the smaller volume W1.

Also the liquid replenishment of the volume W2 can be achieved, by the pressure at the bubble vanishing, in forced manner principally from the upstream side ($V_{D2}$) of the second liquid path, along a face of the movable member 31 at the side of the heat generating member 2, whereby faster refilling can be achieved.

The refilling operation in the conventional head utilizing the pressure at the bubble vanishing causes a significant vibration of the meniscus, leading to the deterioration of the image quality. In contrast, the high-speed refilling in the present embodiment can minimize the meniscus vibration at the discharge port 18 as the movable member suppresses the liquid movement between the first liquid path 14 at the side of the discharge port 18 and the bubble generating area 11.

As explained in the foregoing, the present invention achieves forced refilling to the bubble generating area 11 through the liquid supply path 12 of the second liquid path 16 and the high-speed refilling by the above-explained suppression of the meniscus retraction and the meniscus vibration, thereby realizing stable discharge, high-speed repeated discharges, and improvement in the image quality and in the printing speed.

The configuration of the present invention also has the following effective function, which is the suppression of propagation of the bubble-generated pressure to the upstream side (backward wave). Within the pressure resulting from the bubble generated on the heat generating member 2, a major portion based on the bubble at the side of the common liquid chamber (upstream side) forms a force (backward wave) which pushed back the liquid toward the upstream side. Such backward wave creates a pressure in the upstream side B, a resulting liquid movement and an inertial force associated with the liquid movement, which retard the liquid refilling into the liquid path and hinder the high-speed drive. On the other hand, in the present invention, the movable member 31 suppresses these actions toward the upstream side, thereby further improving the refilling ability.

In the following there will be explained additional structural features and effects of the present embodiment.

In the present embodiment, the second liquid path 16 is provided with a liquid supply path 12 having an internal wall which is connected with the upstream side of the heat generating member 2 in substantially flat manner (without a significant projection in the portion of the heat generating member 2). In such configuration, the liquid is supplied to the bubble generating area 11 and the surface of the heat generating member 2 by a flow $V_{D2}$, along a face of the movable member 31 closer to the bubble generating area 11. Such mode of liquid supply suppresses stagnation of the liquid on the surface of the heat generating member 2, thereby preventing separation of the gas dissolved in the liquid, also facilitating the elimination of so-called remaining bubble that could not vanish totally, and also avoiding excessive heat accumulation in the liquid. Consequently the bubble generation can be repeated at a high speed, in more stable manner. The present embodiment discloses a configuration having the liquid supply path 12 with a substantially flat internal wall, but there may be employed any liquid supply path that has a smooth internal wall connected smoothly with the surface of the heat generating member 2 so as not to cause liquid stagnation thereon or significant turbulence in the liquid supply.

The liquid supply to the bubble generating area 11 is also conducted by $V_{D1}$ through the lateral portion (slit 35) of the movable member 31. However such liquid flow through $V_{D1}$ to the bubble generating area 11 is hindered in a configuration where a large movable member 31 is employed to cover the entire bubble generating area 11 as shown in FIG. 1 in order to more effectively guide the pressure at the bubble generation to the discharge port 18 and the flow resistance of the liquid becomes large between the bubble generating area 11 and the area of the first liquid path 14 closer to the discharge port upon returning of the movable member 31 to the first position. However, in the head configuration of the present embodiment, the flow $V_{D1}$ for liquid supply to the bubble generating area significantly improves the liquid supplying ability which is not deteriorated even in a structure in which the movable member 31 covers the bubble generating area 11 in order to improve the discharge efficiency.

Figure 29:
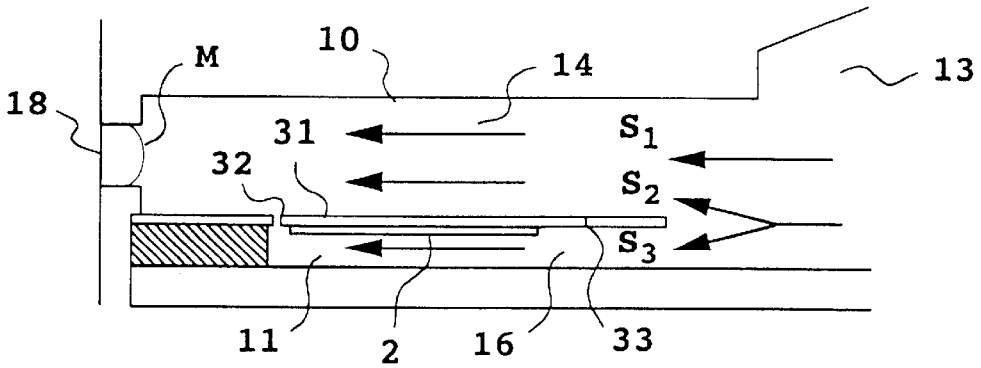
FIG. 29 is a schematic view showing the liquid flow in the present invention.

The movable member 31 is so constructed, for example as shown in FIG. 29, that the free end 32 is positioned at the downstream side with respect to the fulcrum 33. Such configuration allows to realize, at the bubble generation, the aforementioned functions and effects such as aligning of the pressure propagating direction of the bubble and the growing direction thereof toward the discharge port 18. Also such positional relationship attains, in addition to the functions and effects relating to the liquid discharge, a lower flow resistance for the liquid flowing in the liquid path at the liquid supply, thereby enabling high-speed refilling. This is because the free end 32 and the fulcrum 33 are so positioned, as shown in FIG. 5, that the movable member 31 is not against the flows S1, S2 and S3 in the liquid paths (including the first liquid path 14 and the second liquid path 16) at the returning of the meniscus M to the discharge port 18 by the capillary force or at the liquid replenishment for the vanished bubble.

More specifically, in the present embodiment in which the heat generating member 2 is formed on a face of the movable member 31, the free end 32 thereof is positioned at the downstream side of the bubble generating area. Consequently the pressure or the bubble generated at the downstream side of the center of the bubble generating area and significantly contributing to the liquid discharge is received by the movable member and can thus be guided toward the discharge port, whereby the discharge efficiency and the discharge force can be fundamentally improved.

In addition, the upstream side of the bubble is utilized also for attaining various effects.

Furthermore, in the configuration of the present embodiment, the instantaneous mechanical displacement of the free end of the movable member 31 is also considered to advantageously contribute to the liquid discharge.

[Embodiment 9]

In the following there will be explained another embodiment of the present invention, with reference to the attached drawings.

The present embodiment is same as the foregoing embodiments in the principle liquid discharging principle, but adopts a doubled liquid path configuration to divide the used liquid into bubble generating liquid which generates a bubble by heat application and discharge liquid which is principally discharged.

Figure 30:
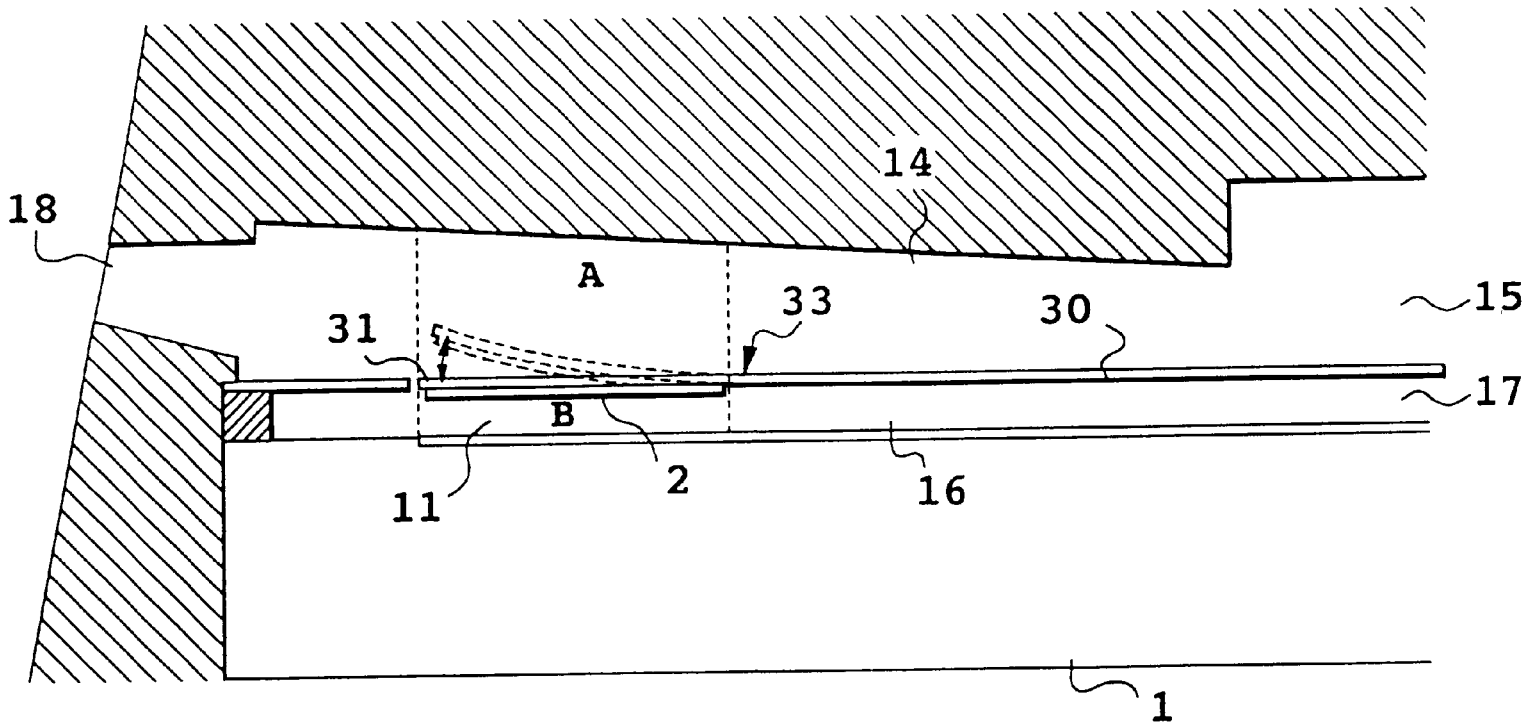
FIG. 30 is a schematic cross-sectional view, along the liquid path, of a liquid discharging head of a ninth embodiment of the present invention.

FIG. 30 is a schematic cross-sectional view of the liquid discharging head of the present embodiment along the liquid path.

The liquid discharging head of the present embodiment is provided, on an element substrate 1, with a liquid path 16 for second liquid for the bubble generating liquid, and thereon with a liquid path 14 for first liquid as the discharge liquid, communicating directly with a discharge port 18.

The upstream side of the first liquid path 14 communicates with a first common liquid chamber 15 for supplying the discharge liquid to the plural first liquid paths 14, while the upstream side of the second liquid path 16 communicates with a second common liquid chamber for supplying the bubble generating liquid to the plural second liquid paths 16.

However, in case the bubble generating liquid and the discharge liquid are same, the common liquid chambers may be united.

Between the first and second liquid paths 14, 16 there is provided a partition wall 30 composed of an elastic material such as a metal, for separating the first and second paths. In case the bubble generating liquid and the discharge liquid are to be least mixed, it is desirable to separate, as far as possible, the liquid of the first liquid path 14 and that of the second liquid path 16 by the partition wall 30, but, in case the bubble generating liquid and the discharge liquid may be mixed to a certain extent, the partition wall 30 need not be given the function of such complete separation.

The movable member 31 is provided, on a face thereof opposed to the discharge power generating area (area A and bubble generating area 11 (B) in FIG. 30), with a heat generating member 2 for providing thermal energy for bubble generation, and is formed as an end-supported beam defined by a surrounding slit and having a free end 32 at the side of the discharge port 18 (at the downstream side of the liquid flow) and a fulcrum 33 at the side of the common liquid chambers (15, 17). The movable member 31, being so positioned as to oppose to the bubble generating area 11 (B), is opened toward the discharge port 18 of the first liquid path 14 (as indicated by an arrow) by the bubble generation in the bubble generating liquid.

The arrangement of the fulcrum 33 and the free end 32 of the movable member 31 with respect to the heat generating member is same as in the foregoing embodiment.

Also the structural relationship of the second liquid path 16 and the heat generating member 2 in the present embodiment is same as that of the liquid supply path 12 and the heat generating member 2 explained in the foregoing embodiment.

Figure 31A:
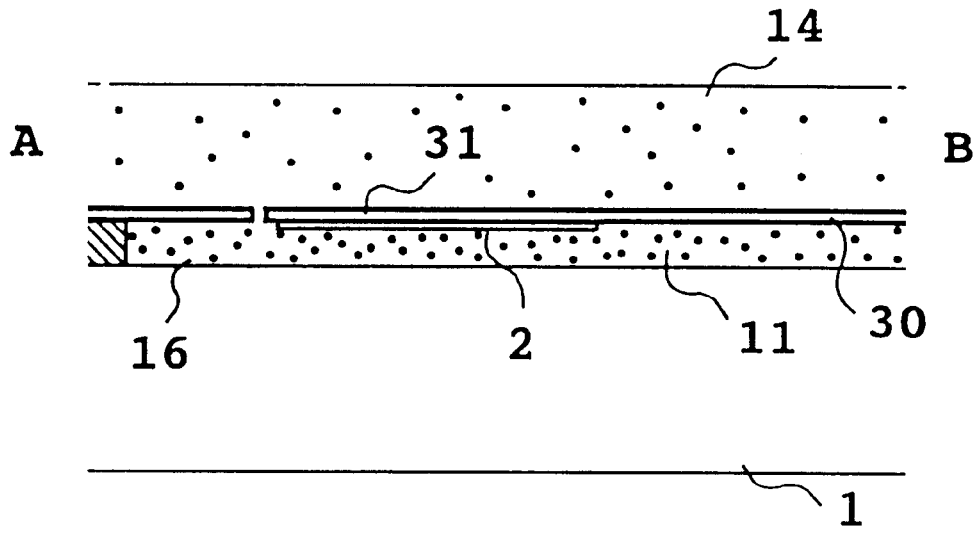
FIGS. 31A and 31B are cross-sectional views showing the discharging function of the ninth embodiment of the liquid discharging head of the present invention.
Figure 31B:
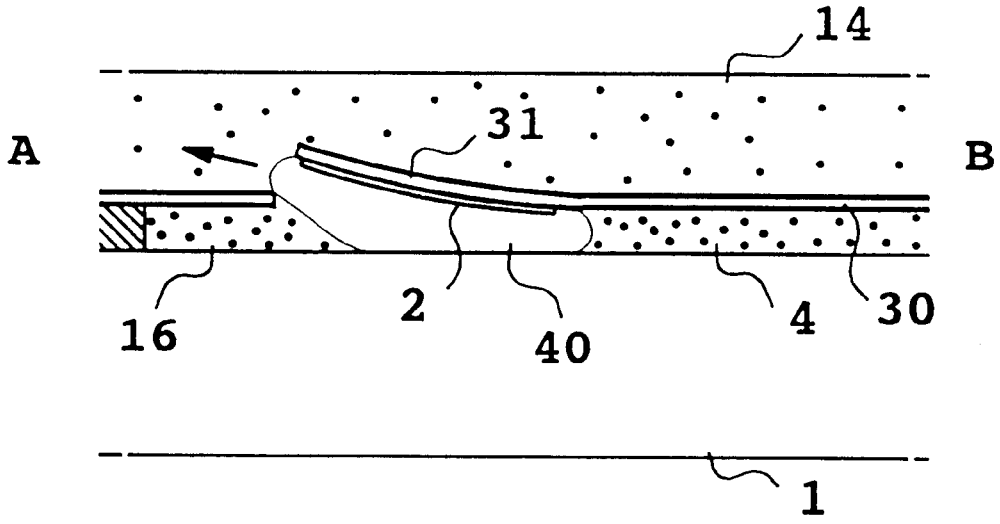

Now reference is made to FIGS. 31A and 31B for explaining the function of the liquid discharging heat of the present embodiment.

The head of the present embodiment was driven with same aqueous ink as the discharge liquid to be supplied to the first liquid path 14 and as the bubble generating liquid to be supplied to the second liquid path 16.

The heat generated by the heat generating member 2 is applied to the bubble generating liquid contained in the bubble generating area of the second liquid path to generate a bubble 40 therein by the film boiling phenomenon, as disclosed in the U.S. Pat. No. 4,723,129.

In the present embodiment, since the bubble-generated pressure cannot escape from the bubble generating area in the three directions thereof, except for the upstream side, such pressure propagates in concentrated manner to the movable member 31 provided in the discharge pressure generating area, and, with the growth of the bubble, the movable member 31 displaces from the state shown in FIG. 31A toward the first liquid path 14 as shown in FIG. 31B. By such function of the movable member 31, the first liquid path 14 communicates widely with the second liquid path 16 and the bubble-generated pressure is principally transmitted toward the discharge port (direction A) in the first liquid path 14. The liquid is discharged from the discharge port 18 by the propagation of such pressure, combined with the mechanical displacement of the movable member 31.

Then, with the contraction of the bubble, the movable member 31 returns to a state shown in FIG. 31A and, in the first liquid path 14, the discharge liquid of an amount, corresponding to that of the discharged liquid, is replenished from the upstream side. Also in this embodiment, the refilling of the discharge liquid is not hindered by the movable member 31, as the liquid is supplied in the closing direction of the movable member 31.

The present embodiment is same as the foregoing first embodiment in the principal effects and advantages relating to the propagation of the bubble-generated pressure, the growing direction of the bubble 40 and the prevention of the backward wave based on the displacement of the movable member 31, but it further provides the following advantages because of the two-liquid path configuration.

The above-explained configuration allows to employ different liquids for the discharge liquid and the bubble generating liquid, and to discharge the discharge liquid by the pressure induced by the bubble generation in the bubble generating liquid. For this reason, even a highly viscous liquid such as polyethylene glycol, which can only show an insufficient discharge force because of insufficient bubble generation under heat application, can be discharged satisfactorily by supplying such liquid in the first liquid path and by supplying the second liquid path with a liquid capable of satisfactory bubble generation (for example an ethanol-water mixture with a mixing ration of 4:6 with a viscosity of 1–2 cP) or a low-boiling liquid.

It is also possible to stabilize the bubble generation thereby achieving satisfactory liquid discharge, by selecting a liquid which does not generate deposit or cogation on the surface of the heat generating member under heat application as the bubble generating liquid.

Also the head configuration of the present embodiment, capable of providing the effects explained in the foregoing embodiments, can discharge various liquids such as highly viscous liquid with a high discharge efficiency and a high discharging force.

Also even liquid susceptible to heat can be discharged without thermal damage and with a high discharge efficiency and a high discharge force, by supplying the first liquid path with such liquid as the discharge liquid and supplying the second liquid path with liquid which is thermally stable and is capable of satisfactory bubble generation.

[Embodiment 10]

In the following there will be explained a tenth embodiment of the present invention.

Figure 32:
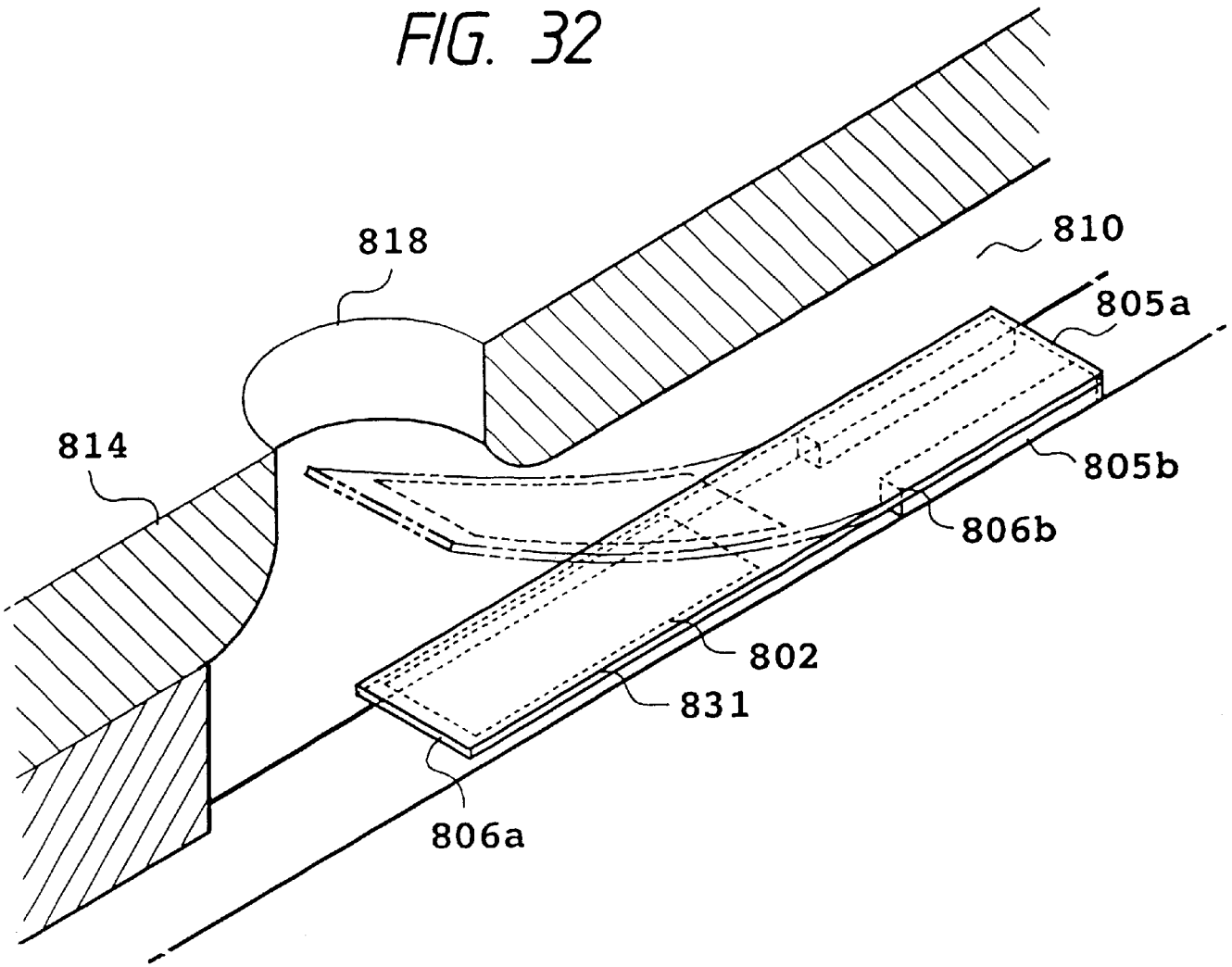
FIG. 32 is a partially cut-off schematic perspective view of a tenth embodiment of the liquid discharging head of the present invention.

FIG. 32 is a partially cut-off schematic perspective view of a liquid discharging head constituting the tenth embodiment of the present invention.

In contrast to the heads of the first and second embodiments of edge shooter type which discharges the liquid in a direction lateral to the bubble generating direction of the heat generating member, the liquid discharging head of the present embodiment is so-called side shooter type in which the discharge port 18 is positioned substantially parallel to the bottom face of the liquid path. A heat generating member 802 (heat generating resistance member of 48×46 μm in the present embodiment) is provided, as in the first and second embodiments, on a face of a movable member 831 opposed to an element substrate 801, and generates thermal energy to be utilized for generation of a bubble 840 by a film boiling phenomenon as described in the U.S. Pat. No. 4,723,129. A discharge port 818 is formed in an orifice plate 814, constituting a discharge port member and formed by nickel electroforming.

A liquid path 810 directly communicating with the discharge port 818 is provided between the orifice plate 814 and the substrate 801. In the present embodiment, aqueous ink is employed as the liquid to be discharged.

A movable member 831 formed as a planar beam supported at an end is provided in the liquid path 810 and is composed of an elastic material such as metal. In the present embodiment it is formed with nickel of a thickness of 5 μm. An end 805*a* of the movable member 831 is fixed to and supported by a support member 805*b*, which is formed by patterning photosensitive resin on the substrate 801. The movable member 831 is spaced by a gap of about 15 μm from the element substrate 801.

A wall member 815*a* is provided as a counter member opposed to the heat-generating face of the movable member 831 at the opened state thereof. The movable member 831 is provided with a fixed end (fulcrum) 806*b* at the upstream side of the liquid flow from the common liquid chamber (not shown) to the discharge port 818 through the movable member 831, and a free end 806*a* at the downstream side. The fixed end 806*b* functions as the fulcrum or supporting point at the opening operation of the movable member 831.

Within the movable member 831, at least the free end 806*a* thereof is provided in an area receiving the pressure of the bubble.

In the following description, the upper area (at the side of the discharge port) of the movable member 831 in the stationary state will be referred to as "A", while the lower area (at the side of the heat generating member) will be referred to as "B".

When a bubble is generated in the area B by the heat generation from the heat generating member 802, the free end 806*a* of the movable member 831 instantaneously displaces toward the area A, in a direction indicated by a double-dotted broken line in FIG. 8, about the fulcrum at 806*b* by the function of the pressure resulting from generation and growth of the bubble or of the growing bubble itself, whereby the liquid is discharged from the discharge port 818.

In the present embodiment, the movable member 831 is so positioned that the free end 806*a* thereof is at the upstream side of the approximate center of the discharge port 818.

The application of an electrical signal to the heat generating member 802 constituting the electrothermal converting member is conducted through wiring electrodes (not shown) provided on the movable member 831.

Figure 28:
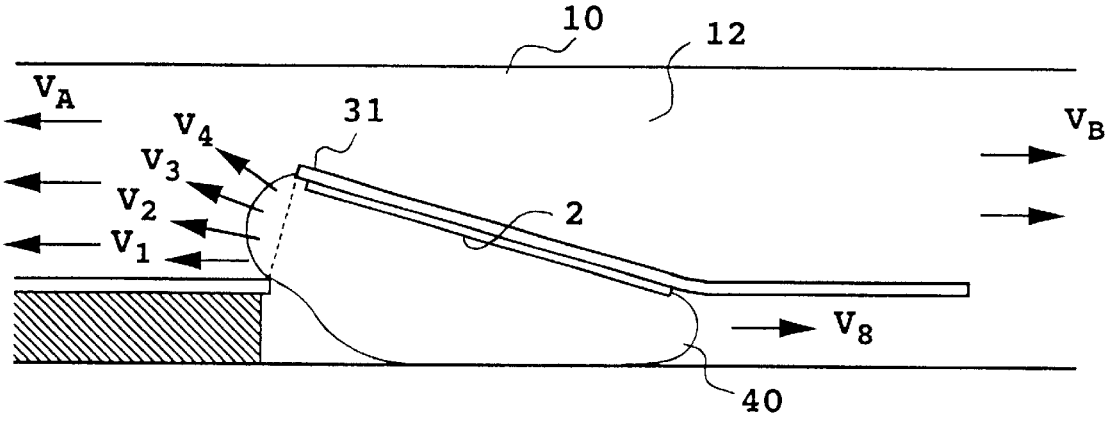
FIG. 28 is a view showing the principle of discharge in the present invention.

The basic liquid discharging principle of the present embodiment is same as that of the foregoing embodiments explained in relation to FIGS. 7 and 28, and is based on a fact that the movable member 831, so provided as to face the bubble, is displaced from the first stationary position to the second displaced position by the bubble 840 itself or the pressure thereof and such displacing movable member 831 guides the bubble 840 itself and the pressure resulting therefrom toward the downstream side where the discharge port 818 is located.

Now the discharging operation of the liquid discharging head of the present embodiment will be explained with reference to FIGS. 33A to 33D, which are schematic cross-sectional views for explaining the discharging operation of the liquid discharging head of the present embodiment, wherein the support member 805*b* is omitted for the purpose of clarity.

Figure 33A:
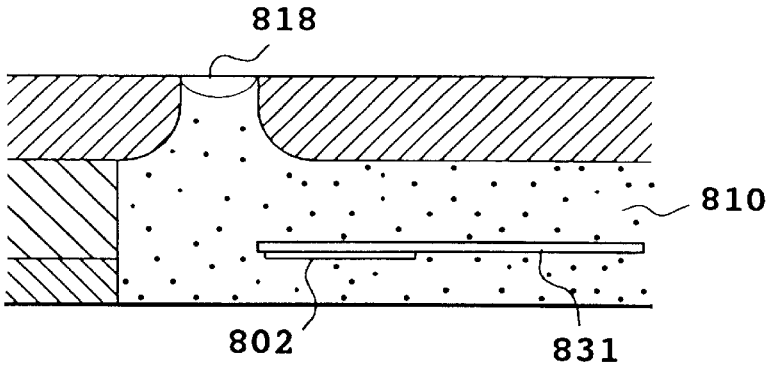
FIGS. 33A, 33B, 33C and 33D are schematic cross-sectional views showing the discharging function of the liquid discharging head of the tenth embodiment.

FIG. 33A shows a state prior to the application for example of electric energy to the heat generating member 802, thus prior to the heat generation thereby.

Figure 33B:
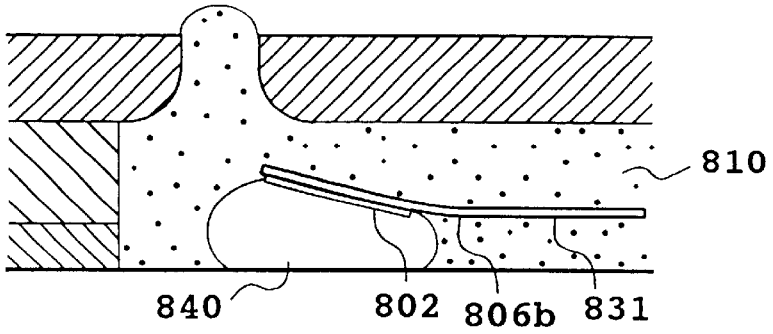

FIG. 33B shows a state where the heat generating member 2 generates heat by the application for example of electrical energy, and a bubble 840 is generated and is growing by film boiling induced by the generated head. The pressure resulting from the generation and growth of the bubble 840 is principally transmitted to the movable member 831, and the mechanical displacement thereof contributes to the discharge of the discharge liquid from the discharge port 818.

Figure 33C:
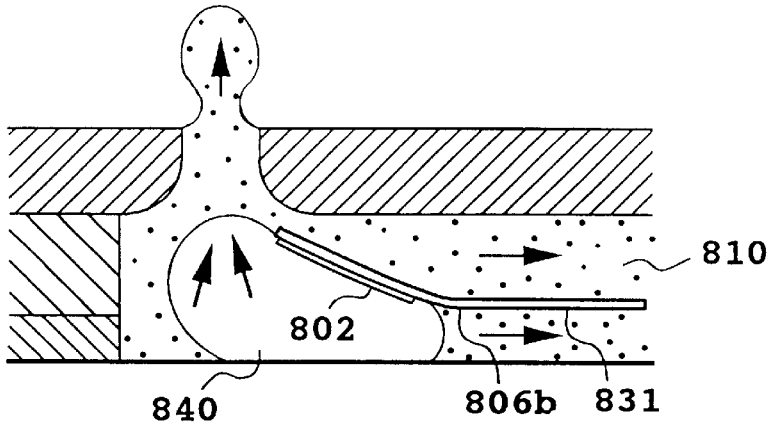

FIG. 33C shows a state in which the bubble grows further and the movable member 831 is displaced further about the fulcrum at 806*b*, with the growth the bubble 840. By the displacement of the movable member 831, the area A at the side of the discharge port communicates with the area B at the side of the heat generating member wider than in the initial state. In this state, the communication path between the heat generating surface and the discharge port 818 is suitably constricted by the movable member 831, whereby the force of the bubble 840 is concentrated toward the discharge port 818. In this manner the pressure wave resulting from the growth of the bubble 840 is concentrated directly upwards in concentrated manner toward the discharge port 818. Such direct propagation of the pressure wave and the mechanical displacement of the movable member 831 cause the discharge liquid to be discharged as a droplet 811*a* (FIG. 33D) from the discharge port 818, with a high speed, a high discharging force and a high discharge efficiency.

In the state shown in FIG. 33C, with the displacement of the movable member 831 toward the discharge port 818, a part of the bubble 840 generated in the area B at the side of the heat generating member extends to the area A at the side of the discharge port. The discharging force can be further increased by selecting the distance from the heat generating surface of the heat generating member 802 or the surface of the substrate 801 to the movable member 831 in such a manner that the bubble 840 can extend to the area A at the side of the discharge port. In order that the bubble 840 can extend toward the discharge port 818 beyond the initial position of the movable member 831, the height of the area B at the side of the heat generating member is preferably selected smaller than the height of the maximum bubble, namely within a range of several micrometers to 30 micrometers.

Figure 33D:
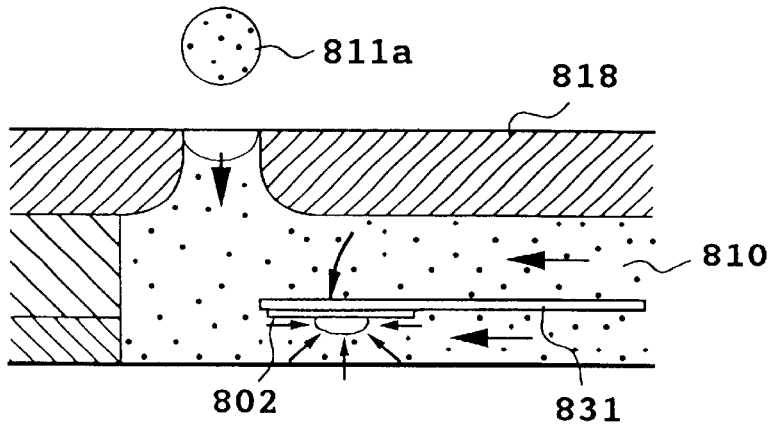

FIG. 33D shows a state in which the bubble 840 contracts and vanishes by the decrease of the pressure in the bubble. The movable member 831 returns to the initial position by a negative pressure generated by the contraction of the bubble and the elastic returning force of the movable member itself. In the liquid path 810, the liquid corresponding to the discharged amount is promptly replenished, since the liquid path 810 is scarcely affected by the backward wave resulting from the bubble and the replenishing operation, being conducted parallel to the closing of the movable member 810, is little hindered by such movable member 810.

Since the free end 806*a* of the movable member 831 in the present embodiment is positioned at the upstream side with respect to the approximate center of the discharge port 818 as explained in the foregoing, the free end 806*a* does not enter the area of the discharge port 818 projected onto the substrate, at the displacement of the movable member 831 as shown in FIG. 33C. Consequently the growth of the bubble 840 toward the discharge port 818 is not hindered, and there can be obtained a satisfactory discharging power. The above-mentioned arrangement of the movable member 831 and the free end 806*a* thereof is also effective in suppressing the propagation of the pressure of the bubble 840 toward the upstream side (backward wave), thereby achieving stable liquid discharge.

In the following there will be given a detailed explanation on the liquid filling in the liquid discharging head of the present embodiment.

When the bubble 840 enters a vanishing stage from the state of maximum volume, the liquid of a volume corresponding to the vanishing bubble flows into the areas from the side of the discharge port 818 and from the side of the liquid path 810. When the volume W of the bubble 840 is divided by the initial position of the movable member 831 into W1 at the upper side (at the side of the discharge port) and W2 at the lower side (at the side of the heat generating member), the retraction of the meniscus at the discharge port 818 for compensating the volume W1 stops when the movable member returns to the initial position in the course of bubble vanishing, and the remaining volume W2 is principally replenished by the liquid supply between the movable member 831 and the heat generating surface. It is therefore rendered possible to suppress the retraction of meniscus in the discharge port 818.

Also in the present embodiment, the liquid replenishment of the volume W2 can be achieved, by the pressure at the bubble vanishing, in forced manner principally from the liquid path 810, along the heat generating surface of the heat generating member 802, whereby faster refilling can be achieved. The refilling operation in the conventional head utilizing the pressure at the bubble vanishing causes a significant vibration of the meniscus, leading to the deterioration of the image quality. In contrast, the high-speed refilling in the present embodiment can minimize the meniscus vibration as the movable member 831 suppresses the liquid movement between the area A at the side of the discharge port and the area B at the side of the heat generating member. In this manner there can be achieved improvement in the image quality and high-speed recording.

[Embodiment 11]

In the following there will be explained an eleventh embodiment of the present invention.

Figure 34:
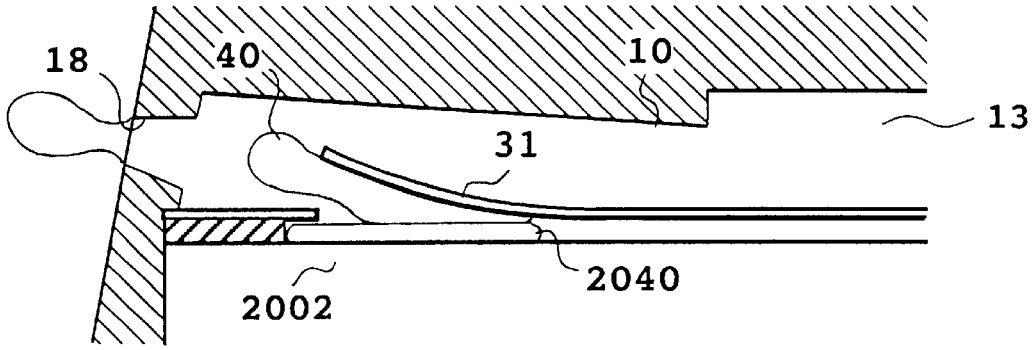
FIG. 34 is a cross-sectional view showing the schematic configuration of an eleventh embodiment of the present invention.

FIG. 34 is a schematic cross-sectional view showing the configuration of the eleventh embodiment, which is formed by providing the liquid discharging head of the edge shooter type of the first embodiment with a second heat generating member 2002 on the element substrate 1 in a portion opposed to the movable member 31 bearing the heat generating member 2 (not shown). FIG. 34 shows a state where bubbles 40 and 2040 are formed by supplying the two heat generating members with energy. The present embodiment is same as the first embodiment in other configurations.

The present embodiment, being provided with two heat generating members 2 and 2002 as explained above, is capable of various controls by selecting the timing and the operation of energy supply for bubble generation to the respective heat generating members.

For example, the liquid discharge amount can be controlled in three levels by:

1. liquid discharge by the heat generating member 2 only;
2. liquid discharge by the heat generating member 2002 only; or
3. liquid discharge by both heat generating members 2 and 2002.

Such gradation control can be adjusted by the sizes of the respective heat generating members and the magnitude of energies to be given to the respective heat generating members for bubble generation, and enables recording of extremely good gradation.

Also in comparison with the conventional single heat generating member, the two heat generating members 2, 2002 enables liquid discharge of a larger volume with a higher discharging power.

Also the selection of timing of supply of the bubble generating energy allows to further improve the discharge efficiency and to prevent mixing of the bubble generating liquid into the discharge liquid.

For further improving the discharge efficiency, the second heat generating member 2002 is caused to generate a bubble 2040 of a size that moves the movable member 831 a little, and then the heat generating member 2 is caused to generate a bubble 40 for discharging the liquid. In such case, since the movable member 831 has started to displace, the pressure of the bubble 40 generated by the heat generating member 2 propagates almost entirely toward the discharge port, whereby the discharging power is increased.

For preventing the mixing of the bubble generating liquid into the discharge liquid, the second heat generating member 2002 is caused to generate a bubble 2040 of a size that covers the aperture of the movable member 831, and then the heat generating member 2 is caused to generate a bubble 40 for discharging the liquid. In such case, the bubbles 40 and 2040 do not become connected by the function of interfacial tension, so that the discharge liquid in the first liquid path is almost exclusively discharged.

[Embodiment 12]

In the following there will be explained a twelfth embodiment of the present invention.

Figure 35A:
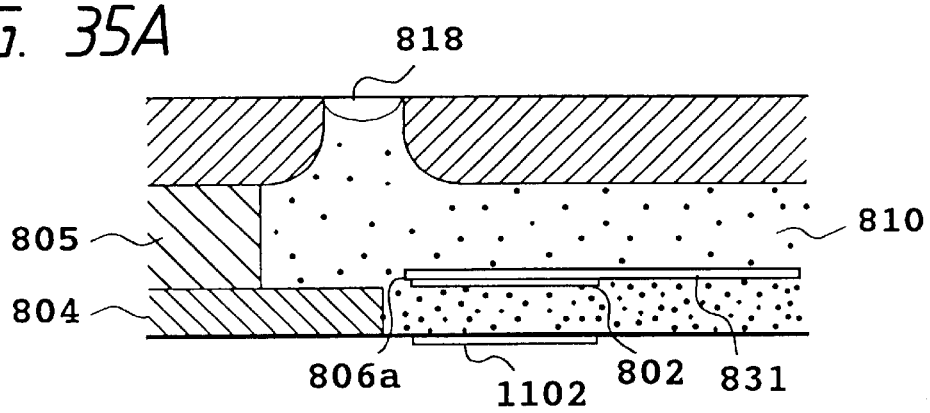
FIGS. 35A and 35B are cross-sectional views showing schematic configuration of a twelfth embodiment of the present invention, respectively at an initial state and at a discharging state.
Figure 35B:
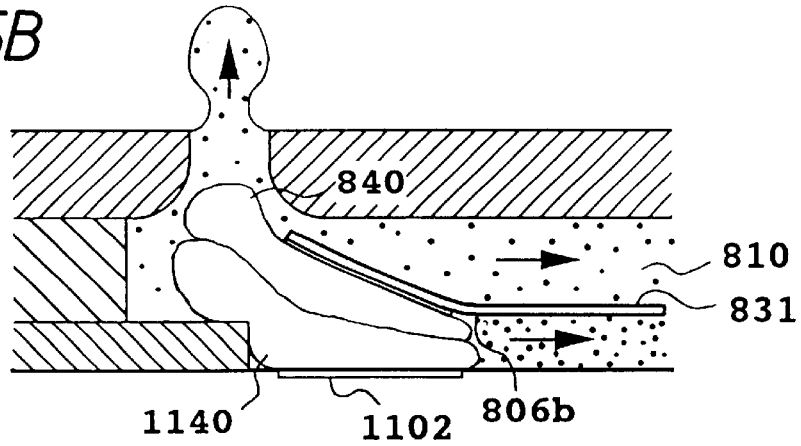

FIGS. 35A and 35B are schematic cross-sectional views showing configuration of the twelfth embodiment, respectively in an initial state and in a state of liquid discharge. The present embodiment is formed by providing the liquid discharging head of side shooter type of the tenth embodiment shown in FIGS. 33A to 33D with a second heat generating member 1102 on the element substrate 1 in a portion thereof opposed to the movable member 831, and supplying the area A at the side of the discharge port 818 and the area B at the side of the heat generating member 2, with respect to the movable member 831, respectively with different liquids (hereinafter respectively called discharge liquid and bubble generating liquid).

In the present embodiment, the positional relationship of the end 806*a* of the movable member 831 and the discharge port 818 is same as that in the tenth embodiment, but, in order to reduce the mixing of the discharge liquid and the bubble generating liquid, a wall support portion 804 is extended to the vicinity of the end 806*a* of the movable member 831 in the initial state shown in FIG. 35A.

FIG. 35B shows a state where bubbles 40, 1140 are formed by the supply of energies to the two heat generating members 802, 1102.

The present embodiment, being provided with two heat generating members 202, 1102 as explained above, is capable of various controls by selecting the timing and the operation of energy supply for bubble generation to the respective heat generating members as in the foregoing embodiment.

The configuration of the present invention, having the heat generating member for bubble generation in the movable member itself, is applicable to the liquid discharging head of edge shooter type or side shooter type as explained in the foregoing, and also to the liquid discharging head employing different liquids as the discharge liquid and the bubble generating liquid. Also in any of these types, there may be employed the configuration having a second heat generating member on the element substrate opposed to the movable member as in the eleventh and twelfth embodiments respectively shown in FIGS. 34 and 35A and 35B.

Also the position of the movable member relative to the discharge port is not limited to that described in the foregoing embodiments. The position of the movable member is significantly related with the liquid discharging characteristics represented by the liquid discharging speed, the liquid discharge amount and the refilling frequency and can be suitably selected so as to obtain the liquid discharging characteristics appropriate for the recording apparatus to be used.

In the following there will be explained features of the present invention described in the foregoing embodiments, in the classifications of (1) configuration having the heat generating member on the movable member, and (2) configuration having the heat generating members on the movable member and the element substrate.

(1) Configuration Having the Heat Generating Member on the Movable Member

1. As the heat generating member is provided on the movable member itself, the movable member is securely displaced by the bubble generated by the supply of energy to the heat generating member, whereby the discharge amount and the discharging speed are securely improved.

2. In case the discharge liquid and the bubble generating liquid are mutually different, the bubble generated by the supply of energy to the heat generating member at first expands at the side of the bubble generating liquid, and then pushes up the movable member, expanding in a form of blocking the communicating area of the bubble generating liquid and the discharge liquid, so that reduced is the mixing of the bubble generating liquid into the liquid discharged from the discharge port. Also in the non-discharging state, the mixing of the discharge liquid and the bubble generating liquid is prevented by the movable member positioned therebetween. In this manner the discharge liquid and the bubble generating liquid can be maintained in a satisfactorily separated state.

(2) Configuration Having the Heat Generating Members on the Movable Member and the Element Substrate 3. In case the additional heat generating member is provided on the element substrate, in a position opposed to the heat generating member provided on the movable member, there can be achieved a further improvement in the discharge amount and the discharge speed by giving energies to the respective heat generating members. It is also possible to obtain different levels of discharge amount and discharge speed by utilizing either or both of the heat generating members for the liquid discharge, thereby achieving recording with gradation control.

4. Since the heat generating members can be respectively formed on the movable member and the element substrate which assume a same position in the plan view, each heat generating member can be given a sufficiently large area and can have satisfactory freedom in designing. It is also possible to improve the discharge amount and the discharge speed with the heat generating members of a size same as in the conventional configuration, and to increase the density of the nozzles and to shorten the length of the nozzle despite of these improvements, whereby achieved are high-speed refilling and high-speed printing.

5. The heat generating members can be respectively formed on the movable member and the element substrate which assume a same position in the plan view, and the one-dimensional distance from the discharge port to the center of gravity of the heat generating member can be made same as that in the conventional configuration. The above-mentioned distance is an important factor determining the liquid discharging characteristics represented by the discharge speed, the discharge amount and the refilling frequency, and the optimum designing can be easily realized because the centers of gravity of the heat generating members can be provided in a same position in the plan view.

6. The size and the position of center of gravity of each heat generating member can be made same as in the conventional configuration as explained above. Consequently the shape and the components can be made same as in the conventional configuration, whereby the improvements in the performance can be achieved with a minimum increase in the manufacturing cost.

In the liquid discharging heads shown in FIGS. 1 to 35A and 35B, bubbles are generated in the liquid paths after prolonged standing or by temperature increase in the printing operation.

If bubbles are present in the first liquid path 14, there are discharged bubble-containing liquid or bubbles only from the discharge port 18, leading to defective liquid discharge or lack of liquid discharge. In particular, a bubble eventually present in the vicinity of the movable member 31 may hinder the displacement thereof, eventually leading to defective printing. Also if bubbles are present in the second liquid path 16, the bubble generating liquid containing such bubbles can only perform insufficient bubble generation, leading to defective liquid discharge or lack of liquid discharge.

Such bubble, if sticking to the wall of the liquid path, is difficult to remove by the ordinary recovery operation.

The present invention is reached in consideration of these facts and will be explained in more details by embodiments thereof.

Figure 36A:
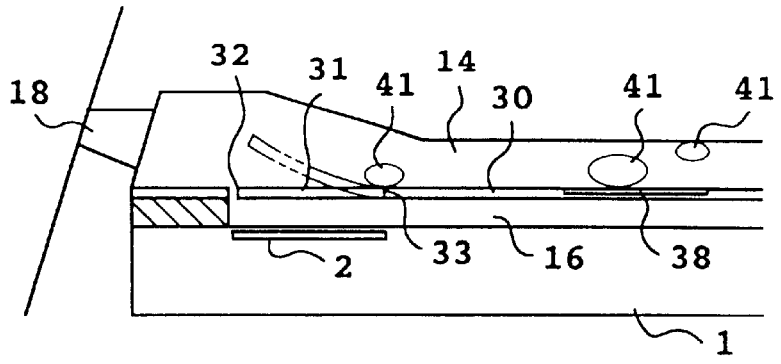
FIGS. 36A, 36B and 36C are cross-sectional views showing schematic configuration of an embodiment of the liquid discharging head of the present invention.
Figure 36B:
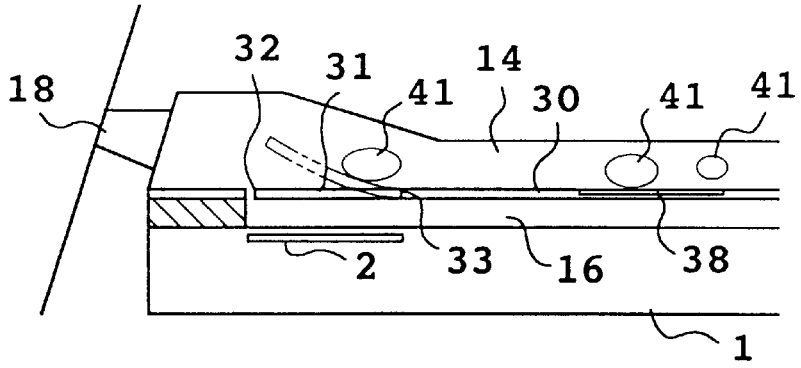
Figure 36C:
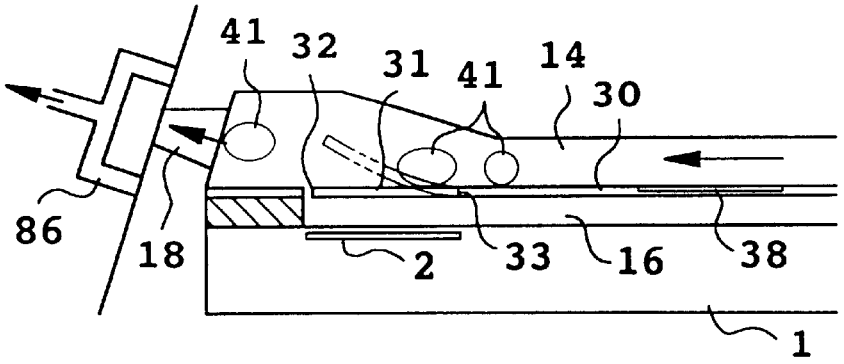

FIGS. 36A to 36C are cross-sectional views of a liquid discharging head constituting an embodiment of the present invention, wherein components equivalent in function to those in the foregoing embodiments will be represented by same numbers and will not be explained further. In the present embodiment, a sub heater 38 is provided on a face of the partition wall 30 opposed to the first liquid path 14 and is used for temperature adjustment of the discharge liquid in the first liquid path 14, thereby removing the bubble therein.

More specifically, after prolonged standing or by temperature increase in the printing operation, a small bubble 41 is generated in the first liquid path 14 and sticks to the wall of the first liquid path 14 in the vicinity of the movable member 31 as shown in FIG. 36A. Therefore, in the present embodiment, the sub heater 38 is energized at the recovery operation to heat the interior of the first liquid path 14, thereby generating a convection flow in the liquid of the first liquid path 14 as shown in FIG. 36B, thus stimulating the peeling of the bubble 41 from the wall and causing the bubble 41 to grow. Then a suction recovery operation is conducted by covering the discharge port 18 with a cap member 86 as shown in FIG. 36C to discharge the bubble 41, present in the first liquid path 14, from the discharge port 18. Such suction recovery operation may be conducted during the energization of the sub heater 38 or after the energization for a predetermined period.

Figure 37:
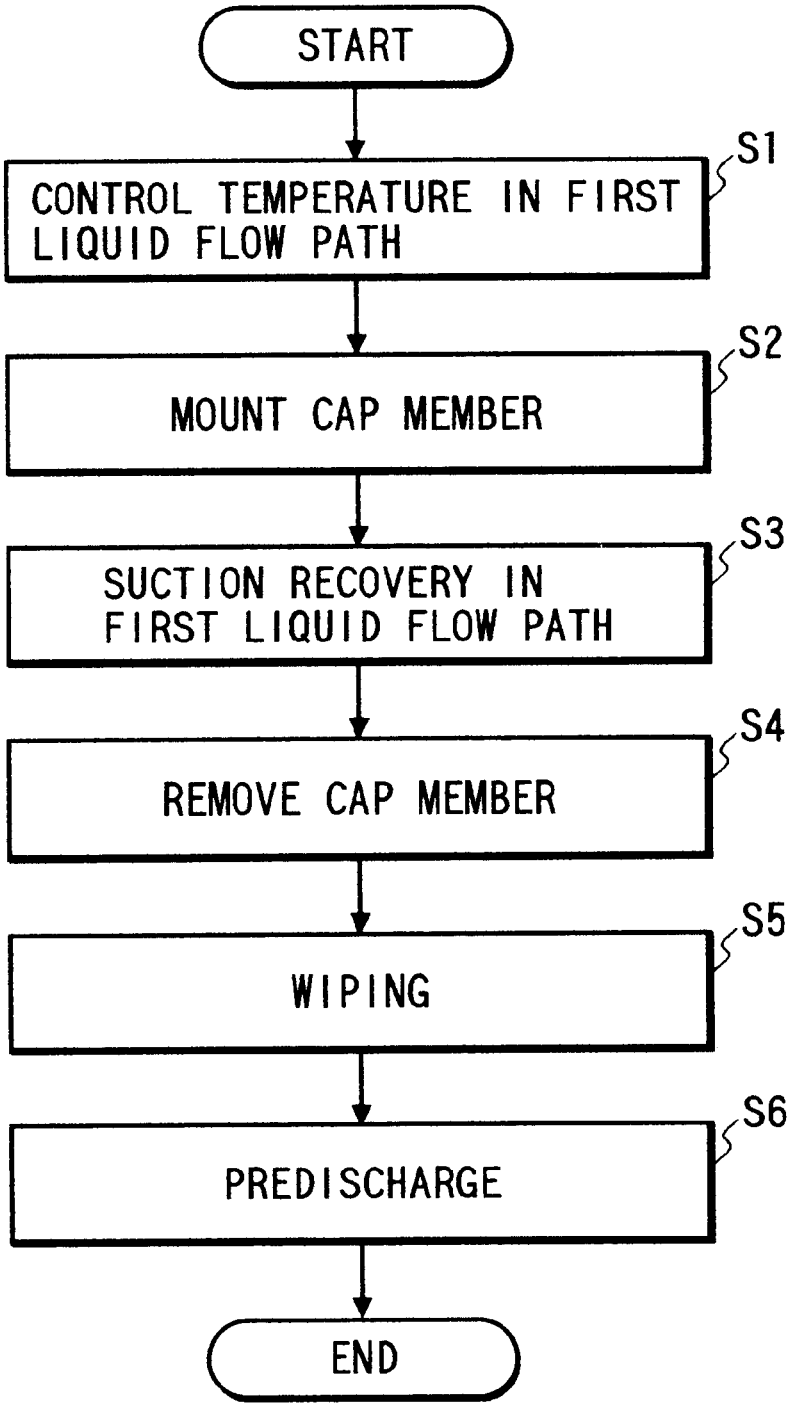
FIG. 37 is a flow chart of a recovery process in the embodiment shown in FIGS. 36A, 36B and 36C.

FIG. 37 shows the process sequence of the present embodiment. At first a step S1 energizes the sub heater 38 for temperature adjustment of the interior of the first liquid path 14, then a step S2 covers the discharge port 18 with the cap member 86, and a step S3 executes the suction recovery of the first liquid path 14. Then a step S4 separates the cap member 86 from the discharge port 18, and further executes suction of the interior of the cap member 86 for discharging the liquid present therein. Then a step S5 wipes the orifice face, and a step S6 executes preliminary liquid discharge according to the necessity. The printing operation is started thereafter.

The above-explained embodiment is to remove the bubble 41 present in the first liquid path 14, but it is also possible to remove the bubble present in the second liquid path 16 at the same time.

Figure 38A:
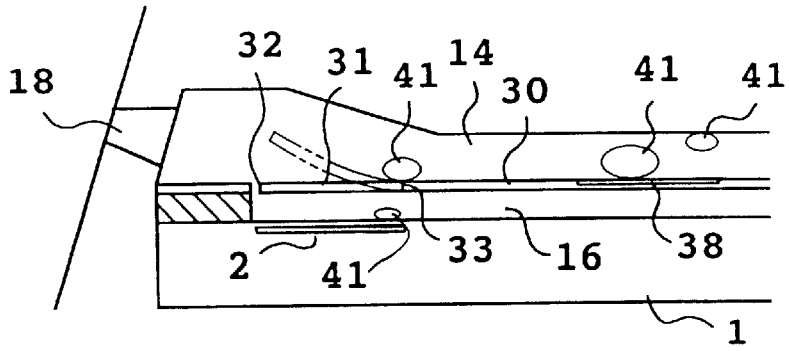
FIGS. 38A, 38B and 38C are cross-sectional views showing schematic configuration of another embodiment of the liquid discharging head of the present invention.
Figure 38B:
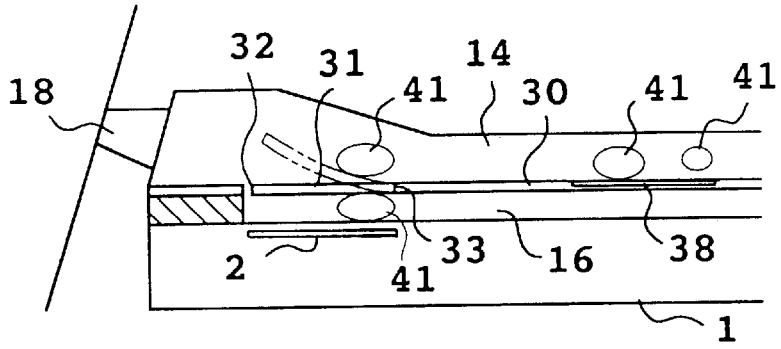
Figure 38C:
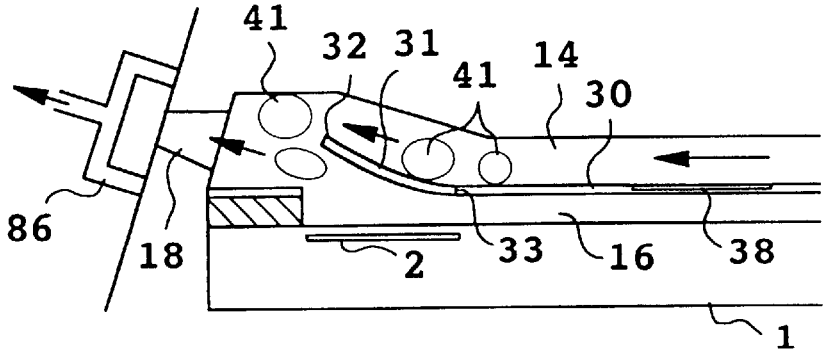

FIGS. 38A to 38C are cross-sectional views of a liquid discharging head constituting another embodiment of the present invention, wherein components equivalent in function to those in the foregoing embodiments will be represented by same numbers and will not be explained further.

After prolonged standing or by temperature increase in the printing operation, small bubbles 41 are generated in the first and second liquid paths 14, 16 and sticks to the walls of the first and second liquid paths 14, 16 on the heat generating member 2 or in the vicinity of the movable member 31 as shown in FIG. 38A. Therefore, in the present embodiment, the sub heater 38 and the heat generating member 2 are energized at the recovery operation to heat the interior of the first and second liquid paths 14, 16 thereby generating convection flows in the liquids of the first and second liquid paths 14, 16 as shown in FIG. 38B, thus stimulating the peeling of the bubbles 41 from the wall and causing the bubbles 41 to grow. Then a suction recovery operation is conducted by covering the discharge port 18 with a cap member 86 as shown in FIG. 38C to discharge the bubbles 41, present in the first and second liquid paths 14, 16 from the discharge port 18. Such suction recovery operation may be conducted during the energization of the sub heater 38 and the heat generating member 2 or after the energization for a predetermined period. There may also be executed a pressurized recovery operation, or a suction recovery and a pressurized recovery in combination. The energization of the heat generating member 2 for recovery is executed with a pulse shorter than that used for liquid discharge.

Figure 39:
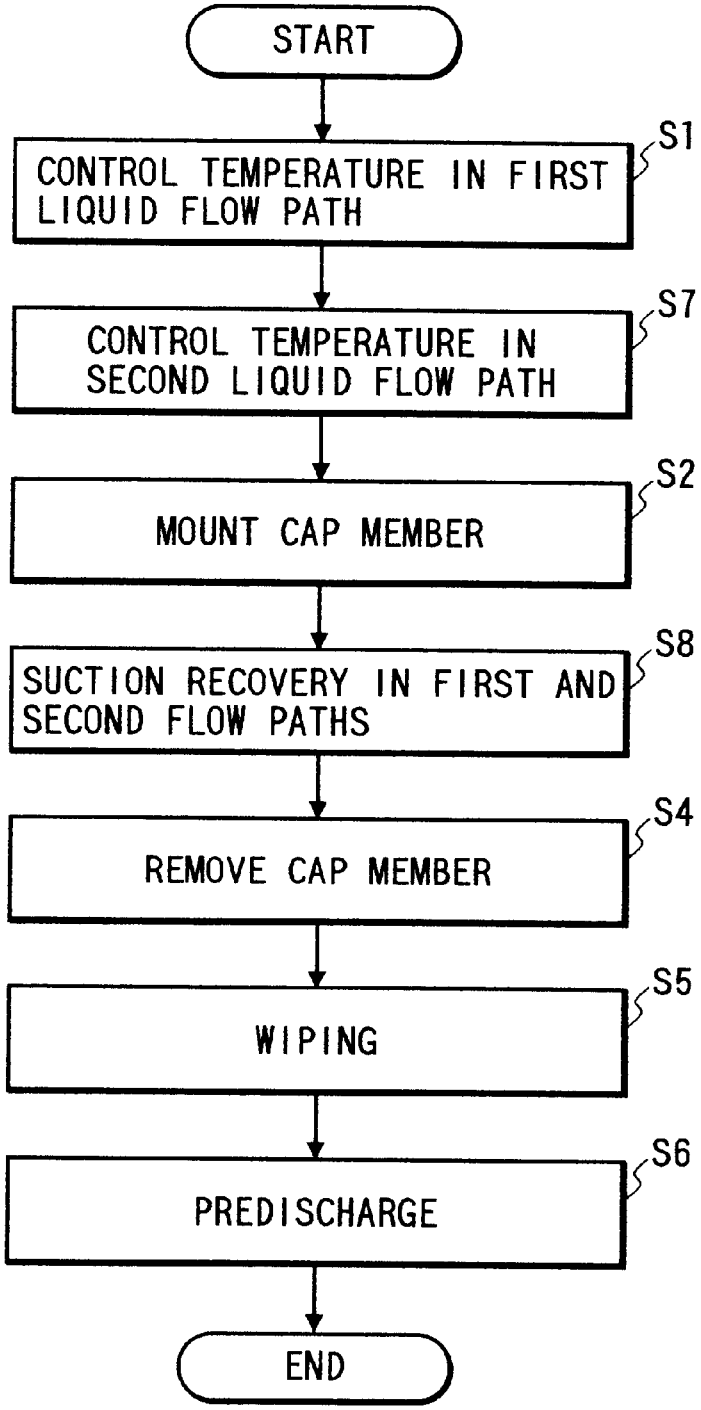
FIG. 39 is a flow chart of a recovery process in the embodiment shown in FIGS. 38A, 38B and 38C.

FIG. 39 shows the process sequence of the present embodiment. At first a step S1 energizes the sub heater 38 for temperature adjustment of the interior of the first liquid path 14, then a step S7 energizes the heat generating member 2 for temperature adjustment of the interior of the second liquid path 16, then a step S2 covers the discharge port 18 with the cap member 86, and a step S8 executes the suction recovery of the first and second liquid paths 14, 16. Then a step S4 separates the cap member 86 from the discharge port 18, and further executes suction of the interior of the cap member 86 for discharging the liquid present therein. Then a step S5 wipes the orifice face, and a step S6 executes preliminary liquid discharge according to the necessity. The printing operation is started thereafter.

The above-explained sub heater 38 is to execute the temperature adjustment of the interior of the first liquid path 14 only, but it may also be so designed as to execute the temperature adjustment of the interior of the second liquid path 16 also.

Figure 40A:
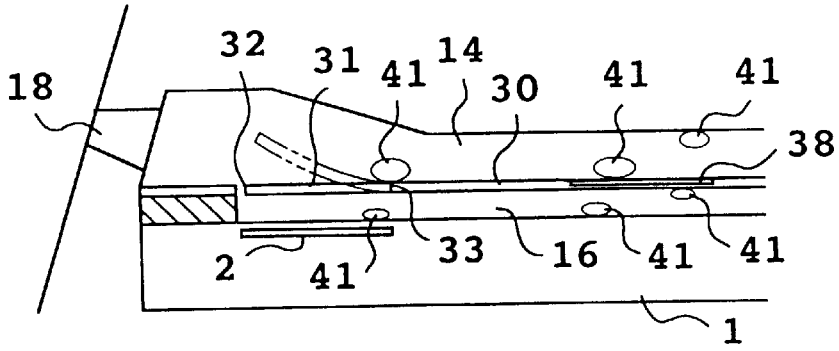
FIGS. 40A, 40B and 40C are cross-sectional views showing schematic configuration of another embodiment of the liquid discharging head of the present invention.
Figure 40B:
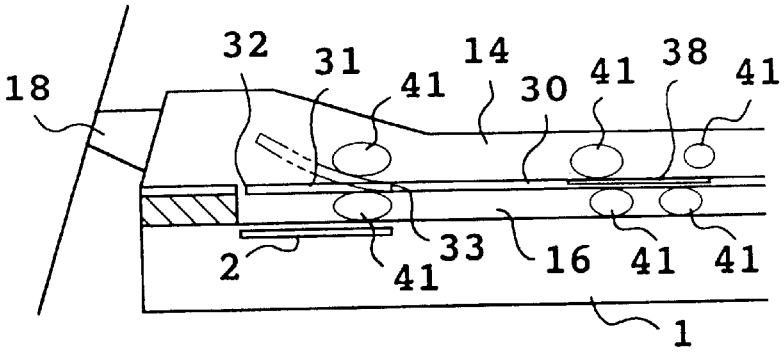
Figure 40C:
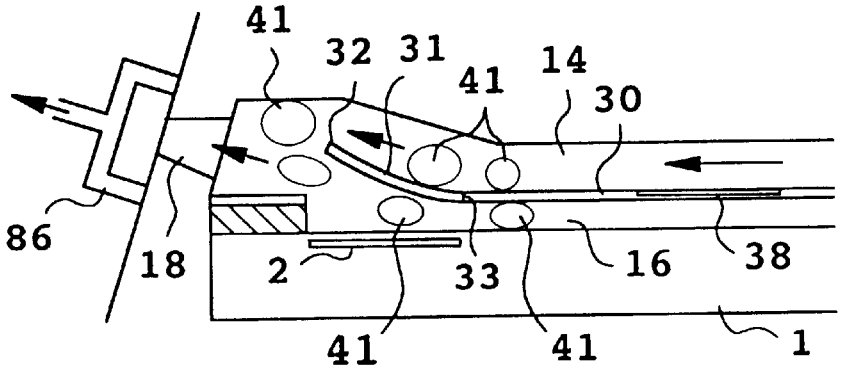

FIGS. 40A to 40C are cross-sectional views of a liquid discharging head constituting still another embodiment of the present invention, wherein components equivalent in function to those in the foregoing embodiments will be represented by same numbers and will not be explained further.

After prolonged standing or by temperature increase in the printing operation, small bubbles 41 are generated in the first and second liquid paths 14, 16 and sticks to the walls of the first and second liquid paths 14, 16 on the heat generating member 2 or in the vicinity of the movable member 31 as shown in FIG. 40A. Therefore, in the present embodiment, the sub heater 38 and the heat generating member 2 are energized at the recovery operation to heat the interior of the first and second liquid paths 14, 16 thereby generating convection flows in the liquids of the first and second liquid paths 14, 16 as shown in FIG. 40B, thus stimulating the peeling of the bubbles 41 from the wall and causing the bubbles 41 to grow. Then a suction recovery operation is conducted by covering the discharge port 18 with a cap member 86 as shown in FIG. 40C to discharge the bubbles 41, present in the first and second liquid paths 14, 16 from the discharge port 18. Such suction recovery operation may be conducted during the energization of the sub heater 38 and the heat generating member 2 or after the energization for a predetermined period. There may also be executed a pressurized recovery operation, or a suction recovery and a pressurized recovery in combination. The energization of the heat generating member 2 for recovery is executed with a pulse shorter than that used for liquid discharge.

In the present embodiment, as the interior of the second liquid path 16 is also heated by the sub heater 38, the liquid convection and the bubble growth in the second liquid path 16 can be accelerated in comparison with the foregoing embodiment. In certain cases, the energization of the heat generating member 2 may be dispensed with and the interiors of the first and second liquid paths 14, 16 may be heated only by the sub heater 38.

Figure 41:
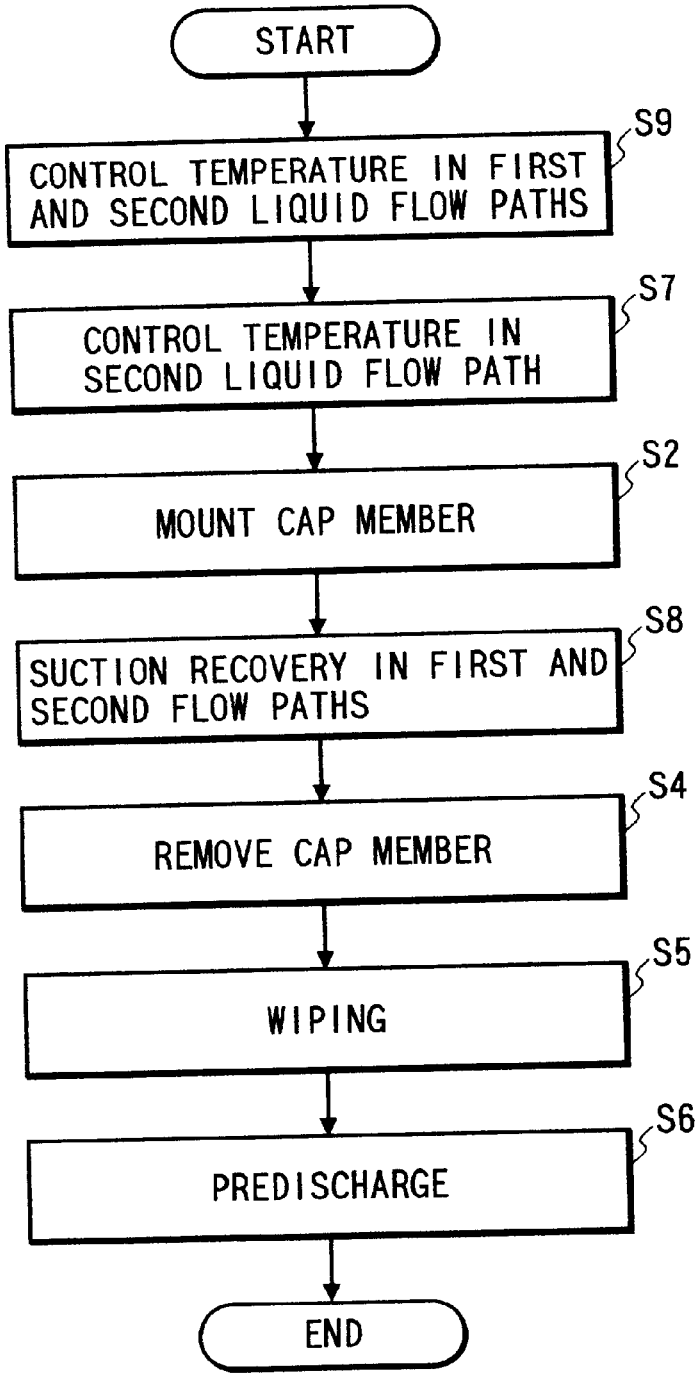
FIG. 41 is a flow chart of a recovery process in the embodiment shown in FIGS. 40A, 40B and 40C.

FIG. 41 shows the process sequence of the present embodiment. At first step S9 energizes the sub heater 38 for temperature adjustment of the interior of the first and second liquid paths 14, 16, then a step S7 energizes the heat generating member 2 for temperature adjustment of the interior of the second liquid path 16, then a step S2 covers the discharge port 18 with the cap member 86, and a step S8 executes the suction recovery of the first and second liquid paths 14, 16. Then a step S4 separates the cap member 86 from the discharge port 18, and further executes suction of the interior of the cap member 86 for discharging the liquid present therein. Then a step S5 wipes the orifice face, and a step S6 executes preliminary liquid discharge according to the necessity. The printing operation is started thereafter.

In the embodiments shown in FIGS. 38A and 38B to 41, at the recovery process of the second liquid path 16 it is also possible to effect liquid discharge at the same time by energizing the heat generating member 2 for liquid discharge, thereby improving the efficiency of recovery of the second liquid path 16.

The recovery process of the present invention has been explained in the foregoing by certain essential embodiments. In the following there will be explained other embodiments that are preferably applicable to the foregoing embodiments. In the following description, the embodiments will be given in the one-liquid path configuration or in the two-liquid path configuration, but they are applicable to both configurations unless specified otherwise. Also the above-mentioned sub heater 38 is omitted in the following embodiments.

[Other Embodiments]

The liquid discharging head and the liquid discharging method of the present invention have been explained in the foregoing by certain essential embodiments. In the following there will be explained other embodiments that are preferably applicable to the foregoing embodiments. In the following description, the embodiments will be given in the one-liquid path configuration or in the two-liquid path configuration, but they are applicable to both configurations unless specified otherwise.

[Ceiling Shape of Liquid Path]

Figure 42:
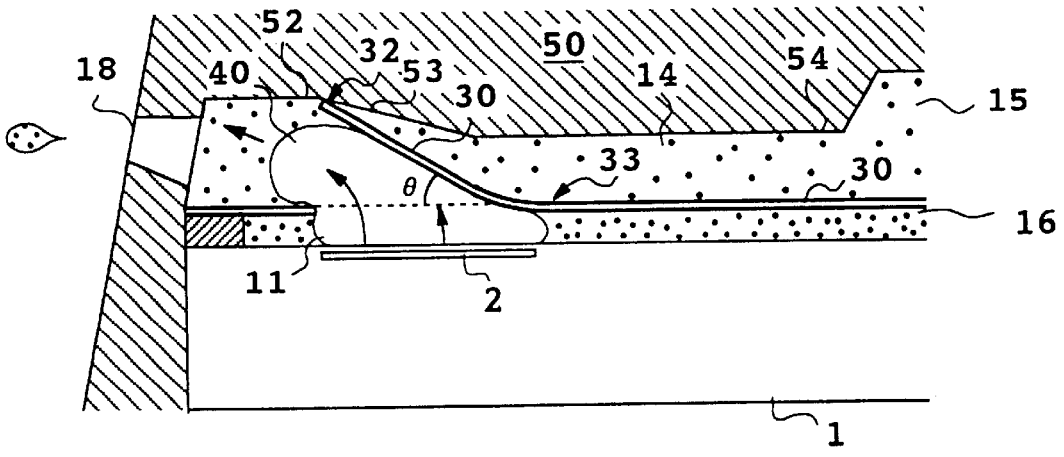
FIG. 42 is a view for explaining the configuration of the movable member and the first liquid path.

FIG. 42 is a cross-sectional view of a liquid discharge head of the present invention along the liquid path, wherein provided, on the partition wall 30, is a grooved member 50 having grooves for constituting the first liquid's liquid path 14. In this embodiment, the ceiling of the liquid path is made higher in the vicinity of the free end 32 of the movable member 31, in order to increase the moving angle θ thereof. The moving range of the movable member 31 is determined in consideration of the structure of the liquid path, the durability of the movable member 31, the bubble generating power etc., but desirably covers a position including the angle of the discharge port 18 in the axial direction.

Also the discharging power can be transmitted in more satisfactory manner by selecting, as shown in FIG. 42, the height of displacement of the free end of the movable member 31 larger than the diameter of the discharge port 18. Furthermore, as shown in FIG. 42, the ceiling of the liquid path is made lower at the fulcrum 33 of the movable member 31 than at the free end 32 thereof, whereby the leak of the pressure wave toward the upstream side can be prevented in more effective manner by the displacement of the movable member 31.

[Positional Relationship of Second Liquid Path and Movable Member]

Figure 43A:
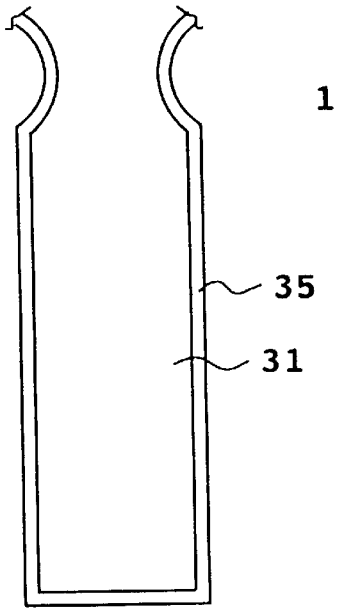
FIGS. 43A, 43B and 43C are views for explaining the structure of the movable member and the liquid path.
Figure 43B:
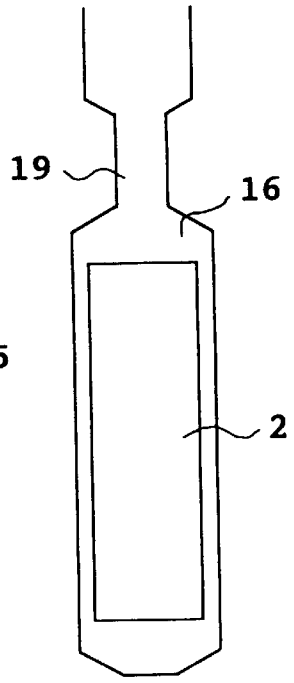
Figure 43C:
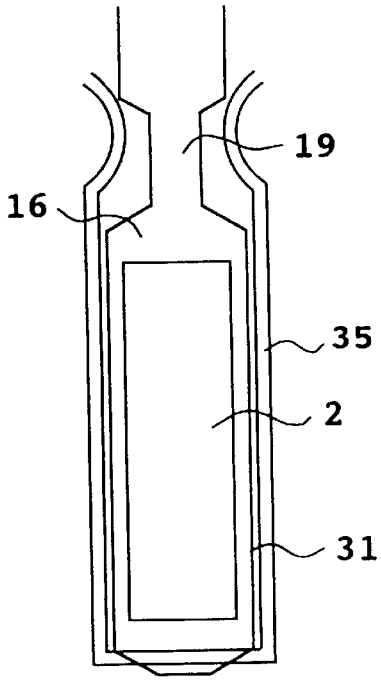

FIGS. 43A to 43C illustrate the positional relationship of the movable member 31 and the second liquid path 16. FIG. 43A is a plan view of the partition wall 30 and the movable member 31 seen from above, while FIG. 43B is a plan view of the second liquid path 16, without the partition wall 30, seen from above, and FIG. 43C is a schematic view of the positional relationship of the movable member 31 and the second liquid path 16, which are illustrated in mutually superposed manner. In these drawings, the lower side is the front side having the discharge port 18.

The second liquid path 16 in the present embodiment has a constricted portion 19 in the upstream side of the heat generating member 2 (the upstream side being defined in the major flow from the second common liquid chamber to the discharge opening 18 through the heat generating member 2, the movable member 31 and the first liquid path), thereby forming a chamber structure (bubble generating chamber) for avoiding easy escape of the pressure of bubble generation to the upstream side of the second liquid path 16.

In case the constricted portion 19 for avoiding the escape of the pressure, generated in the liquid chamber by the heat generating member 2, toward the common liquid chamber is formed in the conventional head in which the bubble generating liquid path is same as the liquid discharging path, the cross section of the liquid path in such constricted portion 19 cannot be made very small in consideration of the liquid refilling.

On the other hand, in the present embodiment, most of the discharged liquid can be the discharge liquid present in the first liquid path and the consumption of the bubble generating liquid in the second liquid path, where the heat generating member is present, can be made small. Consequently the replenishing amount of the bubble generating liquid into the bubble generating area 11 of the second liquid path can be made low. For this reason the gap of the above-mentioned constricted portion 19 can be made as small as several micrometers to less than twenty micrometers, so that the bubble pressure generated in the second liquid path can be further prevented from escaping and concentrated toward the movable member 31. Such pressure can be utilized, by way of the movable member 31, as the discharging power, thereby achieving a higher discharge efficiency and a higher discharging power. The first liquid path 16 is not limited to the above-explained shape but may assume any shape that can effectively transmit the bubble-induced pressure to the movable member 31. The function of the movable member 31 can be made securer by selecting the configuration of the constricted portion 19 and the internal pressure control of the liquid paths 14, 16 in such a manner as explained in the foregoing third embodiment.

As shown in FIG. 43C, the lateral portion of the movable member 31 cover a part of the wall constituting the second liquid path, and such configuration prevents the movable member 31 from dropping into the second liquid path, whereby the aforementioned separation of the discharge liquid and the bubble generating liquid can be further enhanced. It also suppresses the leakage of the bubble through the slit, thereby further increasing the discharge pressure and the discharge efficiency. Furthermore, the aforementioned liquid refilling effect from the upstream side by the pressure at bubble vanishing can be further enhanced.

In FIG. 4 and FIG. 42, a part of the bubble, generated in the bubble generating area of the second liquid path 16, extends in the first liquid path 14 as a result of the displacement of the movable member 31 toward the first liquid path 14, and such a height of the second liquid path as to permit such extension of the bubble allows to further increase the discharge power, in comparison with the case without such extension of the bubble. For realizing such extension of the bubble into the first liquid path 14, the height of the second liquid path 16 is desirably made smaller than the height of the maximum bubble and is preferably selected within a range of several to 30 $\mu$m. In the present embodiment, this height is selected as 15 $\mu$m.

[Movable Member and Partition Wall]

Figure 44A:
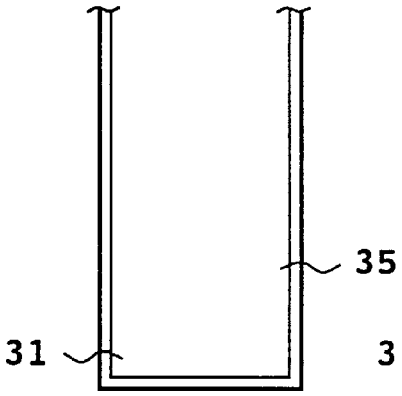
FIGS. 44A, 44B and 44C are views showing other forms of the movable member.
Figure 44B:
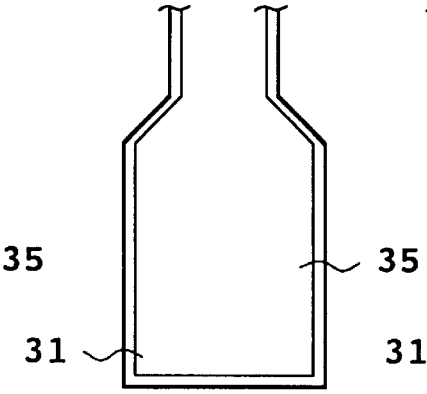
Figure 44C:
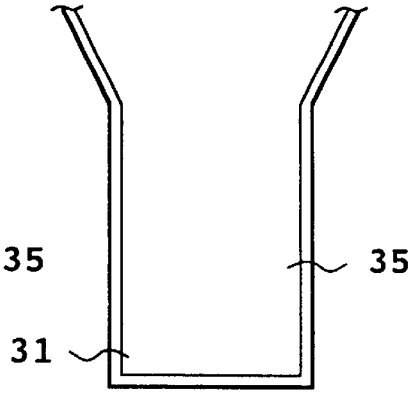

FIGS. 44A to 44C show other shapes of the movable member 31. A slit 35 formed in the partition wall defines the movable member 31. FIG. 44A shows a rectangular shape, while FIG. 44B shows a shape with a narrower fulcrum portion to facilitate displacement of the movable member 31, and FIG. 44C shows a shape with a wider fulcrum portion to increase the durability of the movable member 31. For realizing easy displacement and satisfactory durability, the width of the fulcrum portion is desirably constricted in arc shape as shown in FIG. 43A, but the shape of the movable member 31 may be arbitrarily selected so as not to drop into the second liquid path and as to realize easy displacement and satisfactory durability.

In the foregoing embodiment, the partition wall 5 including the plate-shaped movable member 31 was composed of nickel of a thickness of 5 $\mu$m, but the partition wall 5 and the movable member 31 may be composed of any material that is resistant to the bubble generating liquid and the discharge liquid, has elasticity allowing satisfactory function of the movable member 31 and permits formation of the fine slit 35.

Preferred examples of the material constituting the movable member 31 include a durable metal such as silver, nickel, gold, iron, titanium, aluminum, platinum, tantalum, stainless steel, phosphor bronze or an alloy thereof; nitryl radical-containing resin such as acrylonitrile, butadiene or styrene; amide-radical containing resin such as polyamide; carboxyl-radical containing resin such as polycarbonate; aldehyde-radical containing resin such as polyacetal; sulfone-radical containing resin such as polysulfone; other resins such as liquid crystal polymer or compounds thereof; an ink-resistant metal such as gold, tungsten, tantalum, nickel, stainless steel, titanium or an alloy thereof; a material surfacially coated with such ink-resistant metal or alloy; amide-radical containing resin such as polyamide; aldehyde radical-containing resin such as polyacetal; ketone radical-containing resin such as polyetheretherketone; imide radical-containing radical such as polyimide; hydroxyl radical-containing resin such as polyethylene; alkyl radical-containing resin such as polypropylene; epoxy radical-containing resin such as epoxy resin; amino radical-containing resin such as melamine resin; methylol radical-containing resin such as xylene resin; and ceramics such as silicon dioxide and compounds thereof.

Also preferred examples of the material constituting the partition wall include resin with satisfactory heat resistance, solvent resistance and moldability represented by recent engineering plastics such as polyethylene, polypropylene, polyamide, polyethylene terephthalate, melamine resin, phenolic resin, epoxy resin, polybutadiene, polyurethane, polyetheretherketone, polyethersulfone, polyarylate, polyimide, polysulfone, liquid crystal polymer or compounds thereof; and a metal such as silicon dioxide, silicon nitride, nickel, gold, stainless steel, alloys and compounds thereof; and a material surfacially coated with titanium or gold.

The thickness of the partition wall can be determined in consideration of the material and the shape thereof, so as to attain the required strength and to ensure satisfactory function of the movable member 31, and is preferably selected within a range of 0.5 to 10 μm.

The thickness of the movable member 31 of the present invention is not in the order of centimeter but in the order of micrometer (t μm). For forming such movable member 31 with the sit of a width in the order micrometer (W μm), it is desirable to take certain fluctuation in the manufacture into consideration.

If the thickness of the member opposed to the free end and/or the lateral end of the movable member 31 defining the slit is comparable to that of the movable member 31 (as shown in FIGS. 3, 4, 42 etc.), the mixing of the bubble generating liquid and the discharge liquid can be stably suppressed by selecting the relationship of the slit width and the thickness within the following range, in consideration of the fluctuation in the manufacture. Though this gives a limitation in the designing, a condition $W/t \leqq 1$ enables suppression of mixing of the two liquids over a prolonged period in case of using the bubble generating liquid of a viscosity of 3 cP or less in combination with the highly viscous ink (5 or 10 cP).

A slit in the order of several micrometers can securely realize the "substantially closed state" of the present invention.

When the functions are divided into the bubble generating liquid and the discharge liquid, the movable member 31 practically constitutes a partition member for these liquids. A slight mixing of the bubble generating liquid into the discharge liquid is observed as a result of displacement of the movable member 31 by the growth of the bubble. However, since the discharge liquid which forms the image in the ink jet printing generally contains a coloring material with a concentration of 3–5%, a significant variation in the color density will not result if the bubble generating liquid is contained, within a range up to 20%, in the droplet of the discharge liquid. Consequently, the present invention includes a situation where the bubble generating liquid and the discharge liquid are mixed within such a range that the content of the bubble generating liquid in the discharged droplet does not exceed 20%.

In the above-explained configuration, the mixing ratio of the bubble generating liquid did not exceed 15% even when the viscosity was changed, and, with the bubble generating liquid of a viscosity not exceeding 5 cP, the mixing ratio did not exceed 10% though it is variable depending on the drive frequency.

Such mixing of the liquids can be reduced, for example to 5% or less, by reducing the viscosity of the discharge liquid from 20 cP.

In the following there will be explained the positional relationship of the heat generating member 2 and the movable member 31 in the head, with reference to the attached drawings. However the shape, dimension and number of the movable member 31 and the heat generating member 2 are not limited to those explained in the following. The optimum arrangement of the heat generating member 2 and the movable member 31 allows to effectively utilize the pressure of bubble generated by the heat generating member 2 as the discharging pressure.

Figure 45:
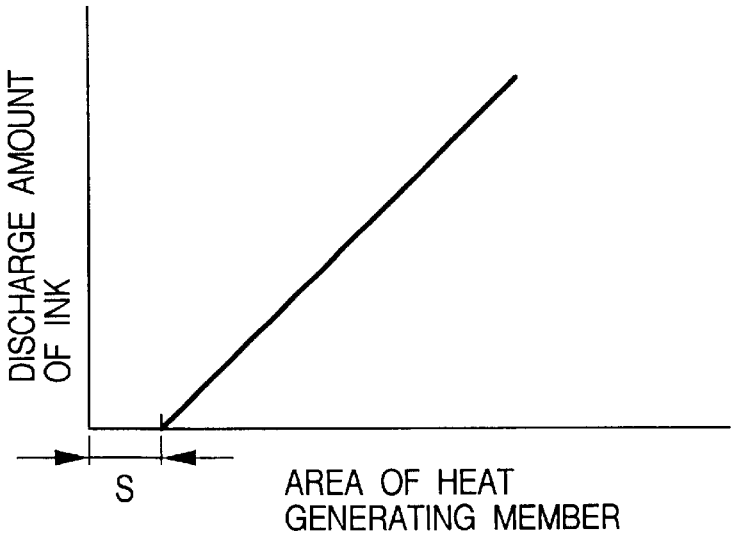
FIG. 45 is a chart showing the relationship between the area of the heat generating member and the ink discharge amount.

In the conventional technology of so-called bubble jet printing which is the ink jet printing for effecting image formation by providing ink with energy such as heat to generate therein a state change involving a steep volume change (bubble generation), discharging the ink from the discharge opening 18 by an action force resulting from such state change and depositing thus discharged ink onto the printing medium, the discharged amount of ink is in proportion to the area of the heat generating member as shown in FIG. 45, but there also exists an ineffective area S which does not contribute to the bubble generation. The state of cogation on the heat generating member 2 indicates that such ineffective area S is present in the peripheral area of the heat generating member 2. Based on these results, it is assumed that a peripheral area, with a width of about 4 μm, of the heat generating member does not contribute to the heat generation.

Consequently, for effective utilization of the pressure of the bubble generation, it is considered effective to position the movable member 31 in such a manner that the movable member 31 covers an area immediately above the effective bubble generating area, which is inside the peripheral area of a width of about 4 μm of the heat generating member. In the present embodiment, the effective bubble generating area is considered as the area inside the peripheral area of a width of about 4 μm of the heat generating member, but such configuration is not restrictive depending on the kind of the heat generating member and the method of formation thereof.

Figure 46A:
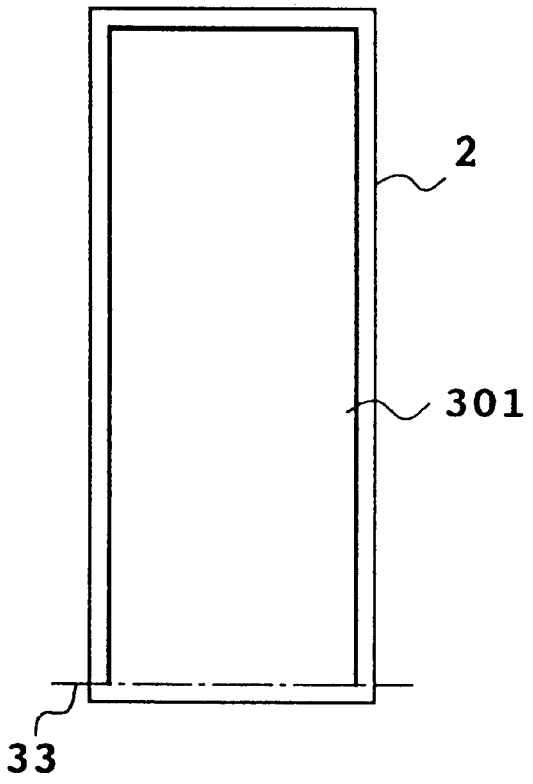
FIGS. 46A and 46B are views showing the positional relationship between the movable member and the heat generating member.
Figure 46B:
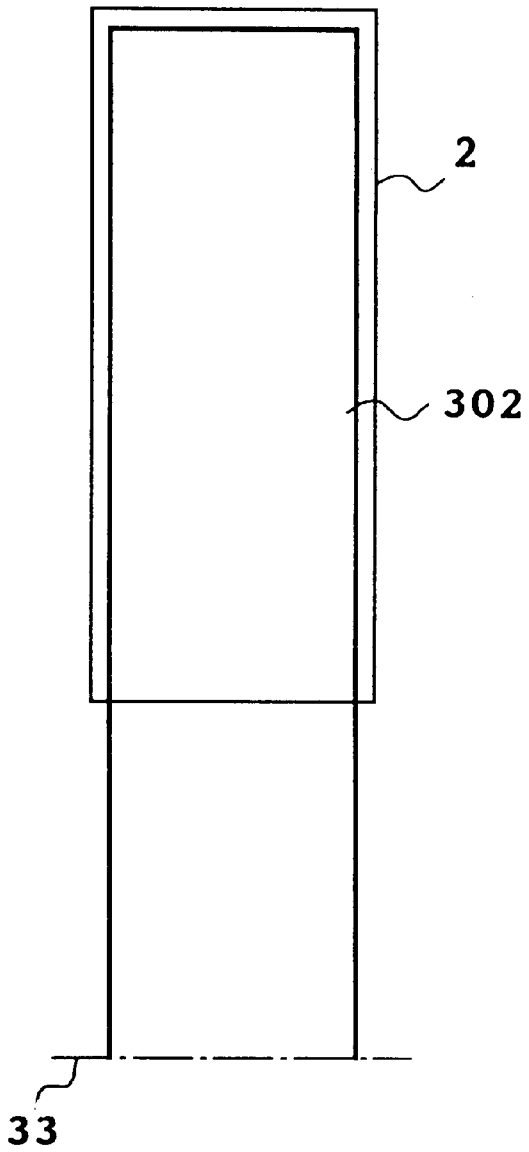

FIGS. 46A and 46B are schematic views, seen from above, of the heat generating member 2 of an area of 58×150 μm, respectively superposed with the movable member 301 (FIG. 46A) and 302 (FIG. 46B) of different movable areas.

The movable member 301 has a dimension of 53×145 μm, which is smaller than the heat generating member 2 but is comparable to the effective bubble generating area of the heat generating member 2, and it is so positioned as to cover such effective bubble generating area. On the other hand, the movable member 302 has a dimension of 53×220 μm, which is larger than the heat generating member 2 (distance from the fulcrum to the movable end being longer than the length of the heat generating member 2, for the same width) and is so positioned as to cover the effective bubble generating area as in the case of the movable member 301. The durability and the discharge efficiency were measured for such movable members 301 and 302, under the following conditions:

bubble generating liquid: 40% aqueous solution of ethanol discharge ink: dye-containing ink voltage: 20.2 V frequency: 3 kHz The measurement under these conditions revealed that (1) the movable member 301 showed a damage in the fulcrum portion after the application of $1\times10^7$ pulses, while (2) the movable member 302 did not show any damage after the application of $3\times10^8$ pulses. It was also confirmed that the energy of motion, determined from the discharged amount and the discharging speed relative to the entered energy, was increased by 1.5 to 2.5 times.

Based on these results, it is preferable, in terms of the durability and the discharge efficiency, to position the movable member in such a manner that it covers an area directly above the effective bubble generating area and that the area of the movable member is larger than that of the heat generating member.

Figure 47:
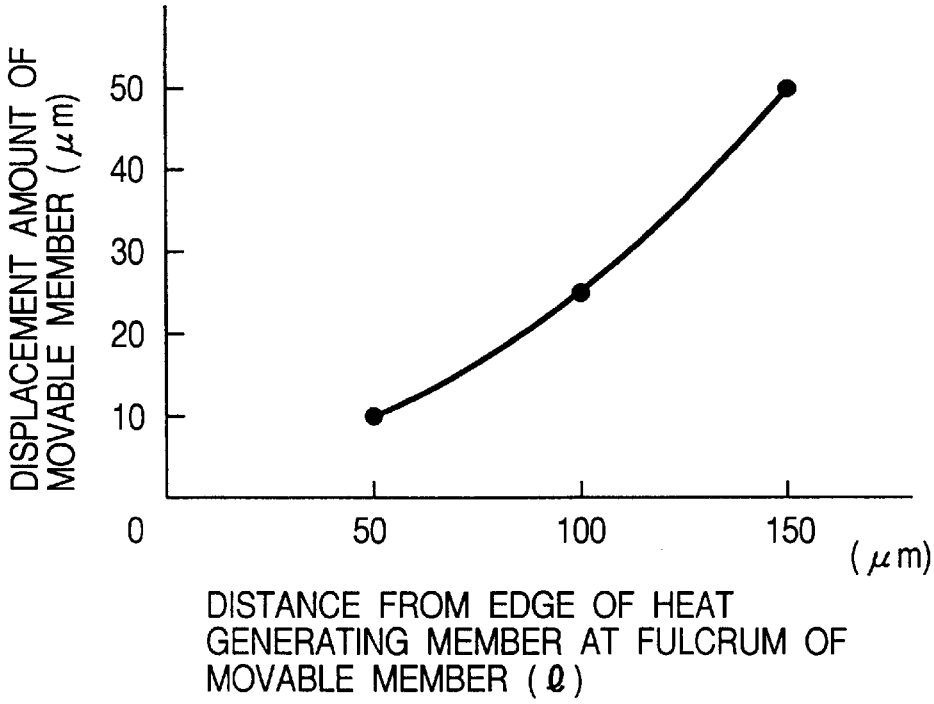
FIG. 47 is a chart showing the relationship between the distance from the edge of the heat generating member to the fulcrum thereof and the amount of displacement of the movable member.
Figure 48:
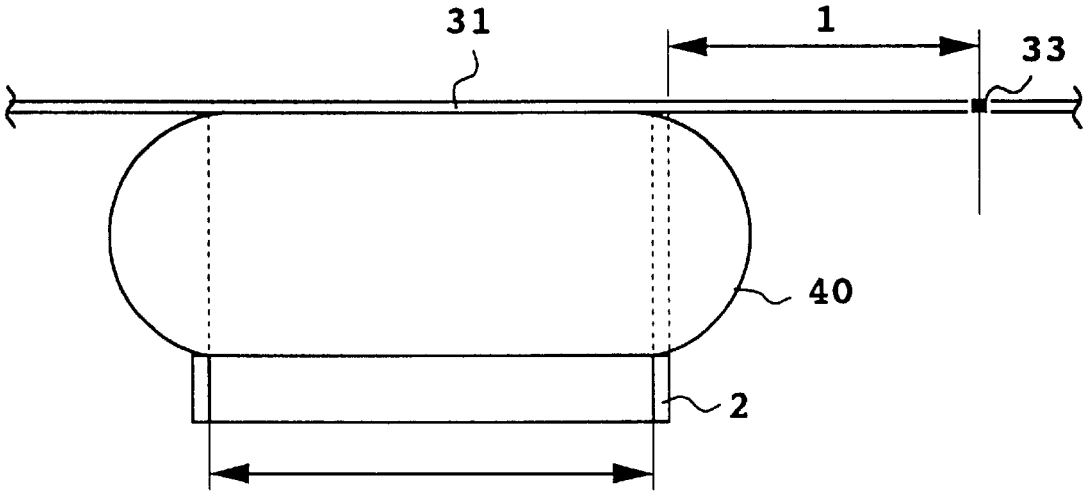
FIG. 48 is a view showing the positional relationship between the heat generating member and the movable member.

FIG. 47 shows the relationship between the distance from the edge of the heat generating member to the fulcrum of the movable member and the amount of displacement thereof. Also FIG. 48 is a lateral cross-sectional view showing the positional relationship of the heat generating member 2 and the movable member 31. The heat generating member 2 had a dimension of 40×105 μm. It will be understood that the amount of displacement increases with the increase in the distance from the edge of the heat generating member 2 to the fulcrum 33 of the movable member 31. It is therefore desirable to determine the optimum amount of displacement and to determine the position of the fulcrum 33 of the movable member 31, according to the desired discharge amount of ink, the structure of the liquid path for the discharge liquid and the shape of the heat generating member.

If the fulcrum 33 of the movable member 31 is positioned directly above the effective bubble generating area of the heat generating member 2, the durability of the movable member 31 becomes deteriorated since the fulcrum 33 directly receives the pressure of bubble generation, in addition to the strain by the displacement of the movable member 31. According to the experiment of the present inventors, the movable member showed deterioration in the durability, generating damage after the application of about $1\times10^6$ pulses, in case the fulcrum 33 was located directly above the effective bubble generating area. Consequently, a movable member 31 of a shape or a material of medium durability may also be employed by positioning the fulcrum thereof outside the area directly above the effective bubble generating area of the heat generating member 2. However, the fulcrum may also be positioned directly above such effective bubble generating area if the shape and the material are suitably selected. In this manner there can be obtained a liquid discharge head which is excellent in the discharge efficiency and in the durability.

[Element Substrate]

In the following there will be explained the configuration of the element substrate, on which provided is the heat generating member 2 for giving heat to the liquid.

Figure 49A:
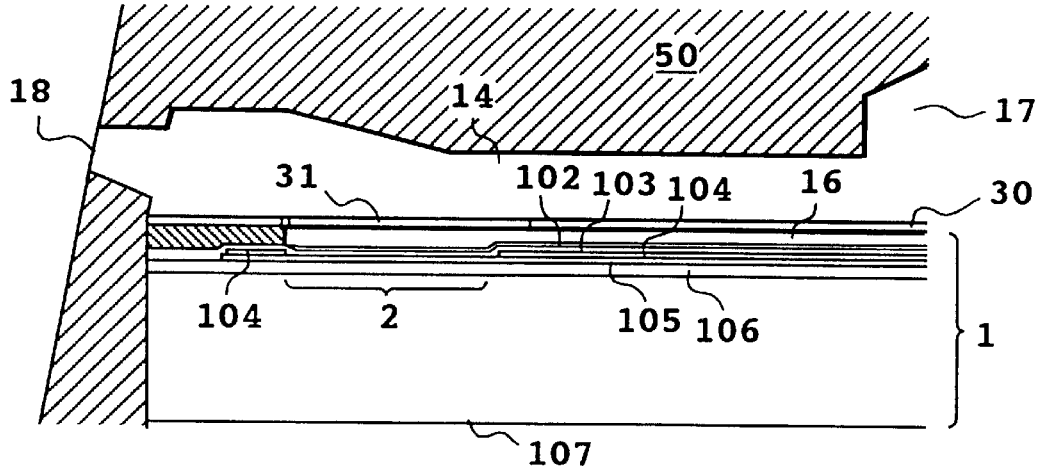
FIGS. 49A and 49B are longitudinal cross-sectional views of a liquid discharging head of the present invention.
Figure 49B:
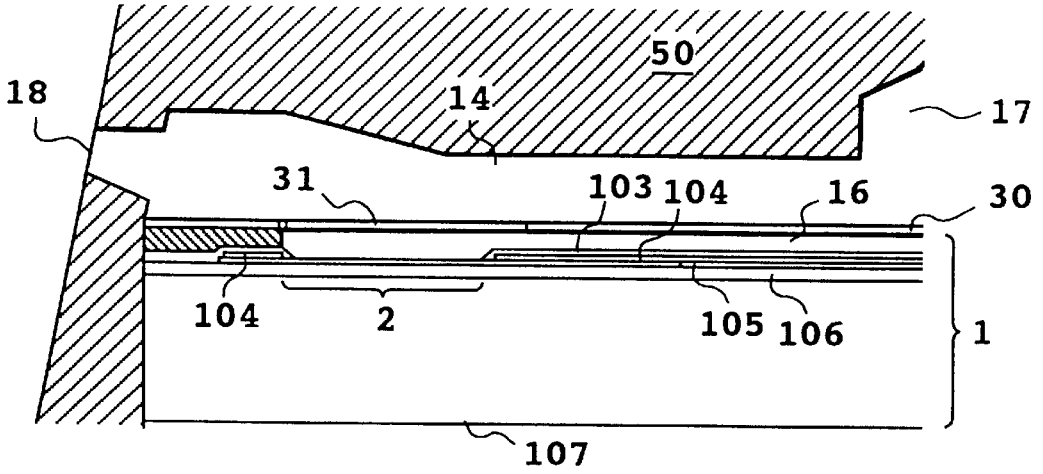

FIGS. 49A and 49B are vertical cross-sectional views of the liquid discharge head of the present invention, respectively with and without a protective film to be explained later.

Above the element substrate 1, there is positioned a grooved member 50 provided with a second liquid path 16, a partition wall 30, a first liquid path 14 and a groove for constituting the liquid path 14.

The element substrate 1 is prepared, on a substrate 107 such as of silicon, by forming a silicon oxide film or a silicon nitride film 106 for insulation and heat accumulation, and thereon patterning, as shown in FIG. 49A, an electric resistance layer 105 (0.01–0.2 $\mu$m thick) composed for example of hafnium boride ($HfB_2$), tantalum nitride (TaN) or tantalum-aluminum (TaAl) and constituting the heat generating member and wiring electrodes 104 (0.2–1.0 $\mu$m thick) composed for example of aluminum. The two wiring electrodes 104 apply a voltage to the electric resistance layer 105, thereby supplying a current thereto and generating heat therein. The electric resistance layer 105 between the wiring electrodes 104 bears thereon a protective layer 103 of a thickness of 0.1–2.0 $\mu$m, composed for example of silicon oxide or silicon nitride, and an anticavitation layer 102 (0.1–0.6 $\mu$m) composed for example of tantalum, for protecting the resistance layer 105 from ink or other liquids.

Since the pressure or the impact wave generated at the generation or vanishing of the bubble is very strong and significantly damages the durability of the hard and fragile oxide film, a metallic material such as tantalum (Ta) is employed as the anticavitation layer.

The above-mentioned protective layer may be dispensed with by the combination of the liquid, the configuration of the liquid paths and the resistance material, as exemplified in FIG. 49B. An example of the material for the resistance layer which does not require the protective layer is iridium-tantalum-aluminum alloy.

The heat generating member in the foregoing embodiments may be composed solely of the resistance layer (heat generating part) provided between the electrodes or may include the protective layer for protecting the resistance layer.

In the present embodiment, the heat generating member has the heat generating part composed of the resistance layer which generates heat in response to the electrical signal, but such configuration is not restrictive and there may be employed any member capable of generating a bubble sufficient for discharging the discharge liquid. For example the heat generating member may have an optothermal converting member which generates heat by receiving light such as from a laser, or a heat generating part which generates heat by receiving a high-frequency signal.

The element substrate 1 may be further provided, in addition to the electrothermal converting member which is composed of the resistance layer 105 constituting the aforementioned heat generating part and the wiring electrodes 104 for supplying the resistance layer 105 with the electrical signal, with functional elements such as transistors, diodes, latches and shift registers which are used for selectively driving the electrothermal converting element, and are integrally prepared by a semiconductor process.

Figure 50:
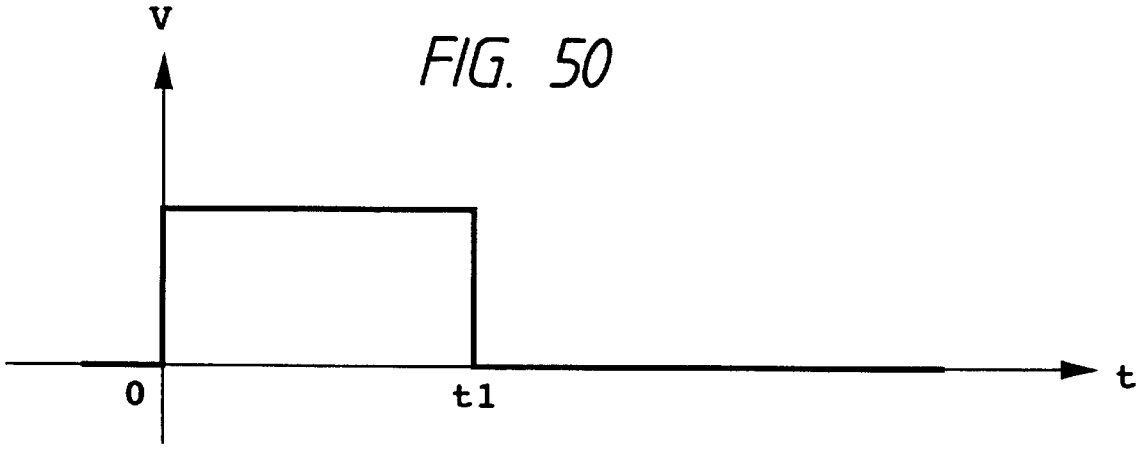
FIG. 50 is a schematic view showing the form of a driving pulse.

For discharging the liquid by driving the heat generating part of the electrothermal converting member provided on such element substrate 1, a rectangular pulse as shown in FIG. 50 is applied to the resistance layer 105 through the wiring electrodes 104 to induce rapid heat generation in the resistance layer 105. In the heads of the foregoing embodiments, an electrical signal of a voltage of 24 V, a pulse duration of 7 $\mu$sec and a current of 150 mA was applied with a frequency of 6 kHz to drive the heat generating member, thereby discharging ink from the discharge opening by the above-explained functions. However the drive signal is not limited to such conditions but may have any conditions that can adequately generate a bubble in the bubble generating liquid.

[Preparation of Liquid Discharge Head]

In the following there will be explained the preparation process of the liquid discharge head explained in the foregoing.

A liquid discharge head as shown in FIG. 27 is prepared by forming the support member 34 for supporting the movable member 31 on the element substrate 1 by patterning for example a dry film, then fixing the movable member 31 to the support member 34 by adhesion or fusion, and adhering the grooved member which bears plural grooves constituting the liquid paths 10, the discharge ports and the recess constituting the common liquid chamber 15, to the element substrate 1 in such a manner that the grooves respectively correspond to the movable members 31.

Figure 54:
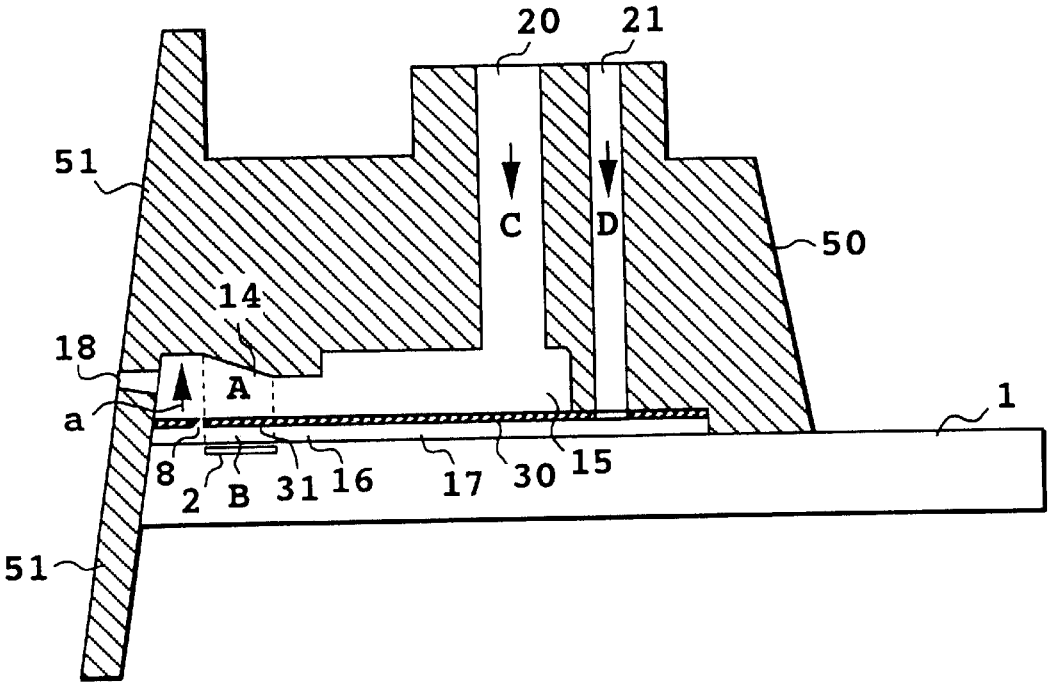
FIG. 54 is a cross-sectional view showing a supply path in the liquid discharging head of the present invention.

In the following there will be explained the preparation process of the liquid discharge head of the two-path configuration, as shown in FIGS. 1 and 54.

In brief, the head is prepared by forming the walls of the second liquid paths 16 on the element substrate 1, then mounting the partition wall 30 thereon and mounting thereon the grooved member 50 which bears the grooves constituting the first liquid paths 14 etc. Otherwise it is prepared, after the formation of the walls of the second liquid paths 16, by adhering thereon the grooved member 50 already combined with the partition wall 30.

In the following there will be given a detailed explanation on the method of preparation of the second liquid paths.

FIGS. 51A to 51E are schematic cross-sectional views showing an example of the preparation method of the liquid discharge head explained in the foregoing.

Figure 51A:
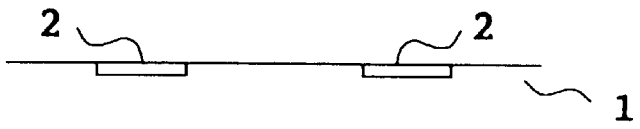
FIGS. 51A, 51B, 51C, 51D, 51E, 52A, 52B, 52C, 52D, 53A, 53B, 53C and 53D are views showing process steps for explaining a manufacturing process of the liquid discharging head of the present invention.

In this example, on the element substrate (silicon wafer) 1, there were prepared electrothermal converting elements including the heat generating members 2 for example of hafnium boride or tantalum nitride as shown in FIG. 51A, with a manufacturing apparatus similar to that employed in the semiconductor device manufacture, and the surface of the element substrate 1 was rinsed for the purpose of improving adhesion with the photosensitive resin in a next step. Further improvement in the adhesion was achieved by surface modification of the element substrate 1 with ultraviolet light ozone treatment, followed by spin coating of liquid obtained by diluting a silane coupling agent (A189 supplied by Nippon Unicar Co.) to 1 wt. % with ethyl alcohol.

Figure 51B:
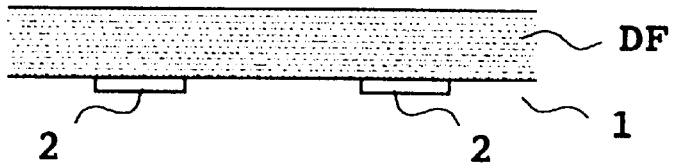

After surface rinsing, an ultraviolet-sensitive resin film DF (dry film Ordil SY-318 supplied by Tokyo Oka Co.) was laminated on the substrate 1 with thus improved adhesion, as shown in FIG. 51B.

Figure 51C:
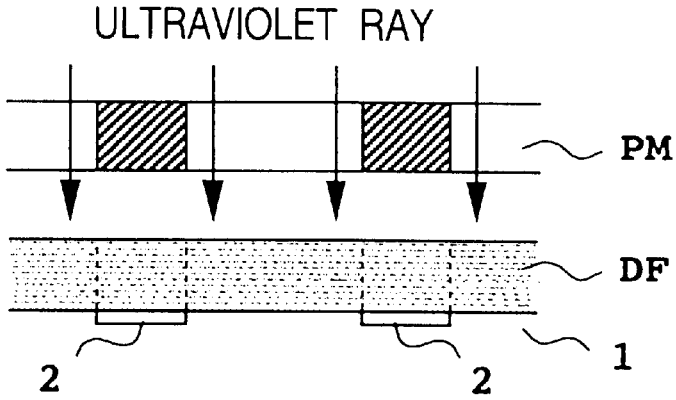

Then, as shown in FIG. 51C, a photomask PM was placed on the dry film DF, and the portions to be left as the walls of the second liquid paths were exposed to the ultraviolet light through the photomask PM. The exposure step was conducted with an exposure apparatus MPA-600, supplied to Canon Co., with an exposure amount of about 600 mJ/cm$^2$.

Figure 51D:
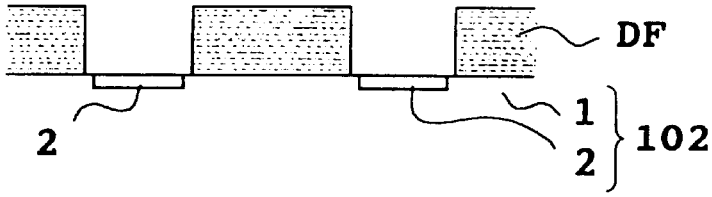
Figure 51E:
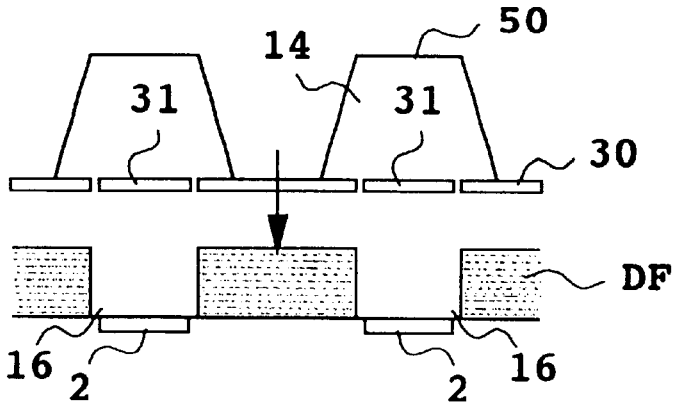

Then, as shown in FIG. 51D, the dry film DF was developed with developer (BMRC-3 supplied by Tokyo Oka Co.) consisting of a mixture of xylene and butylcellosolve acetate to dissolve the unexposed portions, whereby the exposed and hardened portions were left as the walls of the second liquid paths 16. The residue remaining on the element substrate 1 was removed by a treatment for ca. 90 seconds in an oxygen plasma ashing apparatus (MAS-800 supplied by Alcantec Co.). Subsequently ultraviolet light irradiation was conducted for 2 hours at 150° C. with an intensity of 100 mJ/cm$^2$ to completely harden the exposed portions.

The above-explained method allowed to uniformly prepare the second liquid paths in precise manner, on the plural heater boards (element substrates) to be divided from the silicon wafer. The silicon substrate was cut and separated, by a dicing machine with a diamond blade of a thickness of 0.05 mm, into respective heater boards 1. The separated heater board was fixed on the aluminum base plate 70 with an adhesive material (SE4400 supplied by Toray Co.) (cf. FIG. 59). Then the heater board 1 was connected with the printed wiring board 71, adhered in advance to the aluminum base plate 70, with aluminum wires (not shown) of a diameter of 0.05 mm.

Then, on thus obtained heated board 1, the adhered member of the grooved member 50 and the partition wall 30 was aligned and adhered by the above-mentioned method. More specifically, after the grooved member having the partition wall 30 and the heater board 1 were aligned and fixed with the spring 78, the ink/bubble generating liquid supply member 80 was fixed by adhesion on the aluminum base plate 70, and the gaps among the aluminum wires and among the grooved member 50, the heater board 1 and the ink/bubble generating liquid supply member 80 were sealed with a silicone sealant (TSE399 supplied by Toshiba Silicone Co.).

The preparation of the second liquid paths by the above-mentioned method allowed to obtain liquid paths of satisfactory precision, without positional aberration with respect to the heaters of each heater board 1. In particular the adhesion in advance of the grooved member 50 and the partition wall 30 allows to improve the positional precision between the first liquid paths 14 and the movable members 31.

Such high-precision manufacturing method stabilized the liquid discharge and improves the print quality. Also collective manufacture on the wafer enables the manufacture in a large amount, with a low cost.

In the present example, the second liquid paths were prepared with the ultraviolet-hardenable dry film, but they can also be prepared by laminating and hardening a resin having the absorption band in the ultraviolet region, particularly in the vicinity of 248 nm, and directly eliminating the resin in the portions constituting the second liquid paths with an excimer laser.

FIGS. 52A to 52D are schematic cross-sectional views showing a second example of the preparation method of the liquid discharge head explained in the foregoing.

Figure 52A:
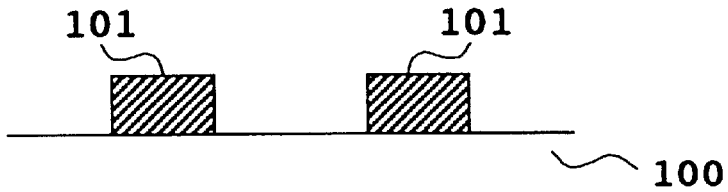

In this example, as shown in FIG. 52A, a photoresist 101 of a thickness of 15 $\mu$m was patterned in the form the second liquid paths on a stainless steel substrate 100.

Figure 52B:
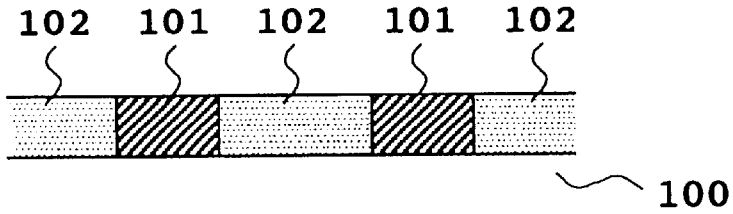

Then, as shown in FIG. 52B, the substrate 100 was subjected to electroplating to grow a nickel layer 102 with a thickness of 15 $\mu$m. The plating bath contained nickel sulfamate, a stress reducing agent (Zero-all supplied by World Metal Co.), an antipitting agent (NP-APS supplied by World Metal Co.) and nickel chloride. The electroplating was conducted by mounting an electrode at the anode side, mounting the patterned substrate 100 at the cathode side, and using the plating bath of 50° C. and a current density of 5 A/cm$^2$.

Figure 52C:
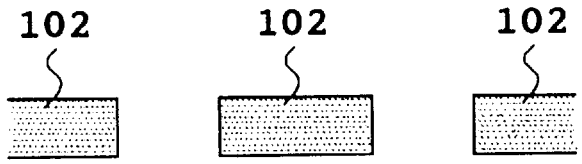

Then, as shown in FIG. 52C, the substrate 100 after the electroplating step was subjected to ultrasonic vibration, whereby the nickel layer 102 was peeled from the substrate 100 in the portions of the second liquid paths.

Figure 52D:
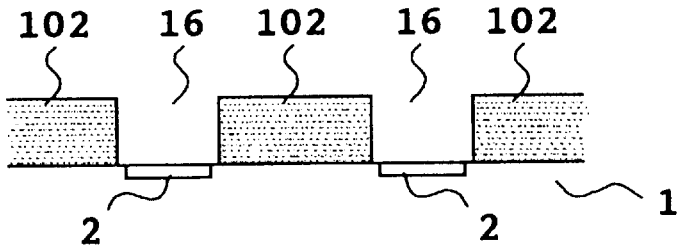

On the other hand, the heater boards bearing the electrothermal converting elements were prepared on a silicon wafer, with a manufacturing apparatus similar to that used in the semiconductor device manufacture, and the wafer was separated into the respective heater boards with the dicing machine, as in the foregoing example. The heater board 1 was adhered to the aluminum base plate 70 on which the printed wiring board was adhered in advance, and the electrical connections were made with the printed wiring board by the aluminum wires (not shown). On the heater board in such state, the nickel layer 102 bearing the second liquid paths prepared in the foregoing step was aligned and fixed, as shown in FIG. 52D. This fixing only needs to be of a level not causing positional displacement at the adhesion of the cover plate, since the cover plate and the partition wall are fixed by the spring in a subsequent step, as in the foregoing first example.

In this example, the alignment and fixing mentioned above were achieved by coating an ultraviolet-settable adhesive material (Amicon UV-300 supplied by Grade Japan Co.), followed by ultraviolet irradiation of 100 mJ/cm$^2$ for about 3 seconds in an ultraviolet irradiating apparatus.

The method of this example can provide a highly reliable head resistant to alkaline liquids, since the liquid path walls are made of nickel, in addition to the preparation of the highly precise second liquid paths without positional aberration relative to the heat generating members 2.

FIGS. 53A to 53D are schematic cross-sectional views showing another example of the preparation method of the liquid discharge head explained in the foregoing.

Figure 53A:
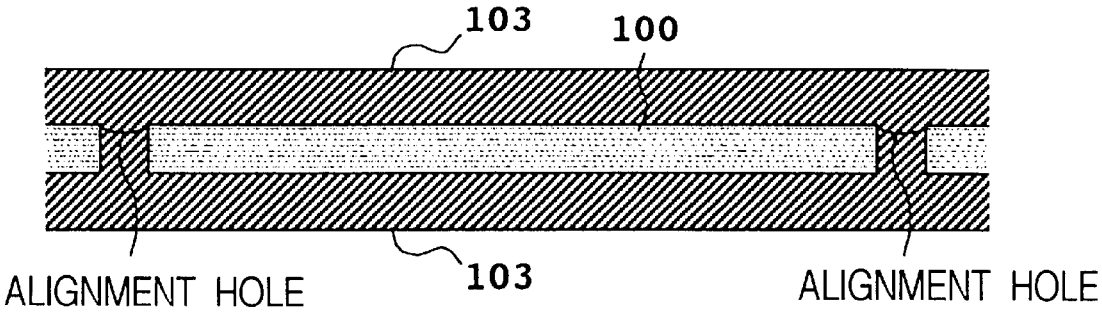

In this example, photoresist 1030 (PMERP-AR900 supplied by Tokyo Oka Co.) was coated on both faces of a stainless steel substrate 100 of a thickness of 15 μm, having an alignment hole or a mark 100*a*, as shown in FIG. 53A.

Figure 53B:
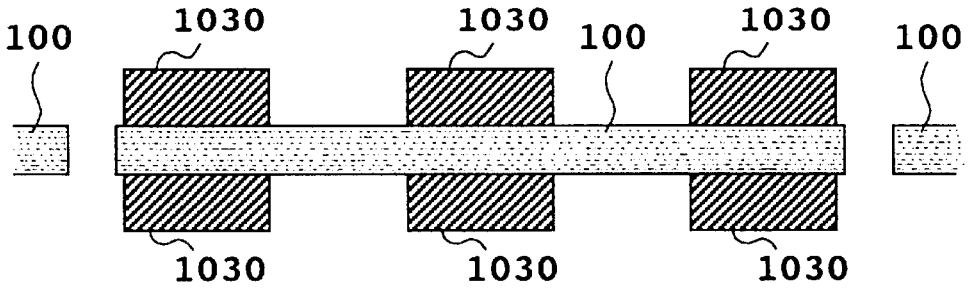

Then, as shown in FIG. 53B, exposure was made with an exposing apparatus (MPA-600 supplied by Canon K.K.), utilizing the alignment hole 100*a* of the substrate 100, with an exposure amount of 800 mJ/cm$^2$, to remove the resist 1030 in the portions where the second liquid paths are to be formed.

Figure 53C:
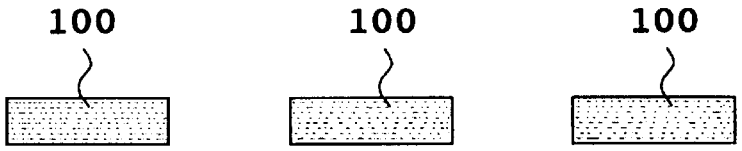

Then, as shown in FIG. 53C, the substrate 100 with the patterned resists on both faces was immersed in an etching bath (aqueous solution of ferric chloride or cupric chloride) to etch off the portions exposed from the resist, and then the resist was stripped off.

Figure 53D:
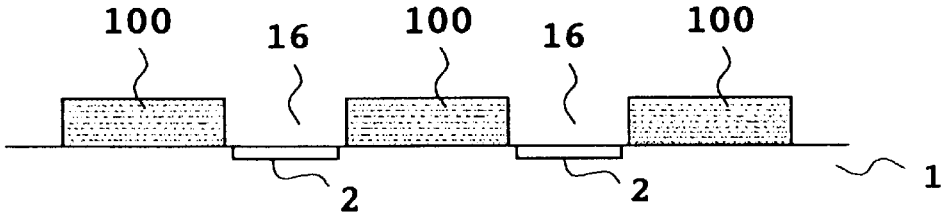

Then, as shown in FIG. 53D, the substrate 100 subjected to the etching step was aligned and fixed on the heater board 1 in the same manner as in the foregoing examples to obtain the liquid discharge head having the second liquid paths 16.

The method of the present example can form the second liquid paths 16 in highly precise manner without positional aberration with respect to the heat generating members, and can provide a highly reliable liquid discharge head resistant to acidic and alkaline liquids, since the liquid paths are formed with stainless steel.

As explained in the foregoing, the method of the present example enables highly precise alignment of the electrothermal converting member and the second liquid path, by forming the walls thereof in advance on the element substrate 100. Also the liquid discharge heads can be prepared in a large number, with a low cost, since the second liquid paths can be simultaneously prepared on a plurality of the element substrates prior to the cutting of the wafer.

Also the liquid discharge head prepared by the preparation method of the present example can efficiently receive the pressure of the bubble, generated by heat generation of the electrothermal converting member, thereby providing an excellent discharge efficiency, since the heat generating member and the second liquid path are aligned with a high precision.

[Head Structure With Two-Liquid Path Configuration]

In the following there will be explained an example of the structure of the liquid discharging head which allows introduction of different liquids into the first and second common liquid chambers with satisfactory separation, and also allows a reduction in the number of components and in the cost.

FIG. 54 is a schematic view showing the structure of such liquid discharging head, wherein components equivalent to those in the foregoing embodiments are represented by same numbers and will not be explained further.

In this embodiment, the grooved member 50 is principally composed of an orifice plate 51 having discharge port 18, plural grooves constituting the plural first liquid paths 14, and a recess constituting a first common liquid chamber 15 which commonly communicates with the plural first liquid paths 14 for the supply of the discharge liquid thereto.

The plural first liquid paths 14 can be formed by adhering a partition wall 30 to the lower face of the grooved member 50. The grooved member 50 is provided with a first liquid supply path 20 reaching the first common liquid chamber 15 from above, and a second liquid supply path 21 reaching the second common liquid chamber 17 from above, penetrating through the partition wall 30.

The first liquid (discharge liquid) is supplied, as indicated by an arrow C in FIG. 54, through the first liquid supply path 20 to the first common liquid chamber 15 and then to the first liquid paths 14, while the second liquid (bubble generating liquid) is supplied, as indicated by an arrow D in FIG. 54, through the second liquid supply path 21 to the second common liquid chamber 17 and then to the second liquid paths 16.

In this embodiment, the second liquid supply path 21 is positioned parallel to the first liquid supply path 20, but such positioning is not limitative and it may be formed in any manner as long as it communicates with the second common liquid chamber 17, penetrating through the partition wall 30 provided outside the first common liquid chamber 15.

The thickness (diameter) of the second liquid supply path 21 is determined in consideration of the supply amount of the second liquid. The second liquid supply path 21 need not have a circular cross section but can have a rectangular cross section or the like.

Figure 55:
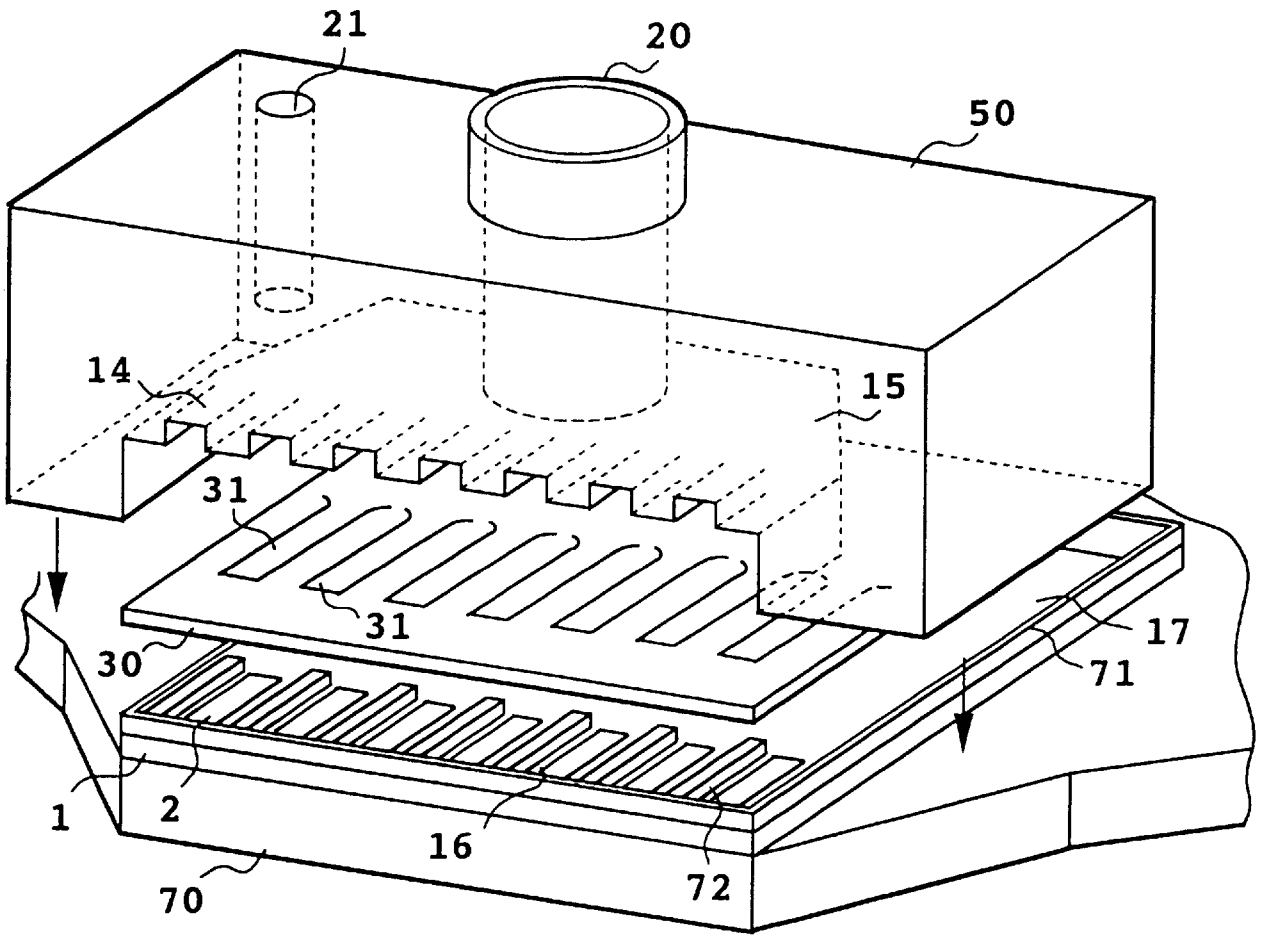
FIG. 55 is an exploded perspective view of the head of the present invention.

The second common liquid chamber 17 can be formed by parting the grooved member 50 with the partition wall 30. The second common liquid chamber 17 and the second liquid paths 16 may be formed, as shown in an exploded perspective view in FIG. 55, by forming the frame of the common liquid chamber and the walls of the second liquid paths by a dry film on the element substrate, and adhering such element substrate with a combined body of the grooved member 50 and the partition wall 30.

In the present embodiment, the element substrate 1 provided with a plurality of electrothermal converting elements, constituting the heat generating members for generating heat for generating the bubble in the bubble generating liquid by film boiling, is provided on a support member 70 composed of a metal such as aluminum.

On the element substrate 1, there is provided with plural grooves constituting the liquid paths 16 defined by the walls of the second liquid paths, a recess constituting the second common liquid chamber 17 for supplying the bubble generating liquid paths with the bubble generating liquid, and a partition wall 30 provided with the aforementioned movable members 31.

A grooved member 50 is provided with grooves constituting the discharge liquid paths (first liquid paths) 14 upon adhesion with the partition wall 30, a recess constituting the first common liquid chamber 15 communicating with the discharge liquid paths and serving to supply such paths with the discharge liquid, a first liquid supply path 20 for supplying the first common liquid chamber with the discharge liquid, and a second liquid supply path 21 for supplying the second common liquid chamber with the bubble generating liquid. The second supply path 21 penetrates through the partition wall 30 positioned outside the first common liquid chamber 15 and is connected to the second common liquid chamber 17, whereby the bubble generating liquid can be supplied thereto without mixing with the discharge liquid.

The element substrate 1, the partition wall 30 and the grooved plate 50 are so mutually positioned that the movable members 31 are aligned corresponding to the heat generating members of the element substrate 1 and that the discharge liquid paths 14 are aligned to such movable members 31. The present embodiment has a second supply path in the grooved member, but there may be provided plural second supply paths according to the supply amount. Also the cross sectional areas of the discharge liquid supply path 20 and the bubble generating liquid supply path 21 may be determined in proportion to the supply amounts.

Components constituting the grooved member 50 may be made compacter by the optimization of such cross sectional areas of the supply paths.

The present embodiment explained above allows to reduce the number of components and to reduce the manufacturing process and the cost, since the second supply path for supplying the second liquid paths with the second liquid and the first supply path for supplying the first liquid paths with the first liquid are formed with a single grooved member.

Also since the supply of the second liquid to the second common liquid chamber communicating with the second liquid paths is achieved by the second liquid supply path which penetrates through the partition wall for separating the first liquid and the second liquid, the adhesion of the partition wall, the grooved member and the element substrate can be achieved in a single step, whereby the manufacturing process can be facilitated and the precision of adhesion can be improved to achieve satisfactory liquid discharge.

The second liquid, being supplied to the second common liquid chamber penetrating through the partition wall, can be securely supplied to the second liquid paths with a sufficient supply amount, whereby the liquid discharge can be achieved in stable manner.

In the following there will be explained the positional relationship of the heat generating member and the movable member in this head, with reference to the attached drawings. However, the shape, dimension and number of the movable member and the heat generating members are not limited to those explained in the following. The optimum arrangement of the heat generating member and the movable member allows to effectively utilize the pressure of bubble generation by the heat generating member as the discharge pressure.

In the following there will be given an explanation on the movable member provided with the heat generating member.

The movable member of the present invention has heat insulating property to the area of displacement, and the configuration will be explained with reference to the attached drawings.

Figure 56A:
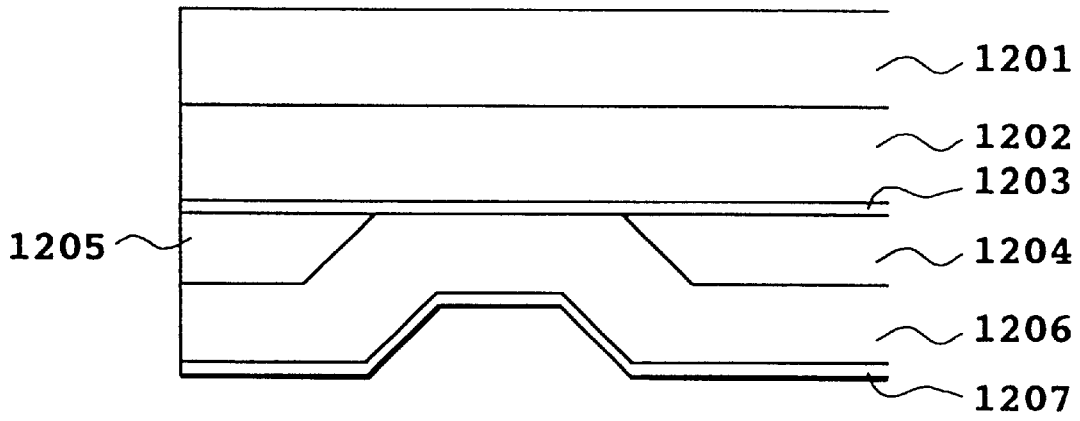
FIG. 56A is a cross-sectional view showing the configuration of a part of the movable member 31, 831 bearing the heat generating member.
Figure 56B:
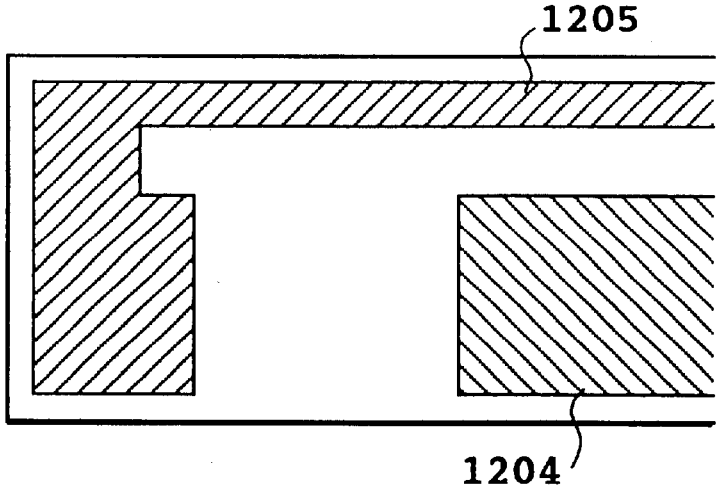
FIG. 56B is a plan view showing the arrangement of electrodes 1204, 1205 shown in FIG. 56A.

FIG. 56A is a cross-sectional view showing the configuration of a part of the movable member 31, 831 bearing the heat generating member. On a substrate 1201 there are formed a heat insulation layer 1202 and an electrical resistance layer 1203. On the heat generating member 1203 there are partially formed electrodes 1204, 1205 and a protective layer 1206, and an anticavitation layer 1207 is formed thereon. FIG. 56B is a plan view showing the arrangement of the electrodes 1204, 1205 in FIG. 56A. In the following there will be explained the materials constituting these layers.

The movable member is provided, on the substrate 1201 for example of silicon, with a silicon oxide film or a silicon nitride film for insulation and heat accumulation, and also with a heat insulation layer 1202 composed of the material of the movable member or the partition wall mentioned above. The heat insulation layer 1202 suppresses the heat conduction to the movable member, and can improve the heat transmission to the heat generating member and the energy efficiency of bubble generation by an increased heat insulation achieved for example by an increased thickness. Particularly in case the movable member is composed of a material of high thermal conductivity such as metal or is formed extremely thin even with a material low thermal conductivity such as resin, the function of the heat insulation layer 1202 becomes important as the heat tends to escape to the opposite side. In case the heat insulation layer 1202 and the protective layer 1207 are formed with a same material or with materials similar in the thermal conductivity, the heat insulation layer 1202 is preferably formed thicker than the protective layer 1207. If these layers are formed with a same thickness, the heat insulation layer 1202 is preferably formed with a material of lower thermal conductivity. Namely the heat transmission should be suppressed at the side of the heat insulation layer 1202, in consideration of the thermal conductivity and the thickness.

On the heat insulation layer 1202, there are patterned the resistance layer 1203 (0.01–0.2 $\mu$m thick) constituting the heat generating member and composed of hafnium boride ($HfB_2$), tantalum nitride (TaN) or tantalum-aluminum (TaAl) and the wiring electrodes 1204, 1205 (0.2–1.0 $\mu$m thick) composed for example of aluminum, as shown in FIG. 56B. The wiring electrodes 1204, 1205 apply a voltage to the resistance layer 1203 to induce a current therein, thus generating heat. On the resistance layer 1203 between the electrodes 1204, 1205, a protective layer 1206 of silicon oxide or silicon nitride is formed with a thickness of 0.1–2.0 $\mu$m, and an anticavitation layer 1207 (0.1–0.6 $\mu$m thick) for example of tantalum is formed thereon to protect the resistance layer 1203 from various liquids such as ink.

Since the pressure and the impact wave generated at the generation or vanishing of the bubble is very strong and significantly deteriorates the durability of the hard and fragile oxide film, a metallic material such as tantalum is employed as the anticavitation layer. The heat generating member explained as the resistance layer 1203 and the second heat generating member formed on the element substrate may be composed solely of a resistance material.

[Head Structure With Two-Liquid Path Configuration]

In the following there will be explained an example of the structure of the liquid discharging head which allows introduction of different liquids into the first and second common liquid chambers with satisfactory separation, and also allows a reduction in the number of components and in the cost.

Figure 57:
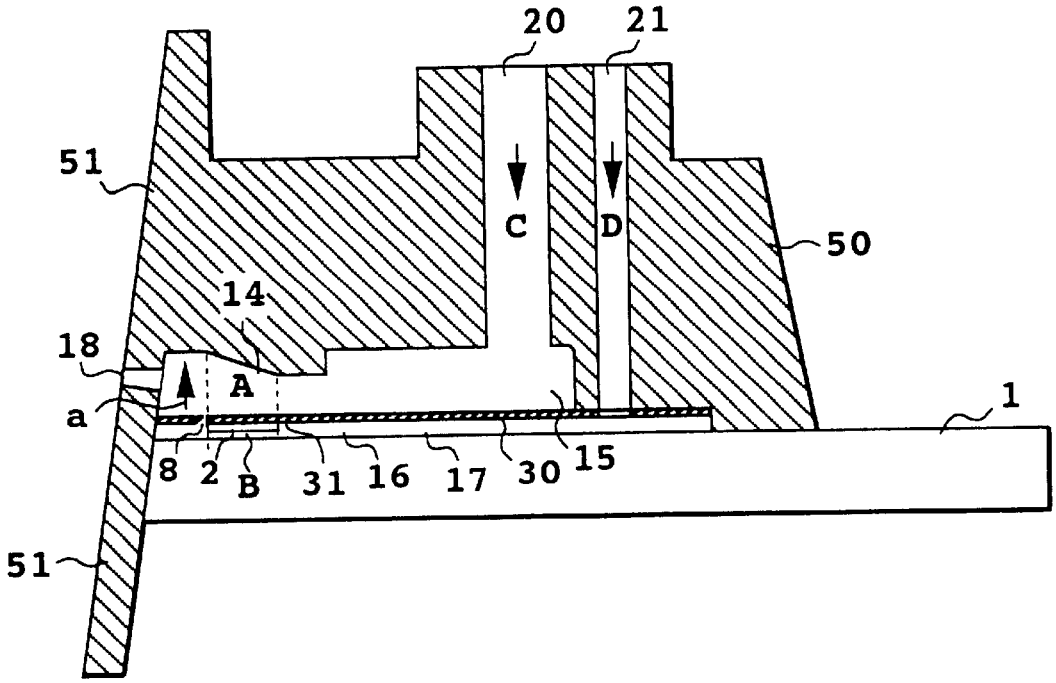
FIG. 57 is a cross-sectional view showing a supply path in the liquid discharging head of the present invention.

FIG. 57 is a schematic view showing the structure of such liquid discharging head of an edge shooter type as in the eighth and ninth embodiments shown in FIGS. 26A to 26D and 27 to 30, wherein components equivalent to those in the eight and ninth embodiments are represented by same numbers and will not be explained further.

In this embodiment, the grooved member 50 is principally composed of an orifice plate 51 having discharge port 18, plural grooves constituting the plural first liquid paths 14, and a recess constituting a first common liquid chamber 15 which commonly communicates with the plural first liquid paths 14 for the supply of the discharge liquid thereto.

The plural first liquid paths 14 can be formed by adhering a partition wall 30 to the lower face of the grooved member 50. The grooved member 50 is provided with a first liquid supply path 20 reaching the first common liquid chamber 15 from above, and a second liquid supply path 21 reaching the second common liquid chamber 17 from above, penetrating through the partition wall 30.

The first liquid (discharge liquid) is supplied, as indicated by an arrow C in FIG. 54, through the first liquid supply path 20 to the first common liquid chamber 15 and then to the first liquid paths 14, while the second liquid (bubble generating liquid) is supplied, as indicated by an arrow D in FIG. 54, through the second liquid supply path 21 to the second common liquid chamber 17 and then to the second liquid paths 16.

In this embodiment, the second liquid supply path 21 is positioned parallel to the first liquid supply path 20, but such positioning is not limitative and it may be formed in any manner as long as it communicates with the second common liquid chamber 17, penetrating through the partition wall 30 provided outside the first common liquid chamber 15.

The thickness (diameter) of the second liquid supply path 21 is determined in consideration of the supply amount of the second liquid. The second liquid supply path 21 need not have a circular cross section but can have a rectangular cross section or the like.

The second common liquid chamber 17 can be formed by parting the grooved member 50 with the partition wall 30.

Figure 58:
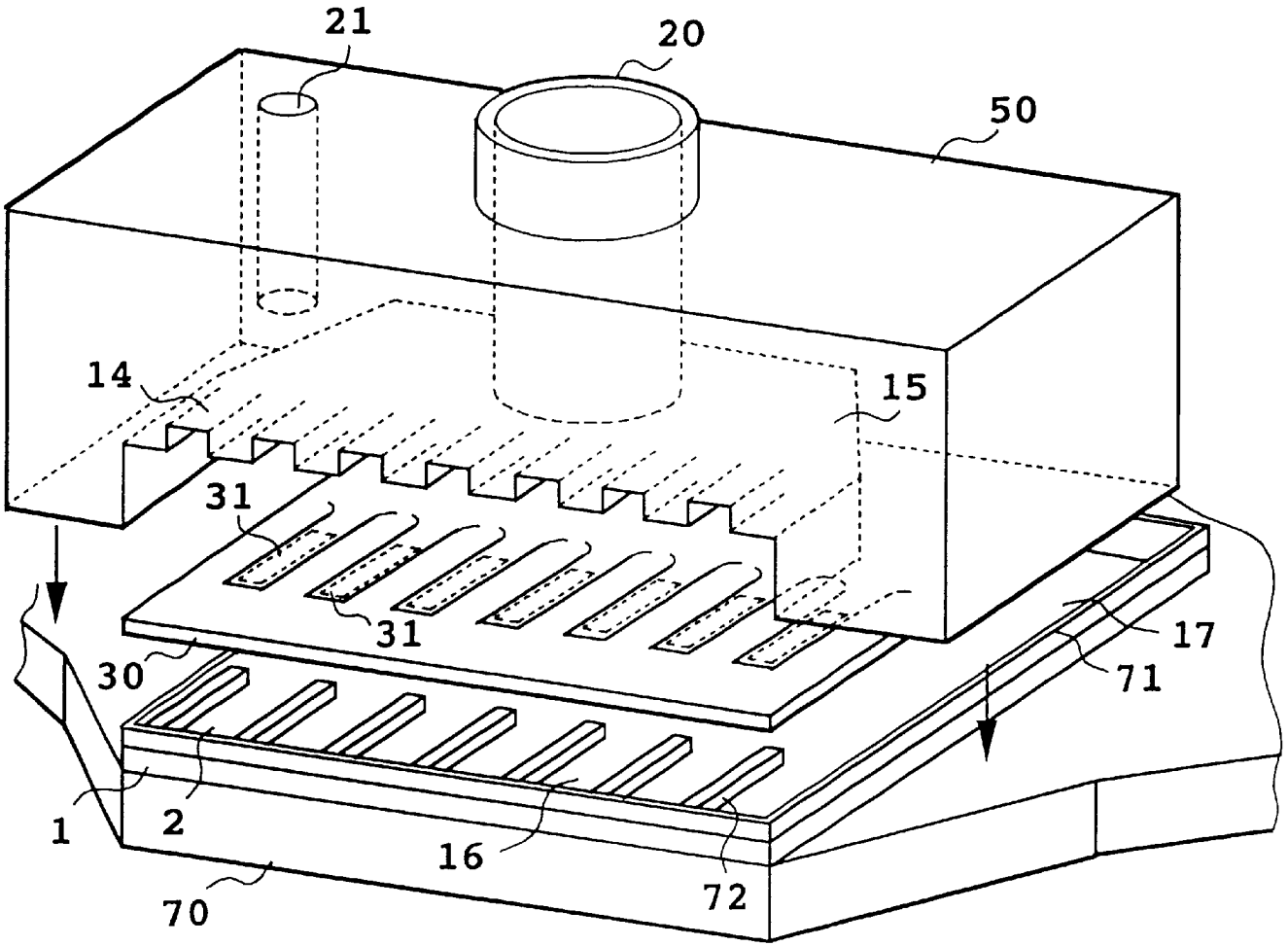
FIG. 58 is an exploded perspective view of the head of the present invention.

The second common liquid chamber 17 and the second liquid paths 16 may be formed, as shown in an exploded perspective view in FIG. 58, by forming the frame of the common liquid chamber and the walls of the second liquid paths by a dry film on the element substrate, and adhering such element substrate with a combined body of the grooved member 50 and the partition wall 30.

In the present embodiment, the element substrate 1 is provided on a support member composed of a metal such as aluminum. On the element substrate 1, there are provided with plural grooves constituting the liquid paths 16 defined by the walls of the second liquid paths, a recess constituting the second common liquid chamber 17 communicating with the plural bubble generating liquid paths and serving to supply the bubble generating liquid paths with the bubble generating liquid, and the partition wall 30 provided with the movable members 31 bearing the aforementioned heat generating members 2.

A grooved member 50 is provided with grooves constituting the discharge liquid paths (first liquid paths) 14 upon adhesion with the partition wall 30, a recess constituting the first common liquid chamber 15 communicating with the discharge liquid paths and serving to supply such paths with the discharge liquid, a first liquid supply path 20 for supplying the first common liquid chamber with the discharge liquid, and a second liquid supply path 21 for supplying the second common liquid chamber with the bubble generating liquid. The second supply path 21 penetrates through the partition wall 30 positioned outside the first common liquid chamber 15 and is connected to the second common liquid chamber 17, whereby the bubble generating liquid can be supplied thereto without mixing with the discharge liquid.

The element substrate 1, the partition wall 30 and the grooved plate 50 are so mutually positioned that the movable members 31 are aligned corresponding to the heat generating members of the element substrate 1 and that the discharge liquid paths 14 are aligned to such movable members 31. The present embodiment has a second supply path in the grooved member, but there may be provided plural second supply paths according to the supply amount. Also the cross sectional areas of the discharge liquid supply path 20 and the bubble generating liquid supply path 21 may be determined in proportion to the supply amounts.

Components constituting the grooved member 50 may be made compacter by the optimization of such cross sectional areas of the supply paths.

The present embodiment explained above allows to reduce the number of components and to reduce the manufacturing process and the cost, since the second supply path for supplying the second liquid paths with the second liquid and the first supply path for supplying the first liquid paths with the first liquid are formed with a single grooved member.

Also since the supply of the second liquid to the second common liquid chamber communicating with the second liquid paths is achieved by the second liquid supply path which penetrates through the partition wall for separating the first liquid and the second liquid, the adhesion of the partition wall, the grooved member and the element substrate can be achieved in a single step, whereby the manufacturing process can be facilitated and the precision of adhesion can be improved to achieve satisfactory liquid discharge.

The second liquid, being supplied to the second common liquid chamber penetrating through the partition wall, can be securely supplied to the second liquid paths with a sufficient supply amount, whereby the liquid discharge can be achieved in stable manner.

[Discharge Liquid, Bubble Generating Liquid]

As explained in the foregoing embodiments, the present invention, employing a configuration with the movable members and utilizing the control of the relative internal pressures of the liquid paths, allows to discharge the liquid with a higher discharge power, a higher discharge efficiency and a higher discharge speed, in comparison with the conventional liquid discharge head. Among such embodiments, if the bubble generating liquid and the discharge liquid are same, there can be employed liquid of various kinds as long as it is not deteriorated by the heat from the heat generating member, it hardly generates deposit on the heat generating member upon heating, it is capable of reversible state change of gasification and condensation by heat and it does not deteriorate the liquid path, the movable member and the partition wall.

Among such liquids, the ink of the composition employed in the conventional bubble jet printing apparatus may be employed as the liquid for printing.

On the other hand, in case the discharge liquid and the bubble generating liquid are mace mutually different in the head of the present invention with the two-path configuration, the bubble generating liquid can have the properties as explained in the foregoing and can be composed, for example, methanol, ethanol, n-propanol, isopropanol, n-hexane, n-heptane, n-octane, toluene, xylene, methylene dichloride, trichlene, fleon TF, fleon BF, ethylether dioxane, cyclohexane, methyl acetate, ethyl acetate, acetone, methylethylketone, water or a mixture thereof.

As the discharge liquid there can be employed various liquids irrespective of the bubble generating property or the thermal properties, and there can even be employed a liquid with low bubble generating property, a liquid easily denatured or deteriorated by heat or a liquid of a high viscosity, which cannot be easily discharged in the conventional art.

However the discharge liquid is preferably not to hinder the discharge, bubble generation or the function of the movable member 31 by a reaction of the discharge liquid itself or with the bubble generating liquid.

The discharge liquid for printing can for example be ink of high viscosity. Also a pharmaceutical liquid or perfume susceptible to heat may be employed as the discharge liquid.

In the present invention, the printing operation was conducted with the inks of following compositions as the printing liquid that could be used for both the discharge liquid and the bubble generating liquid. There could be obtained a very satisfactory printed image because of the improved accuracy of landing of the droplet, as the ink discharge speed was made higher by the increased discharge power.

| Composition of dye ink (viscosity 2 cP) | |
|---|---|
| dye (C.I. food black 2) | 3 wt. % |
| diethylene glycol | 10 wt. % |
| thiodiglycol | 5 wt. % |
| ethanol | 5 wt. % |
| water | 77 wt. % |

The printing operation was also conducted with combinations of the following liquids. Satisfactory discharge could be achieved not only with a liquid of a viscosity higher than 10 cP but also with a liquid of a very high viscosity of 150 cP, which could not be discharged in the conventional head, thereby providing prints of high image quality.

| | |
|---|---|
| Composition of bubble generating liquid 1 | |
| ethanol | 40 wt. % |
| water | 60 wt. % |
| Composition of bubble generating liquid 2 | |
| water | 100 wt. % |
| Composition of bubble generating liquid 3 | |
| isopropyl alcohol | 10 wt. % |
| water | 90 wt. % |
| Composition of discharge liquid 1 (pigment ink of ca. 15 cP) | |
| carbon black | 5 wt. % |
| styrene-acrylic acid-ethyl acrylate copolymer (acid value 140, weight-averaged molecular weight 8000) | 1 wt. % |
| monoethanolamine | 0.25 wt. % |
| glycerine | 69 wt. % |
| thiodiglycol | 5 wt. % |
| ethanol | 3 wt. % |
| water | 16.75 wt. % |
| Composition of discharge liquid 2 (55 cP) | |
| polyethyleneglycol 200 | 100 wt. % |
| Composition of discharge liquid 32 (150 cP) | |
| polyethyleneglycol 600 | 100 wt. % |

In case of the aforementioned liquid that is considered difficult to discharge in the conventional head, the low discharge speed increases the fluctuation in the directionality of discharge, resulting in an inferior precision of the dot landing on the recording paper. Also the discharge amount fluctuates because of the unstable discharge. The high-quality image has been difficult to obtain because of these factors. However, in the head configuration of the foregoing examples, the bubble generation can be conducted sufficiently and stably by the use of the bubble generating liquid mentioned above. As a result, there can be achieved improvements in the precision of droplet landing and in the stability of ink discharge amount, whereby the quality of the printed image can be significantly improved.

[Liquid Discharging Head Cartridge]

In the following there will schematically be explained a liquid discharging head cartridge, employing the liquid discharging head explained in the foregoing.

Figure 59:
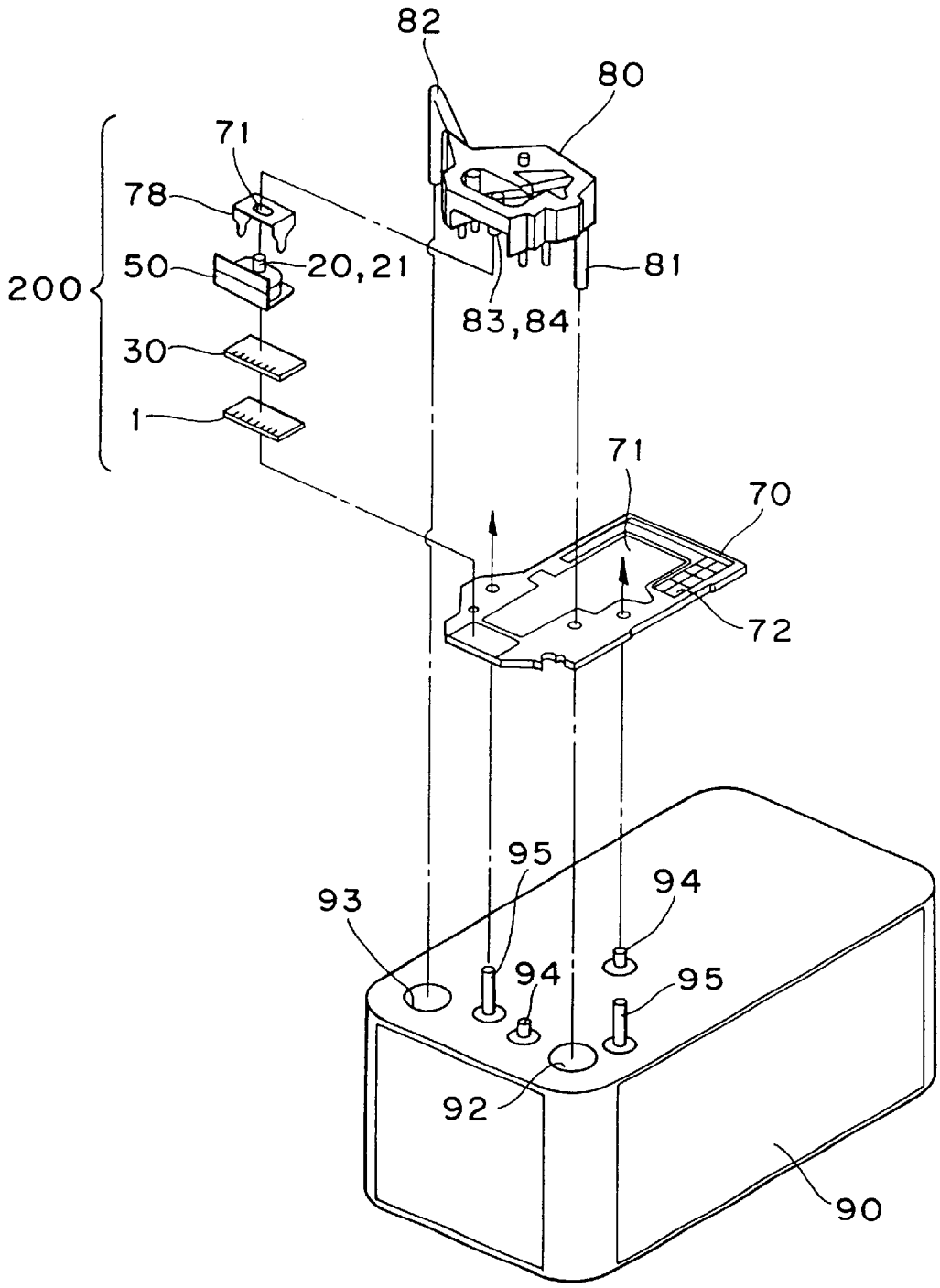
FIG. 59 is an exploded perspective view of a liquid discharging head cartridge.

FIG. 59 is an exploded perspective view of a liquid discharging head cartridge, including the liquid discharging head and principally composed of a liquid discharge head unit 200 and a liquid container 80.

The liquid discharge head unit 200 is composed of an element substrate 1, a partition wall 30, a grooved member 50, a press spring 78, a liquid supply member 90, a support member 70 etc. The element substrate 1 is provided with an array of a plurality of the heat generating resistance members for supplying the bubble generating liquid with heat, and a plurality of functional elements for selectively driving the heat generating resistance members. The bubble generating liquid paths are formed between the element substrate 1 and the aforementioned partition wall 30 bearing the movable members. The unrepresented discharge liquid paths, in which the discharge liquid flows, are formed by the adhesion of the partition wall 30 and the grooved cover plate 50.

The press spring 78 exerts a biasing force on the grooved member 50 toward the element substrate 1, and such biasing force satisfactorily maintains the element substrate 1, the partition wall 30, the grooved member 50 and a support member 70 to be explained later in integral manner.

The support member 70, for supporting the element substrate 1, further supports a circuit board 71 connected with the element substrate 1 for electric signal supply thereto and a contact pad 72 to be connected with a main apparatus for signal exchange therewith.

The liquid container 90 contains therein, in divided manner, the discharge liquid such as ink and the bubble generating liquid for bubble generation, to be supplied to the liquid discharging head. On the outside of the liquid container 90, there are formed positioning unit 94 for positioning a connection member for connecting the liquid container 90 with the liquid discharging head, and fixing shafts 95 for fixing the connection member. The discharge liquid is supplied from a discharge liquid supply path 92 of the liquid container 90, through a supply path 84 of the connection member, to a discharge liquid supply path 81 of a liquid supply member 90, and further to the first common liquid chamber through discharge liquid supply paths 83, 71, 21 of various members. The bubble generating liquid is similarly supplied from a supply path 93 of the liquid container, through a supply path of the connection member, to a bubble generating liquid supply path 82 of the liquid supply member 80, and further to the second common liquid chamber through bubble generating supply paths 84, 71, 22.

The liquid discharging head cartridge explained above has a supply form and a liquid container capable of liquid supply even in case the bubble generating liquid is different from the discharge liquid, but, if they are mutually same, the supply form and the liquid container need not be divided between the bubble generating liquid and the discharge liquid.

The liquid container 90 may be refilled after the used of the respective liquids, and may be provided with liquid inlets for this purpose. Also the liquid discharging head may be integrated with the liquid container 90 or may be made detachable therefrom.

[Liquid Discharging Apparatus]

Figure 60:
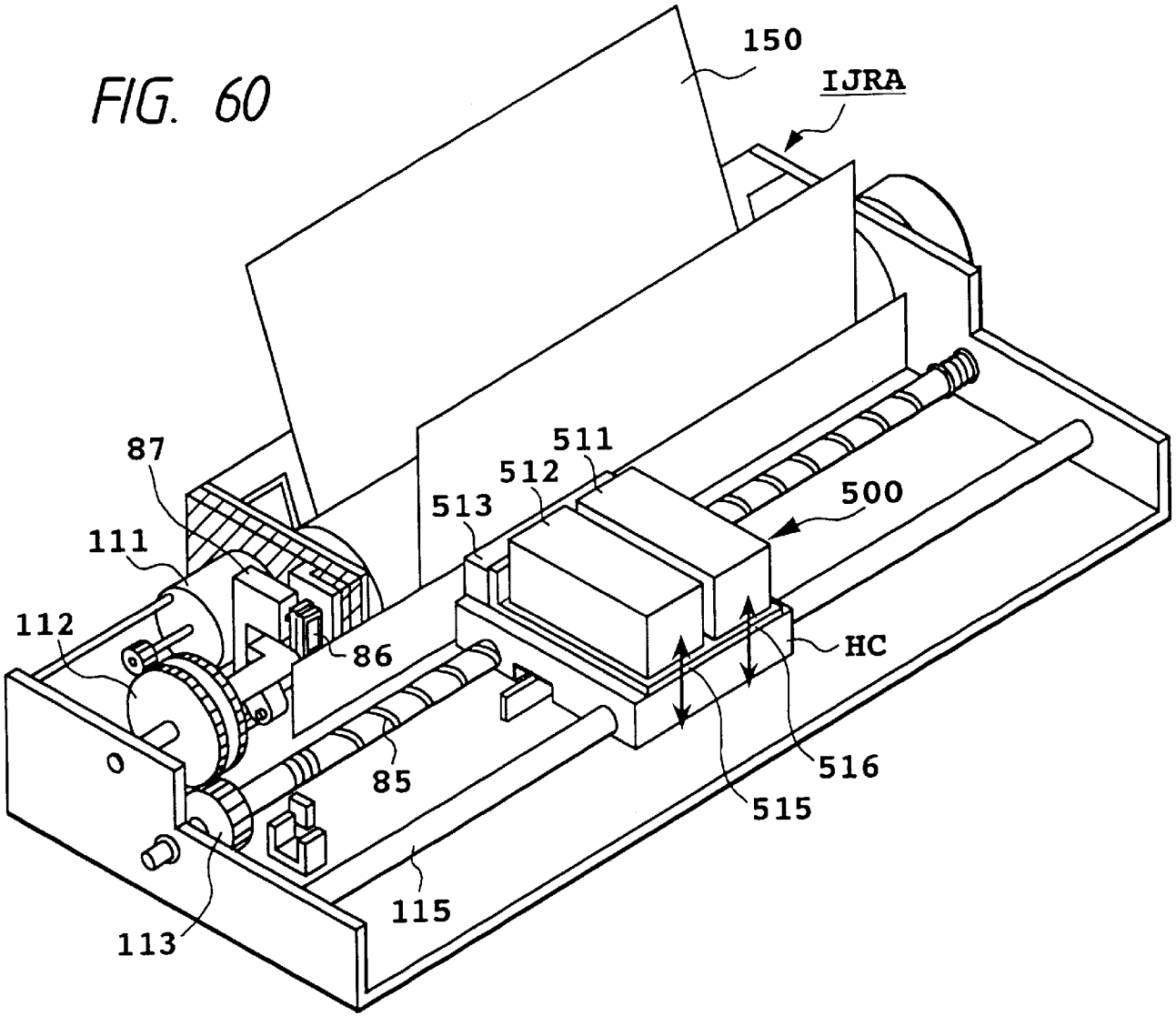
FIG. 60 is a perspective view of a liquid discharging apparatus.

FIG. 60 schematically shows the configuration of a liquid discharging apparatus in which the liquid discharging head is loaded. In the present embodiment, there will be particularly explained an ink discharging print apparatus utilizing ink as the discharge liquid. A carriage HC can perform reciprocating motion along a lead screw 85, and supports a liquid discharging head 513 explained in the foregoing and internal pressure control means 500, and executes reciprocating motion in the transversal direction of a printing medium, such as printing paper, transported by print medium transport means.

When drive signals are supplied from the unrepresented signal supply means to the liquid discharging means on the carriage, the liquid discharging head in response discharges the print liquid onto the print medium. In FIG. 60 there are also shown a cap member 86 for capping the front face of the liquid discharging head, and suction means 87 for sucking the interior of the cap member. The liquid discharging head is subjected to a suction recovery process by these means, thus being prevented from the nozzle clogging etc.

The liquid discharging apparatus for the present embodiment is further provided with a motor 111 for driving the print medium transport means and the carriage, gears 112, 113 and a carriage shaft 115 for transmitting the power of the motor to the carriage. Satisfactory prints could be obtained by discharging liquid onto various print media by means of this printing apparatus and the liquid discharging method conducted on this apparatus.

Figure 61:
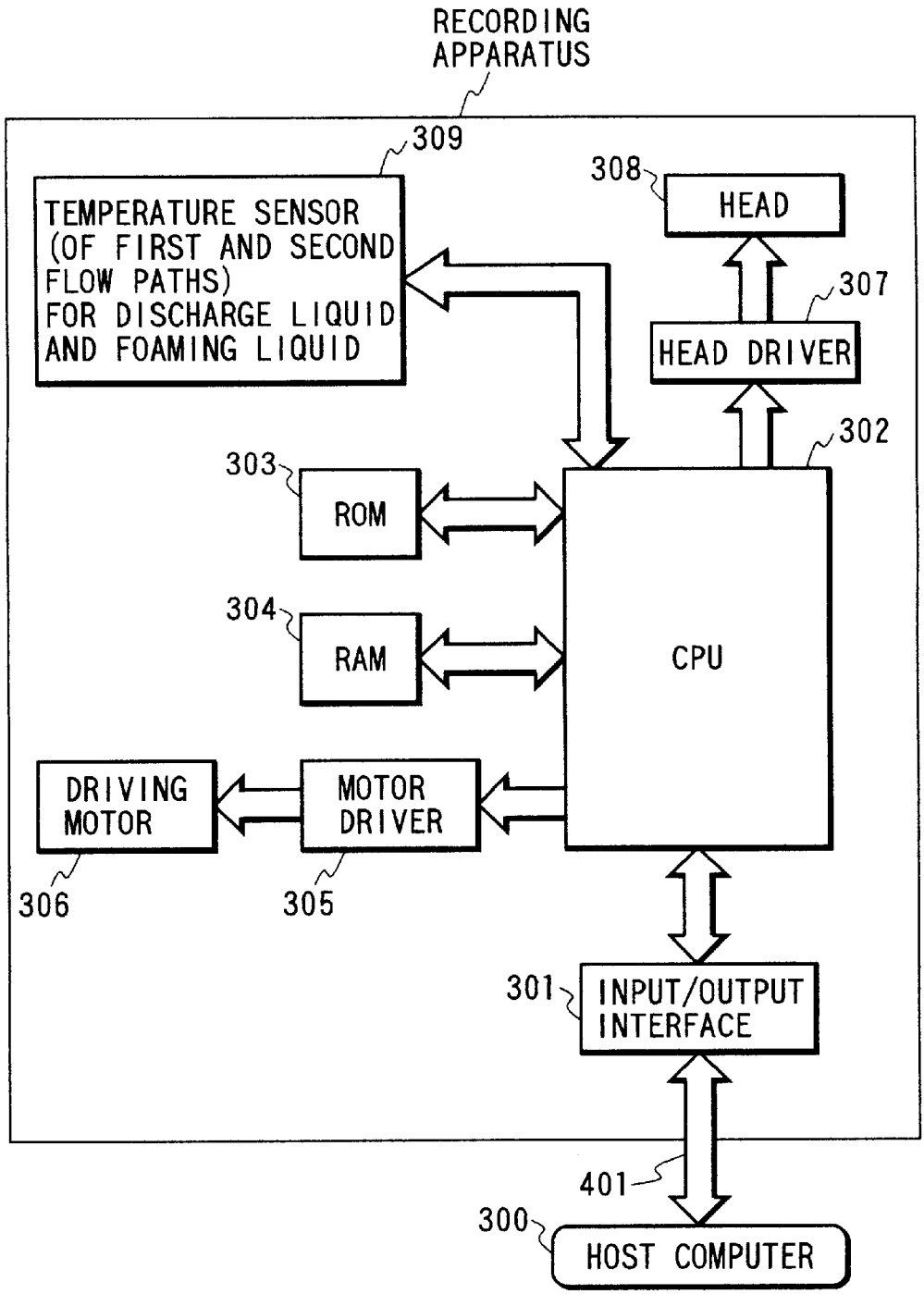
FIG. 61 is a block diagram of a liquid discharging printing apparatus.

FIG. 61 is a block diagram of the entire ink discharging print apparatus utilizing the liquid discharging method and the liquid discharging head of the present invention.

The printing apparatus receives, as the control signal, print information from a host computer 300. The print information is temporarily stored in an input interface 301 in the printing apparatus and is at the same time converted into data that can be processed in the printing apparatus, and supplied to a CPU 302 which also functions as head drive signal supply means. The CPU 302 processes the entered data by means of peripheral units such as a RAM 304, based on a control program stored in a ROM 303, thereby obtaining image data to be printed.

The CPU 302 also prepares drive data for driving the motor for displacing the print paper and the printing head in synchronization with the image data, in order to print the image data in an appropriate position on the print paper. The image data and the drive data are transmitted, respectively through a head driver 307 and a motor driver 305, to the head 308 and the motor 306, which are thus driven with controlled timing to form an image.

A temperature sensor 309, for measuring the temperatures of the liquids in the first and second liquid paths 14, 16 detects the temperatures of the liquids and exchanges signals with the CPU 302 according to a sequence as shown in FIG. 15 or FIG. 23, whereby the temperatures of the discharge liquid and the bubble generating liquid are so adjusted as to maintain satisfactory discharging characteristics.

The print medium usable in the above-explained printing apparatus and adapted to receive the liquid such as ink includes various papers, an OHP sheet, plastic materials employed in a compact disk or decorative plates, textiles, metals such as aluminum and copper, leathers such as cow leather, pig leather or artificial leather, timber such as wood or plywood, bamboo, ceramics such as a tile, a three-dimensional structural material such as sponge.

Also the above-explained printing apparatus includes a printer for printing on various papers and an OHP sheet, a plastics printing apparatus for printing on plastic materials such as of a compact disk, a metal printing apparatus for printing on a metal plate, a leather printing apparatus for printing on leather, a timber printing apparatus for printing on timber, a ceramics printing apparatus for printing on ceramic materials, a printing apparatus for printing on three-dimensional network-structure materials such as sponge, and a printing apparatus for printing on textiles.

The discharge liquid to be employed in such liquid discharging apparatus may be selected according to the respective printing medium and the printing conditions.

[Printing System]

In the following there will be explained an example of the ink jet printing system, employing the liquid discharge head of the present invention and executing printing on a print medium.

Figure 62:
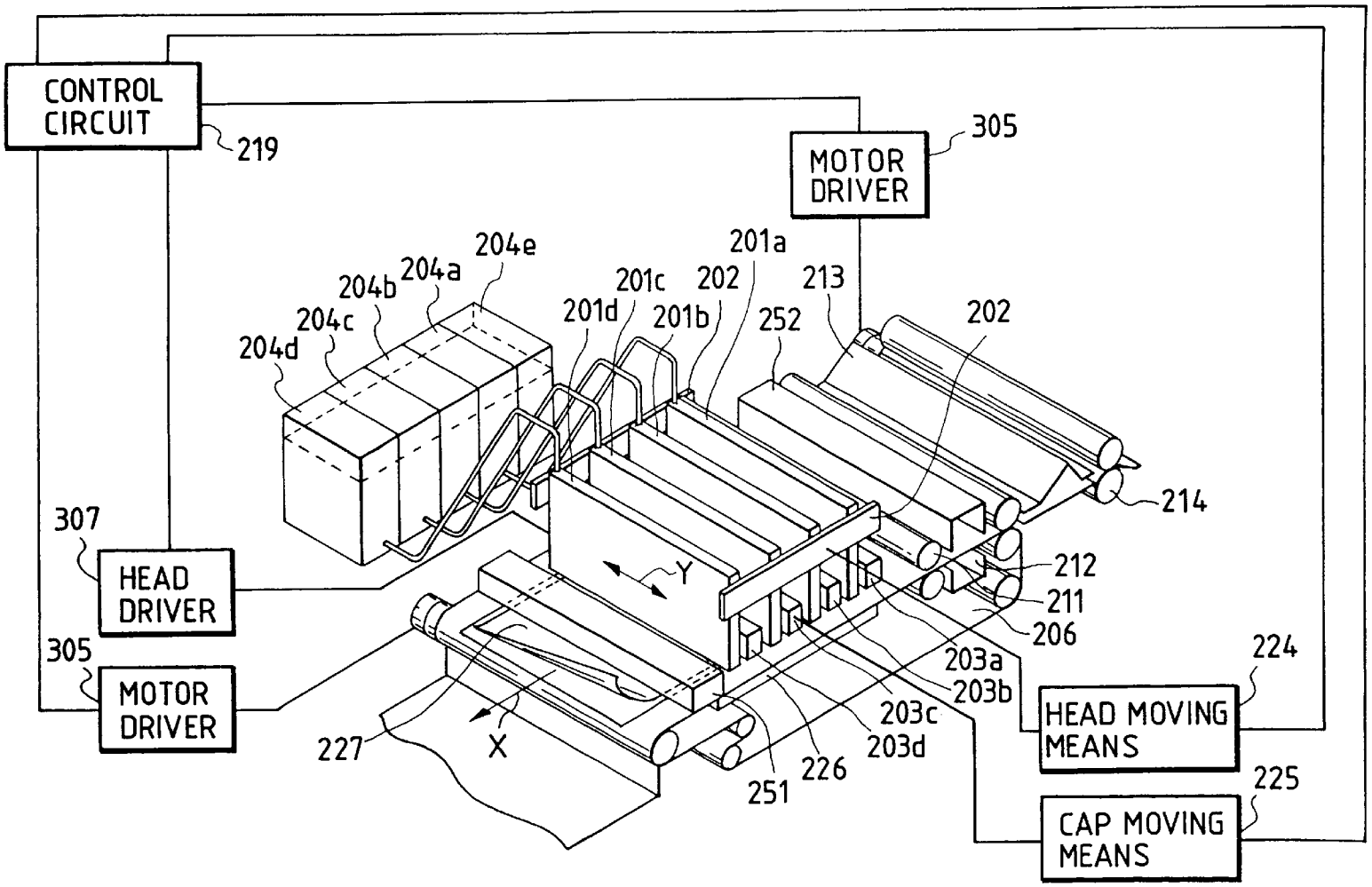
FIG. 62 is a view showing a liquid discharging print system.

FIG. 62 is a schematic view showing the configuration of an ink jet printing system, employing aforementioned liquid discharge heads 201 of the present invention, which are of full-line type, having plural discharge ports at a pitch of 360 dpi over a length corresponding to the printable width of a print medium 150, thus having the discharge ports over the entire width (in Y-direction) of the printing area of the printing medium, and four heads, respectively of yellow (Y), magenta (M), cyan (C) and black (Bk), are supported by a holder 202 in mutually parallel manner, with a predetermined interval in the X-direction.

These heads 201*a* to 201*d* receive signals from a head driver 307 constituting the drive signal supply means, and are driven by such signals.

The heads receive, as the discharge liquids, inks of Y, M, C and Bk colors from ink containers 204*a* to 204*d*. A bubble generating liquid container 204*e* contains and supplies the bubble generating liquid to the heads.

Under the heads there are provided head caps 203*a* to 203*d* which are provided therein with ink absorbent material such as sponge and are adapted to cover the discharge openings of the heads when the printing operation is not conducted, for the purpose of maintenance.

A conveyor belt 206 constitutes transport means for transporting the print medium. It is maintained along a predetermined path by various rollers, and is driven by a drive roller connected to a motor driver 305.

The ink jet printing system of this embodiment is provided with a pre-processing device 251 and a post-processing device 252 for applying various processes to the print medium before and after the printing, respectively at the upstream and downstream sides of the print medium transport path.

Such pre-process and post-process vary according to the kind of the print medium and that of the inks. For example, for metals, plastics and ceramics, the ink adhesion can be improved by surface activation by ultraviolet and ozone irradiation. Also in a print medium which easily generates static electricity such as plastics, dusts are easily deposited thereon and may hinder satisfactory printing operation. It is therefore advantageous to employ an ionizer as the pre-processing device to eliminate the static electricity from the print medium, thereby avoiding dust deposition. In case of textile printing, for the purpose of preventing the blotting and improving the dyability, there can be executed a pre-process of applying, to the textile, a material selected from an alkaline substance, a water-soluble substance, a synthetic polymer, a water-soluble metal salt, urea and thiourea. The pre-process is not limited thereto but can also be a process of maintaining the print medium at a temperature suitable for printing.

On the other hand, the post-process can for example be a fixation process for accelerating the ink fixation by a heat treatment or ultraviolet irradiation, or washing of a processing material which is applied in the pre-process and remains unreacted in the print medium.

The present embodiment employs full-line heads, but such configuration is not restrictive and the system can also be of a configuration for effecting the printing operation by transporting a small-sized head in the transversal direction of the print medium.

[Head Kit]

Figure 63:
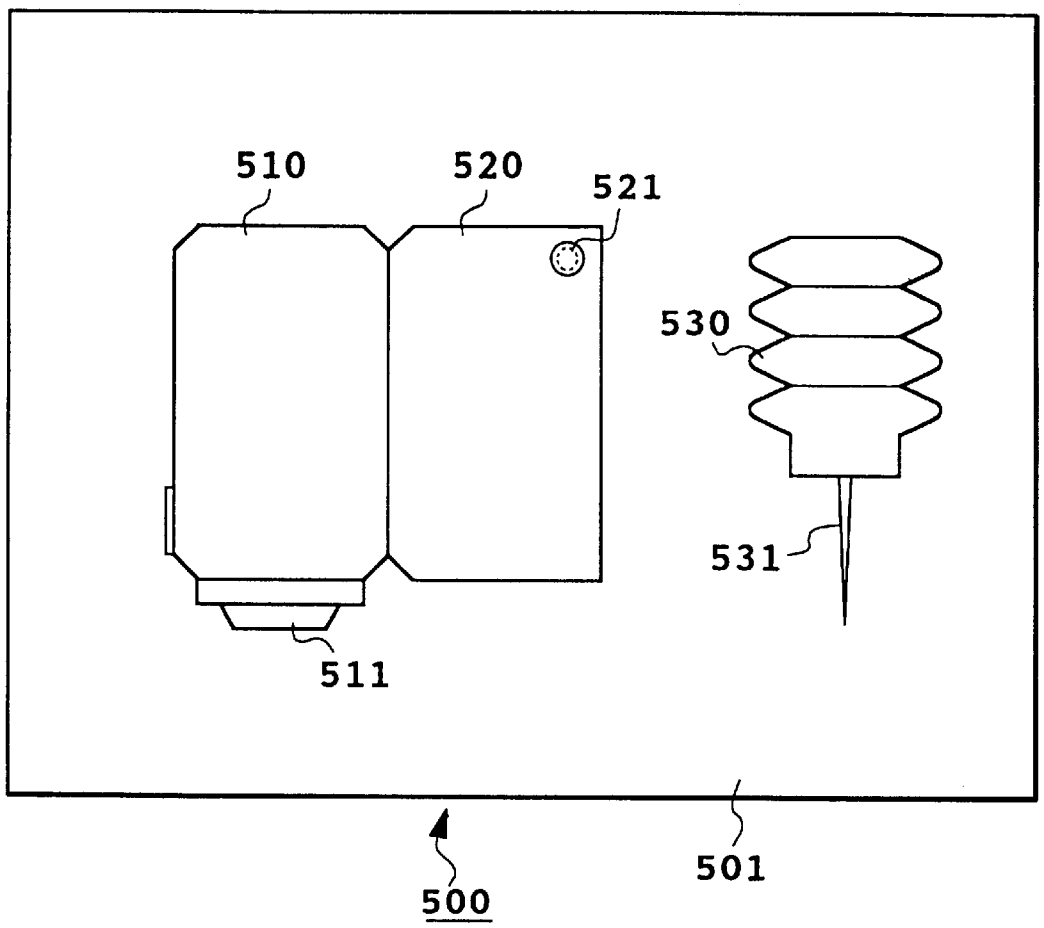
FIG. 63 is a schematic view of a head kit.
Figure 64A:
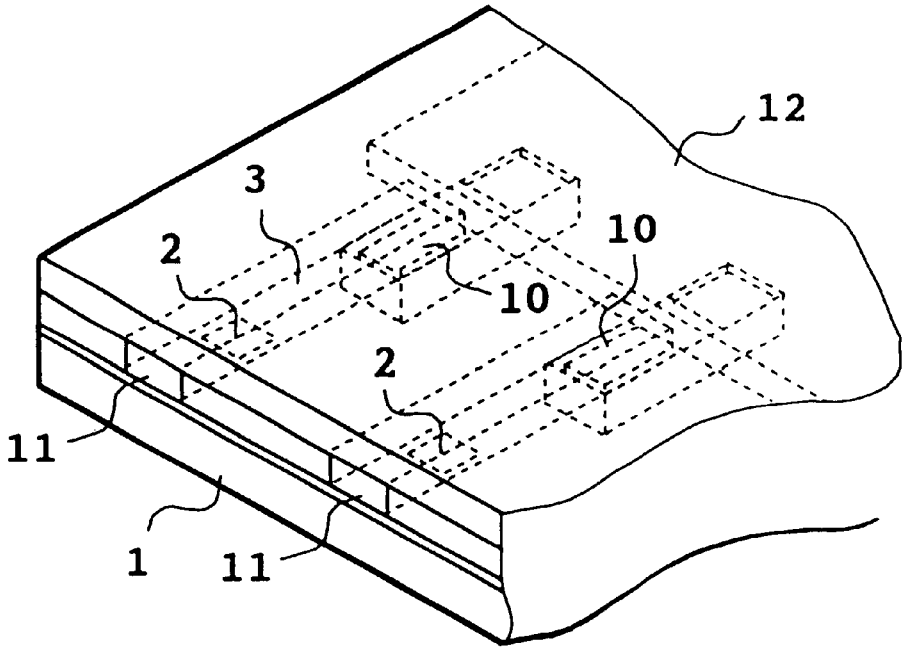
FIGS. 64A and 64B are views showing the liquid path structure of a conventional liquid discharging head.
Figure 64B:
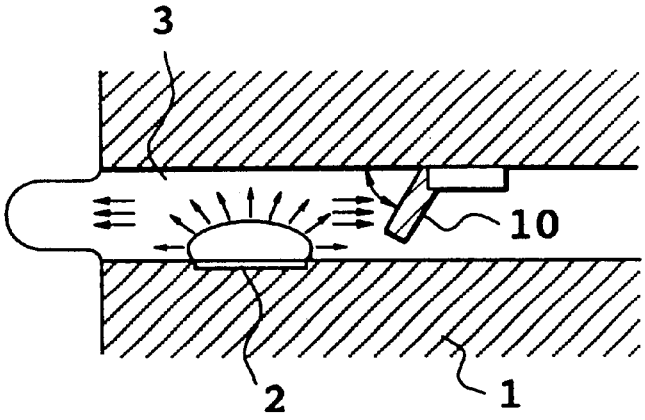

In the following there will be explained a head kit including a liquid discharging head of the present invention. FIG. 63 schematically shows such head kit 500, consisting of a head 510 of the present invention having an ink discharge unit 511, an ink or liquid container 520 integral with or separable from the head 510 and ink filling means containing ink for filling into the ink container 520, all places in a kit container 501.

When the ink is all consumed, a part of the inserting part (such as an injection needle) of the ink filling means is inserted into an external aperture 521 of the ink container 520, a connecting portion thereof with the head 510 or a hole formed in the wall of the ink container 520 and the ink is filled from the ink filling means to the ink container 520 through such inserted part.

The above-explained kit, containing the liquid discharge head 510 of the present invention, the ink container 520 and the ink filling means in a kit container, allows to easily and promptly replenish the ink into the ink container 520 when the ink therein is consumed, thereby allowing to start the printing operation promptly.

The above-explained head kit 500 is assumed to contain the ink filling means, but it may also be of a form containing a detachable ink container 520 filled with ink and a head 510 in the kit container 501, without such ink filling means.

Also the kit shown in FIG. 63 only contains the ink filling means for ink filling to the ink container 520, but it may also contain bubble generating liquid filling means for filling the bubble generating liquid container with the bubble generating liquid.

The present invention, based on a novel discharging principle utilizing the movable members and capable of obtaining a multiplying effect of the generated bubble and the thereby displaced movable member, enables efficient discharge of the liquid in the vicinity of the discharge port, thereby improving the discharge efficiency in comparison with the discharge method and the discharge head of the conventional bubble jet system.

Also the configuration featuring the present invention, in which the temperatures of the liquids in the first and second liquid paths are simultaneously or independently controlled, allows to vary the viscosity by the temperature or to maintain the liquid at temperatures matching the heat resistance and the cold resistance, in consideration of the functions of the liquids in the respective liquid paths. Also direct temperature control of the discharge liquid allows to control the viscosity thereof, thereby improving the precision and response of the temperature control, and also stabilizing or actively modulating the discharge amount. It is therefore possible to realize plural discharge amounts with a single nozzle. Also variation of the temperatures of the liquid paths allows to control the liquids of the liquid paths at optimum viscosities matching the discharge frequency.

Also the temperature of the liquid paths can be varied almost independently from the temperature change dependent on the bubble generating frequency or the pulse width.

Also the temperature adjustment can be achieved with a simple structure because of simultaneous heating of the liquids of the two liquid paths, and with satisfactory precision and response in time because of the direct heating.

Also because the temperature of the discharge liquid can be adjusted independently from that of the bubble generating liquid, the temperature of the discharge liquid can be adjusted independently from the temperature change resulting from bubble generation. The plural stable discharge amounts can be realized with a single nozzle, by independently optimizing the viscosities of the bubble generating liquid and the discharge liquid or by actively varying such viscosities. The discharge amount may be adjusted for each nozzle, depending on the mode of division and control of the electrothermal converting members.

Furthermore, the present invention can prevent lack of liquid discharge even after prolonged standing under a low temperature or humidity condition, and, even in case of such lack of liquid discharge, can immediately restore the ordinary state by a limited recovery operation such as preliminary discharge or suction recovery. As a result, it is rendered possible to reduce the time required for recovery or the liquid loss in the recovery operation, thereby significantly reducing the running cost.

Also the configuration of the present invention with improved refilling characteristics allows to achieve improved response in the continuous liquid discharge, stable bubble growth and stabilized liquid droplets, thereby realizing printing operation with a high speed or a high image quality based on high-speed liquid discharge.

Also the head of two-path configuration, employing a liquid which is capable of easy bubble generation or is reduced in the formation of deposits on the heat generating member as the bubble generating liquid, increases the freedom of selection of the discharge liquid. Thus liquids, which cannot be discharged in the conventional bubble jet discharge method such as a highly viscous liquid incapable of satisfactory bubble generation or a liquid easily forming deposits on the heat generating member, can be satisfactorily discharged.

Also liquids susceptable to heat can be discharged without detrimental effect by heat.

Also the liquid discharging head of the present invention can be utilized for printing purpose, thereby obtaining print of high image quality.

On the other hand, the configuration having the heat generating member on the movable member realizes secure displacement of the movable member by the bubble generated by the supply of energy to the head generating member, thereby securely improving the discharge amount and the discharge speed.

Also the bubble generating liquid is least mixed in the liquid discharged from the discharge port. Also the discharge liquid and the bubble generating liquid are maintained in a satisfactorily separated state, since the movable member positioned between the discharge liquid and the bubble generating liquid can prevent the mixing thereof even in the non-discharging state.

Furthermore, the configuration having the heat generating members on the movable member and the element substrate provides the following advantages.

Supply of discharge energies to the heat generating members allows to further improve the discharge amount and the discharge speed.

Also the discharge amount and the discharge speed can be varied by effecting the liquid discharge with either or both of the heat generating members, whereby achieved is the recording with improved gradation.

Also the conventional nozzle configuration can be maintained with an increase in the nozzle density and a reduction in the length despite of the improvement in the discharge amount and the discharge speed, whereby high-speed refilling can be realized to achieve high-speed printing operation.

Also optimum head designing can be easily achieved, because of a fact that the centers of gravity of the heat generating members can be made to mutually coincide, as an important factor for determining the liquid discharging characteristics represented by the discharge speed, the discharge amount and the refilling frequency.

Also since the size of the heat generating member and the position of center of gravity can be made same as in the conventional configuration, the shape and the components can be made same as those in the conventional configuration, so that the performance can be improved with minimum increase in the manufacturing cost.

Also the refilling operation can be made even faster because of the larger amount of liquid remaining in the bubble generating area.

What is claimed is:

1. A liquid discharge head comprising:

a discharge port for discharging liquid;

a bubble generating area for generating a bubble in the liquid; and a movable member provided so as to oppose to said bubble generating area and adapted to displace between a first position and a second position farther than said first position from said bubble generating area;

in which said movable member is adapted to displace from said first position to said second position by a pressure based on the bubble generation in said bubble generating area, and said bubble is caused to expand larger in the downstream side than in the upstream side of the direction toward said discharge port by the displacement of said movable member;

wherein said movable member is provided with heating means.

2. A liquid discharge head comprising:

a first liquid path communicating with a discharge port;

a second liquid path including a bubble generating area for generating a bubble in liquid by heat application thereto; and a movable member positioned between said first liquid path and said bubble generating area, having a free end at the side of said discharge port and adapted to displace said free end toward said first liquid path, based on a pressure resulting from bubble generation in said bubble generating area thereby guiding said pressure toward said discharge port;

wherein said movable member is provided with heating means.

3. A liquid discharge head comprising:

a heat generating member for generating a bubble in liquid;

a discharge port so formed as to oppose, in substantially parallel manner, to the bottom face of a liquid path constituting a flow path for said liquid;

a movable member positioned between the bottom face of said liquid path and said discharge port and having a free end adapted to displace from a first position by said bubble; and a fixed opposing face opposed to a face of said movable member at the side of bottom face of said liquid path when said free end of the movable member is displaced by said bubble, and serving to guide said bubble toward said discharge port in cooperation with said movable member at the displacement thereof;

wherein said movable member is provided with heating means.

4. A liquid discharge head comprising:

a first liquid path communicating with a discharge port;

a second liquid path including a bubble generating area for generating a bubble in liquid by heat application thereto;

a movable member positioned between said first liquid path and said bubble generating area, having a free end at the side of said discharge port and adapted to displace said free end from a first position toward said first liquid path, based on a pressure resulting from bubble generation in said bubble generating area thereby guiding said pressure toward said discharge port; and a fixed opposing face opposed to a heat generating face of said movable member when said free end of the movable member is displaced by said bubble, and serving to guide said bubble toward said discharge port in cooperation with said movable member at the displacement thereof;

wherein said movable member is provided with heating means.

5. A liquid discharge head according to claim 1, wherein said heating means is adapted to directly heat the liquid in said first liquid path.

6. A liquid discharge head according to any of claims 1 to 5, wherein second heating means is incorporated in a partition wall separating said first liquid path and said second liquid path.

7. A liquid discharge head according to any of claims 1 to 5, further comprising a bubble-generating heat generating member for heating the liquid in said second liquid path or substrate heating means for heating a substrate in the vicinity, wherein said second heating means is provided in said first liquid path.

8. A liquid discharge head according to claim 6, wherein said second heating means is adapted to directly heat the liquid in said first liquid path.

9. A liquid discharge head according to any of claims 1 to 4, wherein said heating means is adapted to generate said bubble which induces the displacement of said movable member.

10. A liquid discharge head according to claim 9, wherein said heating means is provided on a face opposite to said discharge port when said movable member is in said first position.

11. A liquid discharge head according to claim 10, further comprising second heating means for bubble generation, formed in a part of the liquid path opposed to said heating means across the bubble generating area when said movable member is in said first position.

12. A liquid discharge head according to claim 11, wherein said bubble is generated by said heating means provided on said movable member after the bubble generation by said second heating means.

13. A liquid discharge head according to claim 11:

wherein discharge speed and discharge amount of a discharge liquid are adjusted by independent or simultaneous bubble generations by said heating means provided on said movable member and the second heating means.

14. A liquid discharge head according to claim 11:

wherein discharge power is increased by bubble generation by said heating means provided on said movable member, after bubble generation by said second heating means.

15. A head cartridge comprising:

a liquid discharge head according to any of claims 1 to 4; and a liquid container containing liquid to be supplied to said liquid discharge head.

16. A liquid discharge apparatus comprising:

a liquid discharge head according to any of claims 1 to 4; and drive signal supply means for supplying a drive signal for causing said liquid discharge head to discharge liquid.

17. A liquid discharge apparatus comprising:

a liquid discharge head according to any of claims 1 to 4; and print medium transport means for transporting a print medium for receiving the liquid discharged from said liquid discharge head.

18. A print system comprising:

a liquid discharge apparatus according to claim 17; and a post-process device for accelerating the fixation of said liquid to a print medium after printing.

19. A print system comprising:

a liquid discharge apparatus according to claim 17; and a pre-process device for increasing the fixation of said liquid to a print medium before printing.

20. A head kit comprising:

a liquid discharge head according to any of claims 1 to 4; and a liquid container containing liquid to be supplied to said liquid discharge head.

21. A liquid discharge head according to any of claims 1 to 4, wherein a recovery operation is conducted after or during temperature adjustment in said first liquid path.

22. A liquid discharge head according to claim 1, wherein a recovery operation is conducted after or during temperature adjustment in said second liquid path.

23. A liquid discharge head according to claim 1, wherein a recovery operation is conducted after or during temperature adjustment in said first and second liquid paths.

24. A liquid discharge head according to any of claims 22 or 23, wherein recovery is conducted by suction, pressurization or suction and pressurization.

25. A liquid discharge head according to any of claims 22 or 23, wherein recovery is conducted by liquid discharge at the recovery of the second liquid path.

26. A liquid discharge head according to any of claims 22 to 23;

wherein a heat generating member is provided in a position opposed to said movable member, and a space between said heat generating member and said movable member is said bubble generating area.

27. A liquid discharge head according to claim 26, wherein said bubble is generated by a film boiling phenomenon, induced in the liquid by the transmission of head generated by the heat generating member to the liquid.

28. A liquid discharge head according to claim 26, wherein the liquid is supplied onto said heat generating member along a substantially flat or smooth internal wall at the upstream side of the heat generating member.

29. A liquid discharge head according to claim 26, wherein the entire effective bubble generating area of said heat generating member is opposed to said movable member.

30. A liquid discharge head according to claim 26, wherein the entire area of said heat generating member is opposed to said movable member.

31. A liquid discharge head according to claim 26, wherein the fulcrum of said movable member is not positioned directly above said heat generating member.

32. A liquid discharge head according to claim 26, wherein said free end of said movable member is positioned at the side of the discharge port, with respect to said heat generating member.

33. A liquid discharge head according to claim 22 or 23, wherein said heat generating member effects temperature adjustment in said second liquid path.

34. A liquid discharge head according to claim 26, wherein said free end is positioned at the downstream side of the liquid flow, with respect to the a real center of said heat generating member.

35. A liquid discharge head according to any of claims 22 or 23, wherein, with the displacement of said movable member, a part of the generated bubble extends in said first liquid path.

36. A liquid discharge head according to any of claims 22 to 23, wherein, in the course of displacement of said movable member, there is a state where said generated bubble is in contact with said movable member.

37. A liquid discharge head according to any of claims 22 or 23, wherein the liquid supplied to said first liquid path and that supplied to said second liquid path are same.

38. A liquid discharge head according to any of claims 22 or 23, wherein the liquid supplied to said first liquid path and that supplied to said second liquid path are mutually different.

39. A liquid discharge head according to any of claims 22 or 23, wherein the liquid supplied to said second liquid path is superior to that supplied to said first liquid path in at least one of low viscosity, bubble generating ability and thermal stability.

40. A liquid discharge head comprising:

a first liquid path communicating with a discharge port;

a second liquid path including a bubble generating area for generating a bubble in liquid by heat application thereto; and a movable member positioned between said first liquid path and said bubble generating area, having a free end at the side of said discharge port and adapted to displace said free end toward said first liquid path, based on a pressure resulting from bubble generation in said bubble generating area thereby guiding said pressure toward said discharge port;

wherein said head further comprises heating means for directly heating liquid in said first and second liquid paths, with heating in said first liquid path being independent of heating in said second liquid path.

41. A liquid discharge head according to claim 40, wherein said heating means is incorporated in a partition wall separating said first liquid path and said second liquid path.

42. A liquid discharge head according to claim 40 further comprising a bubble-generating electrothermal converting member for heating the liquid in said second liquid path or substrate heating means for heating a substrate in the vicinity.

43. A liquid discharge method utilizing a liquid discharge head including a first liquid path communicating with a discharge port, a second liquid path including a bubble generating area, and a movable member having a free end at the side of said discharge port and positioned between said first liquid path and said bubble generating area, and comprising steps of generating a bubble in said bubble generating area, displacing said free end toward said first liquid path, based on a pressure resulting from bubble generation and guiding said bubble toward the discharge port of said first liquid path;

wherein heating means is provided for directly heating liquid in said first and second liquid paths and is adapted to heat the interior said first and second liquid paths, with heating of the interior of said first liquid path being independent of heating of the interior of said second liquid path.

44. A liquid discharge method according to claim 43, wherein a partition wall is provided for separating said first and second liquid paths, and a heat generating member for temperature adjustment is incorporated in said partition wall and is adapted to effect temperature adjustment of both of the liquids in said first and second liquid paths.

45. A liquid discharge method according to claim 43, wherein said heating means includes a heat generating member for temperature adjustment provided in a cover plate constituting said first liquid path of said liquid discharge head or on the surface of the liquid path, and said heat generating member is adapted to directly effect the temperature adjustment of the liquid in said first liquid path.

46. A liquid discharge method according to claim 44, or 45, wherein said heating means is adapted to achieve heat generation by the use of a metal and irradiation of a high-frequency electromagnetic wave thereto.

47. A liquid discharge method according to claim 43, wherein said heating means includes an electrothermal converting member for temperature adjustment as said heat generating member, in a partition between the nozzles of said liquid discharge head, and said heat generating member is adapted to directly effect temperature adjustment of the liquid in said first liquid path.

48. A liquid discharge method according to claim 43, wherein said heating means effects temperature adjustment by forming a cover plate of said liquid discharge head facing said first liquid path with an infrared transmitting member, irradiating an infrared light from the side of the cover plate to cause the liquid itself in said first liquid path to absorb the energy of the infrared light thereby directly heating said liquid.

49. A liquid discharge method according to claim 43, wherein said heating means simultaneously effects temperature adjustment of the liquid in said second liquid path, by varying the infrared transmittance or reflectivity of a partition wall separating said first and second liquid paths, thereby regulating the proportion of heating of the liquids in said first and second liquid paths.

50. A liquid discharge method according to claim 43, wherein said liquid discharge head is adapted to effect temperature adjustment of the liquid in said second liquid path by the bubble-generating electrothermal converting member or a heat generating member provided on a substrate in the vicinity.

51. A liquid discharge method according to claim 43, wherein said bubble is obtained by film boiling of said second liquid, induced by the electrothermal converting member.

52. A liquid discharge method according to claim 45 or 50, wherein said heating means employs an infrared absorbing member and effects temperature adjustment of the liquid by irradiating said infrared absorbing member with infrared light.

53. A liquid discharge method according to claim 43, wherein said heating means includes a temperature detector for detecting the temperature of the liquid in the first liquid path and is adapted to effect temperature adjustment based on a detection value of said temperature detector.

54. A liquid discharge method utilizing a liquid discharge head including a first liquid path communicating with a discharge port, a second liquid path including a bubble generating area, and a movable member having a free end at the side of said discharge port and positioned between said first liquid path and said bubble generating area, and comprising steps of generating a bubble in said bubble generating area, displacing said free end toward said first liquid path, based on a pressure resulting from bubble generation and guiding said bubble toward the discharge port of said first liquid path:

wherein provided are a first temperature adjustment means for temperature adjustment of a first liquid in said first liquid path and a second temperature adjustment means for temperature adjustment of a second liquid in said second liquid path, and different temperatures are set in said first and second temperature adjustment means.

55. A liquid discharge apparatus comprising:

a liquid discharge head including a grooved member integrally provided with plural discharge ports for discharging liquid, plural grooves for constituting first liquid paths respectively corresponding to and directly communicating with said discharge ports and a recess constituting a first common liquid chamber for supplying said plural first liquid paths with the liquid; an element substrate provided with plural heat generating members for generating bubble in the liquid by giving heat thereto; and a partition wall positioned between said grooved member and said element substrate, constituting a part of the walls of second liquid paths corresponding to said heat generating members, and provided, in positions opposed to said heat generating members, with movable members adapted to displace toward said first liquid paths by a pressure based on said bubble generation; and temperature adjustment means for effecting independent temperature adjustments of the liquid in said first and second liquid paths.

56. A liquid discharge apparatus according to claim 55, wherein said temperature adjustment means is a heat generating member incorporated in the partition wall separating said first and second liquid paths and adapted to jointly effect the temperature adjustment of the liquid in said liquid paths.

57. A liquid discharge printing method utilizing a liquid discharge head including a first liquid path communicating with a discharge port, a second liquid path including a bubble generating area, and a movable member having a free end at the side of said discharge port and positioned between said first liquid path and said bubble generating area; and discharging a printing liquid by generating a bubble in said bubble generating area, displacing the free end of said movable member toward said first liquid path by a pressure resulting from said bubble generation and guiding said pressure toward the discharge port of said first liquid path by the displacement of said movable member;

wherein temperatures of the liquids in said first and second liquid paths are adjustable independently of each other.

58. A liquid discharge printing method according to claim 57, wherein a heat generating member for temperature adjustment is incorporated in the partition wall separating said first and second liquid paths and effects simultaneous temperature adjustments of the liquids in said liquid paths.

59. A liquid discharge printing method according to claim 57, wherein a heat generating member for temperature adjustment is incorporated in a cover plate of said liquid discharge head constituting said first liquid paths or on the surface of the liquid paths and effects direct temperature adjustment of the liquid in said first liquid path.

60. A liquid discharge apparatus comprising:

a liquid discharge head including a first liquid path communicating with a discharge port, a second liquid path including a bubble generating area for bubble generation in liquid by heat supply thereto, a movable member positioned between said first liquid path and said bubble generating area, having a free end at the side of the discharge port and displacing said free end toward said first liquid path by a pressure resulting from bubble generation in said bubble generating area thereby guiding said pressure toward the discharge port of said first liquid path, and a sub heater for temperature adjustment of liquid in said first and second liquid paths, with temperature adjustment of liquid in said first liquid path being independent of temperature adjustment of liquid in said second liquid path;

drive signal supply means for supplying a drive signal for causing said liquid discharge head to discharge the liquid; and recovery means for said liquid discharge head.

61. A liquid discharge apparatus comprising:

a liquid discharge head including a grooved member integrally provided with plural discharge ports for discharging liquid, plural grooves for constituting first liquid paths respectively corresponding to and directly communicating with said discharge ports and a recess constituting a first common liquid chamber for supplying said plural first liquid paths with the liquid; an element substrate provided with plural heat generating members for generating bubble in the liquid by giving heat thereto; a partition wall positioned between said grooved member and said element substrate, constituting a part of the walls of second liquid paths corresponding to said heat generating members, and provided, in positions opposed to said heat generating members, with movable members adapted to displace toward said first liquid paths by a pressure based on said bubble generation; and a sub heater provided in said partition wall for temperature adjustment of liquid in said first and second liquid paths, with temperature adjustment of liquid in said first liquid path being independent of temperature adjustment of liquid in said second liquid path;

drive signal supply means for supplying a drive signal for causing said liquid discharge head to discharge the liquid; and recovery means for said liquid discharge head.

62. A liquid discharge apparatus comprising:

a liquid discharge head including a first liquid path communicating with a discharge port, a second liquid path including a bubble generating area for bubble generation in liquid by heat supply thereto, a movable member positioned between said first liquid path and said bubble generating area, having a free end at the side of the discharge port and displacing said free end toward said first liquid path by a pressure resulting from bubble generation in said bubble generating area thereby guiding said pressure toward the discharge port of said first liquid path, and a sub heater for temperature adjustment of liquid in said first and second liquid paths, with temperature adjustment of liquid in said first liquid path being independent of temperature adjustment of liquid in said second liquid path;

print medium transport means for transporting a print medium for receiving the liquid discharged from said liquid discharge head; and recovery means for said liquid discharge head.

63. A liquid discharge apparatus comprising:

a liquid discharge head including a grooved member integrally provided with plural discharge ports for discharging liquid, plural grooves for constituting first liquid paths respectively corresponding to and directly communicating with said discharge ports and a recess constituting a first common liquid chamber for supplying said plural first liquid paths with the liquid; an element substrate provided with plural heat generating members for generating bubble in the liquid by giving heat thereto; a partition wall positioned between said grooved member and said element substrate, constituting a part of the walls of second liquid paths corresponding to said heat generating members, and provided, in positions opposed to said heat generating members, with movable members adapted to displace toward said first liquid paths by a pressure based on said bubble generation; and a sub heater provided in said partition wall for temperature adjustment of liquid in said first and second liquid paths, with temperature adjustment of liquid in said first liquid path beinq independent of temperature adjustment of liquid in said second liquid path;

print medium transport means for transporting a print medium for receiving the liquid discharged from said liquid discharge head; and recovery means for said liquid discharge head.

64. A liquid discharge apparatus according to any of claims 60 to 63, capable of printing by discharging ink from said liquid discharge head and depositing the ink on a print paper.

65. A liquid discharge apparatus according to any of claims 60 to 63, capable of printing by discharging ink from said liquid discharge head and depositing the ink on textile.

66. A liquid discharge apparatus according to any of claims 60 to 63, capable of printing b discharging ink from said liquid discharge head and depositing the ink on a plastic material.

67. A liquid discharge apparatus according to any of claims 60 to 63, capable of printing by discharging ink from said liquid discharge head and depositing the ink on a metal.

68. A liquid discharge apparatus according to any of claims 60 to 63, capable of printing by discharging ink from said liquid discharging head and depositing the ink on timber.

69. A liquid discharge apparatus according to any of claims 60 to 63, capable of printing by discharging ink from said liquid discharge head and depositing the ink on leather.

70. A liquid discharge apparatus according to any of claims 60 to 63, capable of printing by discharging inks of plural colors from said liquid discharge head and depositing the inks on a print medium.

71. A liquid discharge apparatus according to any of claims 60 to 63, wherein said discharge port is provided in plural units over the entire width of the printable area of the print medium.

72. A print system comprising a liquid discharge apparatus according to any of claims 60 to 63, and a post-processing device for accelerating fixation of the liquid to the print medium after printing.

73. A print system comprising a liquid discharge apparatus according to any of claims 60 to 63, and a pre-processing device for increasing fixation of the liquid to the print medium before printing.

74. A liquid discharge head comprising:

a first liquid path communicating with a discharge port;

a second liquid path including a bubble generating area for generating a bubble in liquid by heat application thereto;

a movable member positioned between said first liquid path and said bubble generating area, having a free end at the side of said discharge port and adapted to displace said free end toward said first liquid path, based on a pressure resulting from bubble generation in said bubble generating area thereby guiding said pressure toward said discharge port; and heating means on said movable member in a position corresponding to said bubble generating area in said second liquid path.

* * * * *

UNITED STATES PATENT AND TRADEMARK OFFICE

CERTIFICATE OF CORRECTION

PATENT NO. : 6,231,167 B1
DATED : May 15, 2001
INVENTOR(S) : Tsuboi et al.

It is certified that error appears in the above-identified patent and that said Letters Patent is hereby corrected as shown below:

Title page,
Item [57], ABSTRACT, line 5, "there by" should read -- thereby --.

Column 2,
Line 7, "as" should read -- so as --; and
Line 41, "discharge" should read -- discharged --.

Column 3,
Line 6, "view point" should read -- viewpoint --;
Line 21, "directly" should read -- directing --;
Line 29, "applicant" should read -- applicants -- and "on" should read -- based on --; and
Line 52, "separate" should read -- separated --.

Column 4,
Line 19, "displace" should read -- be displaced --;
Line 39, "port." should read -- port, --;
Line 52, "displace" should read -- be displaced --; and
Line 53, "opposed" should read -- be opposed --.

Column 5,
Line 8, "of" should read -- of a --.

Column 8,
Line 6, "of" should read -- of a --.

Column 9,
Line 5, "entire" should read -- the entire --;
Line 9, "member;" should read -- members; --;
Line 12, "member" should read -- members --;
Line 17, "member;" should read -- members; --; and
Line 36, "energy" should read -- energy of --.

UNITED STATES PATENT AND TRADEMARK OFFICE

CERTIFICATE OF CORRECTION

PATENT NO. : 6,231,167 B1
DATED : May 15, 2001
INVENTOR(S) : Tsuboi et al.

It is certified that error appears in the above-identified patent and that said Letters Patent is hereby corrected as shown below:

Column 10,
Line 56, close up right margin; and
Line 57, close up right margin.

Column 15,
Line 62, "satisfactory" should read -- satisfactorily --.

Column 23,
Line 24, "downstream." should read -- downstream --.

Column 35,
Line 46, "sticks" should read -- stick --.

Column 48,
Line 32, "eight" should read -- eighth --.

Column 50,
Line 21, "mace" should read -- maced --.

Column 52,
Line 3, "electric" should read -- electrical --; and
Line 31, "used" should read -- use --.

Column 60,
Line 55, "interior" should read -- interior of --.

Column 62,
Line 9, "bubble" should read -- a bubble --.

Column 63,
Line 14, "bubble" should read -- a bubble --; and
Line 62, "bubble" should read -- a bubble --.

UNITED STATES PATENT AND TRADEMARK OFFICE

CERTIFICATE OF CORRECTION

PATENT NO. : 6,231,167 B1
DATED : May 15, 2001
INVENTOR(S) : Tsuboi et al.

It is certified that error appears in the above-identified patent and that said Letters Patent is hereby corrected as shown below:

Column 64,
Line 21, "b" should be -- by --.

Signed and Sealed this

Ninth Day of April, 2002

*Attest:*

*Attesting Officer*

JAMES E. ROGAN
*Director of the United States Patent and Trademark Office*